US007678520B2

(12) United States Patent
Daifuku et al.

(10) Patent No.: US 7,678,520 B2
(45) **Date of Patent: *Mar. 16, 2010**

(54) METHOD FOR PRODUCING ELECTROPHOTOGRAPHIC TONER AND ELECTROPHOTOGRAPHIC TONER

(75) Inventors: Koji Daifuku, Hachioji (JP); Kaori Ono, Hino (JP)

(73) Assignee: Konica Minolta Holdings, Inc. (JP)

( * ) Notice: Subject to any disclaimer, the term of this patent is extended or adjusted under 35 U.S.C. 154(b) by 427 days.

This patent is subject to a terminal disclaimer.

(21) Appl. No.: 11/580,106

(22) Filed: Oct. 12, 2006

(65) Prior Publication Data

US 2007/0092819 A1 Apr. 26, 2007

(30) Foreign Application Priority Data

Oct. 21, 2005 (JP) ..... 2005-306990
Sep. 7, 2006 (JP) ..... 2006-242522

(51) Int. Cl.
*G03G 9/08* (2006.01)

(52) U.S. Cl. ..... 430/108.1; 430/137.14

(58) Field of Classification Search ..... 430/108.1, 430/137.14

See application file for complete search history.

(56) References Cited

U.S. PATENT DOCUMENTS 5,892,033 A * 4/1999 Komamura et al. ..... 544/225
2002/0064722 A1* 5/2002 Endo et al. ..... 430/108.6
2006/0046177 A1* 3/2006 Daifuku et al. ..... 430/108.21
2006/0093935 A1* 5/2006 Ono et al. ..... 430/108.1

FOREIGN PATENT DOCUMENTS

| | | |
|---|---|---|
| JP | 05-011504 | 1/1993 |
| JP | 05-034980 | 2/1993 |
| JP | 05-072792 | 3/1993 |
| JP | 08-069128 | 3/1996 |
| JP | 09-026673 | 1/1997 |
| JP | 10-020559 | 1/1998 |
| JP | 11-160914 | 6/1999 |
| JP | 2002-169336 | 6/2002 |
| JP | 2002-221823 | 8/2002 |
| JP | 2006-106561 | 4/2006 |

OTHER PUBLICATIONS http://www.ultrex.net/ultrex/products/simitri/simitri_white_paper.pdf.
www.vlga.nl/nieuws/9221/toner-s-finer-particles-improve-reproduction.htm; Published Aug. 15, 2005.
Turkevich, John. Colloidal Gold Part II. Gold Bull. 1985, 18, (4). p. 127, last paragraph in left column.
http://konicaminolta.jp/about/research/technology report/2000/pdf/45.pdf; Published Jan. 2000.

* cited by examiner

*Primary Examiner*—John L Goodrow
(74) *Attorney, Agent, or Firm*—Cantor Colburn LLP

(57) ABSTRACT

A method for producing an electrophotographic toner comprising the steps of: (1) mixing a water-insoluble organic solvent, an oil-soluble dye capable of chelating with a metal, a metal compound and water to form an oil-soluble dye dispersion, (2) removing the organic solvent from the oil-soluble dye dispersion to form colored microscopic particles, and (3) adding an emulsion thermoplastic resin to the colored microscopic particles so as to associate the particles with slow coagulation.

12 Claims, 1 Drawing Sheet

METHOD FOR PRODUCING ELECTROPHOTOGRAPHIC TONER AND ELECTROPHOTOGRAPHIC TONER

This application is based on Japanese Patent Application No. 2005-306990 filed on Oct. 21, 2005, and 2006-242522 filed on Sep. 07, 2006, in Japanese Patent Office, the entire content of which is hereby incorporated by reference.

FIELD OF THE INVENTION

The invention relates to a method for producing an electrophotographic toner and the electrophotographic toner.

BACKGROUND OF THE INVENTION

Recently, a color image copying method has been made practical, in which an electrostatic latent image of an original image is formed by exposing a photoreceptor to separated light and developed by a single color toner to form a single color image, and several of the thus formed color images are overlapped to form a full color image. Color toners such as a yellow, magenta and cyan toners to be used for such copying method are produced by dispersing a pigment or oil-soluble dye in a binder resin.

In an electrophotographic mage forming method, the image is generally formed according to the following procedure.

Firstly, an electrostatic latent image is formed on a photoreceptor constituted of a photoconductive substance by imagewise exposing the photoreceptor to light corresponding to image information, using various methods. Next, the electrostatic latent image formed on the photoreceptor is developed by a charged toner to form a toner image. The toner image is transferred onto an image recording medium such as typical paper or an intermediate transfer member, and is fixed onto the paper by a thermal fixing apparatus.

In a color image forming method utilizing the electrophotographic method, electrostatic latent images, each corresponding to digital image data separated into each of colors of yellow, magenta, cyan and black, and are each developed by toners of each of the same color as that of the image data. A full color image can be obtained via such a developing process by repeating it four times.

Hitherto, known organic pigments and oil-soluble dyes are used as the colorant for the electrophotographic toner. However, these pigments and the oil-soluble dyes each have specific drawbacks.

For example, though the organic pigments are generally superior to the oil-soluble dyes in resistance to heat and light, the transparency of the image is lowered because the pigments each exist in a state of particles dispersed in the toner so that the covering power is raised, but the dispersing capability of pigment is generally not that high. Therefore, transparency and saturation of the image are reduced, and color reproducibility is deteriorated. Transparency of the toner after fixing is necessary to visually confirm he color of the lowest layer without being covered by the color of the upper layer of a layered toner image. Therefore, high dispersing capability and the coloring capability of the colorant are required to maintain the true color of the original image.

As a method for resolving the drawbacks of common pigment, a method in which a flushing method is applied to form primary particles in the submicron order, without producing secondary particles, which improve transparency, and a method in which the pigment particles are covered by a binder resin and a shell resin layer to improve the charging capability, fixing capability and image uniformity of the pigment are proposed (please refer, for example, to Patent Documents 1 and 2).

However, sufficient transparency is difficult to obtain even when the image is printed out by the use of the pigment toners proposed in the above cited documents.

In principle all colors can be reproduced by the subtractive mixture of the three colors of yellow, magenta and cyan. However, many problems exist for reproducing the exact color of the original image because color reproducibility and chromaticity of the reproduced image is in practice deteriorated according to the spectral property of the pigment dispersed in thermoplastic resin, and color mixing adaptability of the toners when the toners are superposed.

On the other hand, toners employing an oil-soluble dye or a mixture of pigment and oil-soluble dye are disclosed (please refer, for example, to Patent Documents 3 and 4).

Oil-soluble dyes are generally superior in transparency and saturation since the oil-soluble dye exists in a dissolved state in the binder resin of the toner, however such oil-soluble dye is much inferior to pigment in resistance to heat and light. Regarding heat resistance, some problems are that the image density is lowered due to decomposition of the oil-soluble dye and contamination in the apparatus tends to be caused by sublimation of the oil-soluble dye during fixing the toner image by heated rollers, and offset is caused by silicone oil, in which the oil-soluble dye is dissolved and adhered onto the heated rollers.

For resolving such problems, one method in which a magenta toner containing a specific anthraquinone type dye or a chelated dye is used to enhance compatibility of light resistance and sublimation with color reproducibility and a capsuled toner constituted by a core containing a polymer resin and a color dye, and a polymer covering the core are proposed (please refer, for example, to Patent Documents 5 -7).

However, sufficient heat (sublimation) resistance and light resistance can hardly ever be obtained by toner using dye even when the image is printed out by using the above cited toners. Thus, development of a toner which more satisfies the above conditions is sought.

As to the method for producing the electrophotographic toner containing common pigment, toner particles obtained by a usual crushing method and toner particles obtained by a wet method employing a polymerization process are known. In the crushing method (or pulverizing method), the targeted toner is produced via processes of mixing the oil-soluble dye and resin, kneading, crushing and classifying. In the case of the polymerization method, for example, a polyester polymerized toner has been proposed which is produced via an interface polymerization method by dissolving or dispersing a pre-polymer, pigment and wax in a solvent and emulsified in an aqueous medium, subjected to interface polymerization and then the solvent is removed (please refer, for example, to Patent Document 8).

Further, as to a polymerized toner, proposed is a method to prepare undefined shape toner particles with association or salting out/fusion of resin particles and colorant particles as needed (please refer, for example, to Patent Document 9). However, the colored particles exhibit an average particle diameter of 112 nm, which is unsatisfactory since dispersion is conducted employing a Clearmix Dissolver. Further, as to the polymerized toner using a nickel chelating oil-soluble dye (please refer, for example, to Patent Document 10), it has been proven after detailed study by the inventors of this invention that corrugated broadening and an increase of the deterioration rate in light resistance under high humidity conditions.

Patent Document 1: Unexamined Japanese Patent Application Publication No. (hereinafter, referred to as JP-A) 9-26673

Patent Document 2: JP-A 11-160914

Patent Document 3: JP-A 5-11504

Patent Document 4: JP-A 5-34980

Patent Document 5: JP-A 8-69128
Patent Document 6: JP-A 10-20559
Patent Document 7: JP-A 5-72792
Patent Document 8: JP-A 2002-169336
Patent Document 9: JP-A 2002-221823
Patent Document 10: JP-A 2006-106561

SUMMARY OF THE INVENTION

The present invention has been achieved to overcome the above-cited problems. An object of the invention is to provide a method for producing an electrophotographic toner, and the electrophotographic toner by which suitable colorization can be made possible without the problem of dispersion into a thermoplastic resin, and further the toner is superior in heat resistance, charging capability and offset inhibiting capability, and to provide a method for producing an electrophotographic toner and the electrophotographic toner in which no hazardous metal is used.

Figure 1:
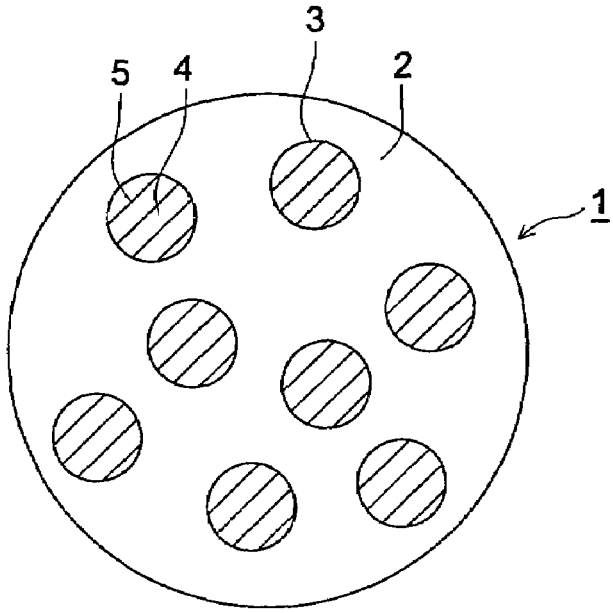
FIG. 1 shows a schematic cross section of a toner particle in which colored microscopic particles are dispersed in a thermoplastic resin.

The above object of the invention can be attained by the following means.

[Item 1]

A method for producing an electrophotographic toner comprising the steps of:

(1) mixing a water-insoluble organic solvent, an oil-soluble dye capable of chelating with a metal, a metal compound and water to form an oil-soluble dye dispersion, (2) removing the organic solvent from the oil-soluble dye dispersion to form colored microscopic particles, and (3) adding an emulsion of a thermoplastic resin to the colored microscopic particles so as to associate the particles with slow coagulation.

[Item 2]

The method for producing the electrophotographic toner of Item 1, wherein the oil-soluble dye dispersion prepared in the first process contains an oil-soluble dye represented by Formula (1) capable of chelating with a metal and a copper compound represented by Formula (2):

Formula (1)

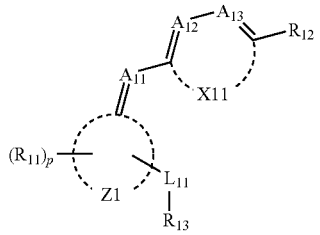

in the above formula, $R_{11}$ are each independently a hydrogen atom or a substituent; $R_{12}$ is an —$NR_{14}R_{15}$ group or an —$OR_{16}$ group; $R_{13}$ is a hydroxyl group, an alkoxy group, an aryloxy group, an amino group, an amide group, an alkylsulfonylamino group or an arylsulfonylamino group; $A_{11}$, $A_{12}$ and $A_{13}$ are each independently a —$CR_{17}$= group or an —N= atom; X11 is a group of atoms necessary for forming a five- or six-member aromatic or heterocyclic ring; Z1 is a group of atoms necessary to form a heterocyclic ring including at least one nitrogen atom which may have a substituent or may form a condensed ring with a substituent; $R_{14}$ through $R_{17}$ are each independently a hydrogen atom or a substituent; $L_{11}$ is a linking group having one or two carbon atoms or forming a part of the ring structure which may form a five- or six-member ring structure by bonding with $R_{13}$; and p is an integer of 0-3;

M(X1)m(X2)n.(W1)s Formula (2)

in the above formula, M is a divalent Cu ion; X1 and X2 are each independently a mono- or di-dentate ligand which may be the same as or differ from each other; and X1 and X2 may be bonded together; m, n and s are each an integer of 0-2; and W1 is a counter ion when a counter-ion is necessary to neutralize the electric charge.

[Item 3]

The method for producing an electrophotographic toner of Item 1, wherein the heterocyclic ring represented by Z1 is a ring represented by Formula (3) or (4);

Formula (3)

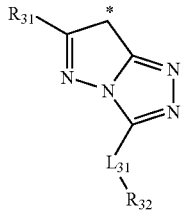

Formula (4)

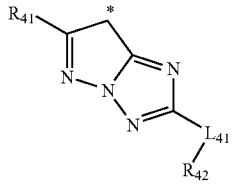

in the above formulas, $R_{31}$ and $R_{41}$ are each independently a hydrogen atom or a substituent; $R_{32}$ and $R_{42}$ are each a hydrogen atom, an alkoxy group, an aryloxy group, an amino group, an alkylsulfonylamino group or an arylsulfonylamino group; and $L_{31}$ and $L_{41}$ are each a linking group having one or two carbon atoms or forming a part of a ring structure and bonded with $A_{11}$ in Formula (1) at the site represented by *.

[Item 4]

The method for producing the electrophotographic toner of Item 1, wherein the heterocyclic ring represented by Z1 is a ring represented by Formula (5) or (6);

Formula (5)

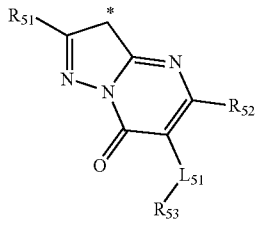

-continued

Formula (6)

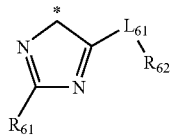

in the above formulas, $R_{51}$, $R_{52}$ and $R_{61}$ are each independently a hydrogen atom or a substituent; $R_{53}$ and $R_{62}$ are each a hydrogen atom, an alkoxy group, an aryloxy group, an amino group, an alkylsulfonylamino group or an arylsulfonylamino group; and $L_{51}$ and $L_{61}$ are each a linking group of one or two carbon atoms or forming a part of a ring structure and bonded with $A_{11}$ in Formula (1) at the site represented by *.

[Item 5]

The method for producing an electrophotographic toner of Item 1, wherein the heterocyclic ring represented by Z1 is a ring represented by Formula (7) or (8):

Formula (7)

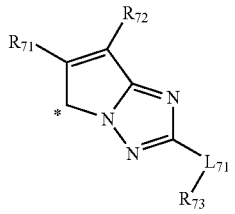

Formula (8)

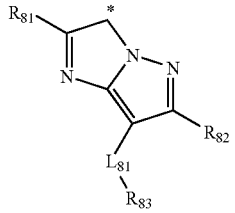

in the above formulas, $R_{71}$, $R_{72}$, $R_{81}$ and $R_{82}$ are each independently a hydrogen atom or a substituent; $R_{73}$ and $R_{83}$ are each a hydrogen atom, an alkoxy group, an aryloxy group, an amino group, an alkylsulfonylamino group or an arylsulfonylamino group; and $L_{71}$ and $L_{81}$ are each a linking group of one or two carbon atoms or forming a part of a ring structure and bonded with $A_{11}$ in Formula (1) at the site represented by *.

[Item 6]

The method for producing an electrophotographic toner of any one of Items 2-5, wherein $A_{11}$ in Formula (1) is a group represented by —$CR_{17}$= in which $R_{17}$ is a hydrogen atom or a substituent.

[Item 7]

The method for producing an electrophotographic toner of any one of Items 2-6, wherein the ligand represented by X1 or X2 in Formula (2) is also one represented by Formula (9):

Formula (9)

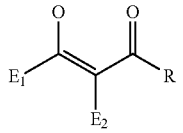

in this formula, $E_1$ and $E_2$ are each an electron-withdrawing group having a Hammett's substituent constant (σp) of 0.1-0.9; and R is an alkyl group, an aryl group, a heterocyclic group, an alkoxy group, an aryloxy group or an amino group, each of which may have a substituent.

[Item 8]

The method for producing the electrophotographic toner of any one of Items 1-7, wherein the average particle diameter of the colored microscopic particles is 10-100 nm.

[Item 9]

The method for producing the electrophotographic toner of any one of Items 1-8, wherein the oil-solunle dye dispersion further comprising a resin having different compositions from the thermoplastic resin in step (1) and the colored microscopic particle containing resin of different compositions from the thermoplastic resin formed in step (2).

[Item 10]

The method for producing the electrophotographic toner of Item 9, wherein the colored microscopic particle is constituted of a core comprising the resin and the oil-soluble dye, and a resin shell covering the core.

[Item 11]

An electrophotographic toner produced by the method for producing an electrophotographic toner of any one of Items 1-10.

[Item 12]

An electrophotographic toner containing an oil-soluble dye capable of chelating with a metal and a metal compound, wherein the amount of the metal compound is 1.1-2 times in moles of the amount of the oil-soluble dye capable of chelating with the metal.

[Item 13]

The electrophotographic toner of Item 12, wherein the oil-soluble dye is represented by Formula (1) and the metal compound is a copper compound represented by Formula (2).

The method for producing the electrophotographic toner and the electrophotographic toner of this invention can made possible suitable colorization without the problem of dispersion into the thermoplastic resin, and the toner superior in heat resistance, charging property and offset inhibiting capability, as well as transparency and color reproducibility. The method and the toner show superior targeted effect without using a hazardous metal.

DESCRIPTION OF THE PREFERRED EMBODIMENT

The method for producing the electrophotographic toner of this invention is characterized in the steps of:

(1) mixing a water-insoluble organic solvent, an oil-soluble dye capable of chelating with a metal, a metal compound, and water to form an oil-soluble dye dispersion, (2) removing the organic solvent from the oil-soluble dye dispersion to form colored microscopic particles, and (3) adding an emulsion of a thermoplastic resin to the colored microscopic particles so as to associate the particles with slow gradual coagulation.

The electrophotographic toner relating to this invention, hereinafter simply referred to as the toner, is characterized in that the toner comprises colored microscopic particles dispersed in the thermoplastic resin, and the colored microscopic particle contains a resin having different composition from the thermoplastic resin and a specific oil-soluble dye. Therefore, the toner of the invention is characterized that the colored microscopic particles containing the resin different in the composition from the thermoplastic resin (also referred to as the binder resin) and the oil-soluble dye are dispersed in the thermoplastic resin and is different from usual toner in which an oil-soluble dye is directly dispersed or dissolved in the binder resin.

As a result of the investigation by the inventors, the oil-soluble dyes each having the specific structure represented by Formulas (1)-(9) and the copper compound are found, and it is found that the color toner produced by dispersing the colored microscopic particle containing the resin different from the thermoplastic resin in the composition and the oil-soluble dye into the thermoplastic resin is superior in the hue, the image fastness, transparency and color reproducibility.

Oil-Soluble Dyes Having Specific Structure, and Copper Compound

The compounds represented by Formulas (1)-(9) are described below.

<<Compounds Represented by Formula (1)>>

In Formula (1), $R_{11}$ are independently a hydrogen atom or a substituent, $R_{12}$ is an —$NR_{14}R_{15}$ group or an —$OR_{16}$ group, $R_{13}$ is a hydroxyl group, an alkoxy group, an aryloxy group, an amino group, an amide group, an alkylsulfonylamino group or an arylsulfonylamino group, $A_{11}$ trough $A_{13}$ are each independently a —$CR_{17}$= group or an —N= atom, X11 is a group of atoms necessary to form a five- or six-member aromatic or heterocyclic ring, Z1 is a group of atoms necessary to form a five- or six-member heterocyclic ring containing at least one nitrogen atom which may have a substituent and may form a condensed ring by the substituent, $R_{14}$ through $R_{17}$ are each independently a hydrogen atom or a substituent, and $L_{11}$ is a linking group having one or two carbon atoms or forming a part of a ring structure which may form a five- or six-member ring structure by bonding with $R_{13}$, and p is an integer of from 0 to 3.

The substituent represented by $R_{11}$ is not specifically limited as long as the group can be substituted. Examples of the substituent include an alkyl group such as a methyl group, an ethyl group, a propyl group, an isopropyl group, a tert-butyl group, a pentyl group, a hexyl group, an octyl group, a dodecyl group, a tridecyl group, a tetradecyl group and a pentadecyl group; a cycloalkyl group such as a cyclopentyl group and a cyclohexyl group; an alkenyl group such as a vinyl group and an allyl group; an alkynyl group such as an ethynyl group and a propalgyl group; an aryl group such as a phenyl group and a naphthyl group; a heteroaryl group such as a furyl group, a thienyl group, a pyridyl group, pyridazyl group, prymidyl group, a pyrazyl group, a triazolyl group, an imidazolyl group, a pyrazolyl group, a thiazolyl group, a benzimidazolyl group, a benzoxazolyl group, a quinazolyl group and phthalazyl group; a heterocyclic group such as a pyrrolidyl group, an imidazolidyl group, a morpholyl group and an oxazolidyl group; an alkoxy group such as a methoxy group, an ethoxy group, a propyloxy group, a pentyloxy group, a hexyloxy group, an octyloxy group and a dodecyloxy group; a cycloalkoxy group such as a cyclopentyloxy group and a cyclohexyloxy group; an aryloxy group such as a phenoxy group and a naphthyloxy group; an alkylthio group such as a methylthio group, an ethylthio group, a propylthio group, a pentylthio group, a hexylthio group, an octylthio group and dodecylthio group; a cycloalkylthio group such as a cyclopentylthio group and a cyclohexylthio group; an arylthio group such as a phenylthio group and a naphthylthio group; an alkoxycarbonyl group such as a methyloxycarbonyl group, an ethyloxycarbonyl group, a butyloxycarbonyl group, an octyloxycarbonyl group and a dodecyloxycarbonyl group; an aryloxycarbonyl group such as a phenyloxycarbonyl group and a naphthyloxycarbonyl group; a sulfamoyl group such as an aminosulfonyl group, a methylaminosulfonyl group, a dimethylaminosulfonyl group, a butylaminosulfonyl group, a hexylaminosulfonyl group, a cyclohexylaminosulfonyl group, an octylaminosulfonyl group, a dodecylaminosulfonyl group, a phenylaminosulfonyl group, a naphthylaminosulfonyl group and a 2-pyridylaminosulfonyl group; an acyl group such as an acetyl group, an ethylcarbonyl group, a propylcarbonyl group, a pentylcarbonyl group, a cyclohexylcarbonyl group, an octylcarbonyl group, a 2-ethylheaxylcarbonyl group, a dodecylcarbonyl group, a phenylcarbonyl group, a naphthylcarbonyl group and a pyridylcarbonyl group; an acyloxy group such as an acetyloxy group, an ethylcarbonyloxy group, a butylcarbonyloxy group, an octylcarbonyloxy group, a dodecylcarbonyloxy group and a phenylcabonyloxy group; an amido group such as a methylcarbonylamino group, an ethylcarbonylamino group, a dimethylcarbonylamino group, a propylcarbonylamino group, a pentylcarbonylamino group, a cyclohexylcarbonylamino group, a 2-ethylhexylcarbonylamino group, an octylcarbonylamino group, a dodecylcarbonylamino group, a trifluoromethylcarbonylamino group, a phenylcarbonylamino group and a naphthylacarbonylamino group; a carbamoyl group such as an aminocarbonyl group, a methylaminocarbonyl group, a dimethylaminocarbonyl group, a propylaminocarbonyl group, a pentylaminocarbonyl group, a cyclohexylaminocarbonyl group, an octylaminocarbonyl group, a 2-ethylhexylaminocarbonyl group, a dodecylaminocarbonyl group, a phenylaminocarbonyl group, a naphthylaminocarbonyl group and a 2-pyridylaminocarbonyl group; a ureido group such as a methylureido group, an ethylureido group, a pentylureido group, a cyclohexylureido group, an octylureido group, a dodecylureido group, a phenylureido group, a naphthylureido group and a 2-pyridylaminoureido group; a sulfinyl group such as a methylsulfinyl group, an ethylsulfinyl group, a butylsulfinyl group, a cyclohexylsulfinyl group, a 2-ehtylhexylsulfinyl group, a dodecylsulfinyl group, a phenylsulfinyl group, a naphthylsulfinyl group and a 2-pyridylsulfinyl group; an alkylsulfonyl group such as a methylsulfonyl group, an ethylsulfonyl group, a butylsulfonyl group, a cyclohexylsulfonyl group, a 2-ehtylhexylsulfonyl group and a dodecylsulfonyl group; an arylsulfonyl group such as a phenylsulfonyl group, a naphthylsulfonyl group and 2-pyridylsulfonyl group; an amino group such as an amino group, an ethylamino group, a dimethylamino group, a butylamino group, a cyclopentylamino group, a 2-ethylhexylamino group, dodecylamino group, an anilino group, a naphthylamino group and a 2-pyridylamino group; a cyano group; a nitro group; and a halogen atom such as a fluorine atom, a chlorine atom and a bromine atom.

Among the —$NR_{14}R_{15}$ group and the —$OR_{16}$ group each represented by $R_{12}$, —$NR_{14}R_{15}$ is preferable from the viewpoint of the molar absorptivity coefficient $\epsilon$ but —$OR_{16}$ is also preferable from the viewpoint of absorption wavelength control. $R_{14}$-$R_{16}$ are each a hydrogen atom or a substituent. As the substituent, ones same as those described as $R_{11}$ can be applied. Among them, a hydrogen atom, an alkyl group, an aryl group, a heterocyclic group, an acyl group and an alkylsulfonyl group are preferable and a hydrogen atom, an alkyl group, an aryl group and an acyl group are more preferable.

$R_{13}$ is a hydroxyl group, an alkoxy group, an amino group, an amido group, an alkylsulfonylamino group or an arylsulfonylamino group, and examples of them are those described above. The hydroxyl group, alkoxy group, amino group, and alkylsulfonylamino group are preferable.

$A_{11}$-$A_{13}$ are each independently a —$CR_{17}$= group or an —N= atom, and $A_{11}$ and $A_{12}$ are each preferably a —$CR_{17}$= group. $R_{17}$ is a hydrogen atom or a substituent. The substituent is the same as those represented by $R_{11}$, and is preferably a hydrogen atom, halogen atom and alkoxycarbonyl group and more preferably the hydrogen atom.

Examples of the five- or six-member aromatic ring or heterocyclic ring represented by $A_{11}$ include a benzene ring, a naphthalene ring, a pyridine ring, a pyrazine ring, a furan ring, a thiophene ring, an imidazole ring and a thiazole ring; and the benzene ring, pyridine ring and thiophene ring are preferable.

Examples of the five- or six-member heterocyclic ring containing at least one nitrogen atom include rings derived from a pyridine ring, a pyrimidine ring, a quinoline ring, a pyrazole ring, an imidazole ring, a pyrrole ring and a pyrazoline ring such as pyrazolidine-3,5-dione; they further may have a substituent which may form a condensed ring. The structures represented by Formulas (3) through (8) are preferred.

The linking group having one or two carbon atoms or forming a part of the ring structure represented by $L_{11}$ is, for example, a substituted or unsubstituted methylene group, ethylene group, an ethine group or a group represented by Formula (10).

Formula (10)

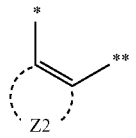

In the above formula, Z2 is a five- or six-member aromatic or heterocyclic ring which may have a substituent and bonded with Z1 and $R_{13}$ at the sites shown by * and **, respectively.

$L_{11}$ is preferably a methylene group, and a group represented by Formula (9) in which the ring represented by Z2 is a benzene ring or a pyridine ring. One in which the substituent on the group of $L_{11}$ and $R_{13}$ form a five- or six-member ring such as a furan ring is also preferable.

The ring structure may have a substituent; the substituent is preferably a halogen atom, an alkoxy group, an amino group, an acylamino group, a sulfonylamino group and an ureido group, and more preferably the halogen atom, alkoxy group, amino group and acylamino group.

Further, it is also preferable that the compound has a group capable of chelating. The group capable of chelating is a substituent including an atom having an unshared electron pare, concretely a heterocyclic group, a hydroxyl group, a carbonyl group, an oxycarbonyl group, a carbamoyl group, an alkoxy group, a heterocycloxy group, a carbonyloxy group, a urethane group, a sulfonyloxy group, an amino group, an imino group, a sulfonylamino group, a sulfamoylamino group, an acylamino group, a ureido group, a sulfonyl group, a sulfamoyl group, an alkylthio group, an arylthio group and a heterocyclothio group. As the preferable substituent, the hydroxyl group, carbonyl group, oxycarbonyl group, carbamoyl group, alkoxy group, carbonyloxy group, urethane group, sulfonyloxy group, amino group, imino group, sulfonylamino group, ureido group, alkylthio group, and arylthio group can be exemplified. The hydroxyl group, carbonyl group, carbamoyl group, alkoxy group, sulfonylamino group and acylamino group are more preferable.

<<Compound Represented by Formula (2)>>

In Formula (2), M is a di-valent Cu, X1 and X2 are each independently a mono- or di-dentate ligand, they may be bonded with together. "m", "n" and "s" are each an integer of 0 or 1. W1 is a counter ion when a counter ion is necessary for neutralizing the electric charge.

As examples of X1 and X2, those described in JP-A Nos. 2000-251957, 2000-311723, 2000-323191, 2001-6760, 2001-59062 and 2001-60467 can be cited. Concrete examples include various chelate ligands such as a halogen ion, a hydroxyl ion, ammonia, pyridine, an amine such as methyl amine, diethylamine and tributylamine, a cyanide ion, a cyanate ion, a thiolate ion, a thiocyanate ion, a bipyridine, an aminopolycarboxylic acid and 8-hydroxylquinoline. The chelating ligands are exemplified in K. Ueno, "Kireito Kagaku (Chelate Chemistry)".

Mono-dentate ligands coordinating by an acyl group, a carbonyl group, a thiocyanate group, a halogen atom, a cyano group, an alkylthio group, an arylthio group or an acryloxy group, and a ligand constituted by dialkylketone or carbonamide are preferable.

Di-dentate ligands coordinating by an acyloxy group, an oxalylene group, an acylthio group, a thioacyloxy group, an acylaminoxy group, a thiocarbamate group, a dithiocarbamate group, a thiocarbonate group, a dithiocarbonate group, a trithiocarbonate group, an alkylthio group or an arylthio group, and a ligand constituted by dialkylketone or carbonamide are preferable.

Concrete examples of X1 and X2 are listed below but the invention is not limited to them. The structural formula described below is merely one of many possible canonical resonance structures, and distinguish between the covalent bond (represented by —) and the coordinate bond (represented by . . . ) is merely superficial and not absolutely expression.

X-1

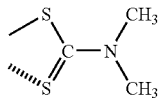

X-2

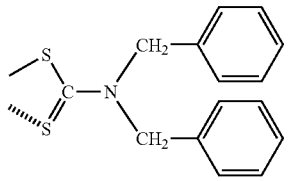

X-3

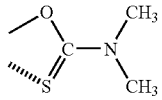

X-4

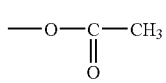

X-5

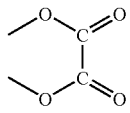

X-6

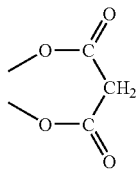

-continued
X-7
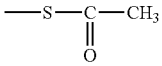
X-8
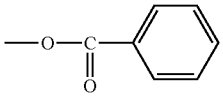
X-9
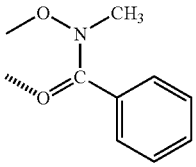
X-10
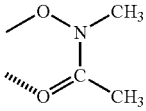
X-11
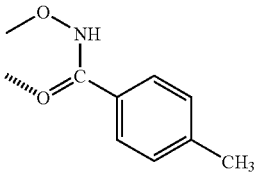
X-12
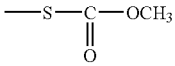
X-13
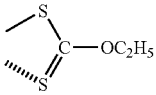
X-14
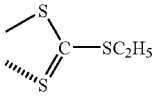
X-15
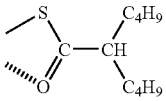
X-16
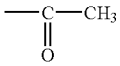
X-17
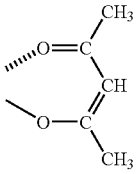
X-18
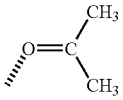
X-19
X-20
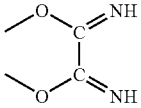
-continued
X-21
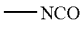
X-22
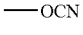
X-23
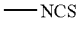
X-24
X-25
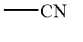
X-26
X-27
X-28
X-29
X-30
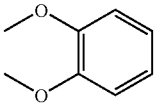
X-31
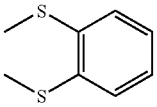
X-32
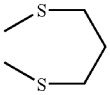
X-33
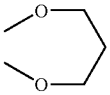
X-34
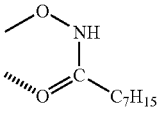
X-35
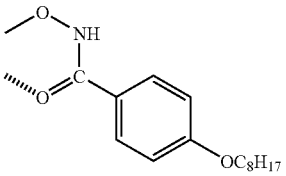
X-36
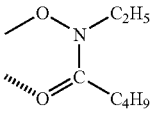
X-37
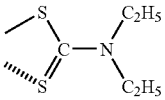
X-38
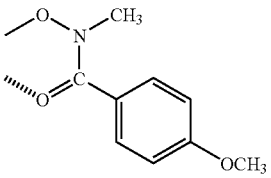

-continued
X-39
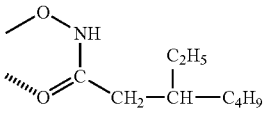
X-40
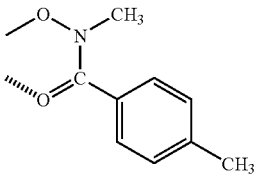
X-41
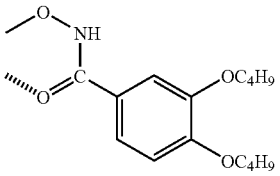
X-42
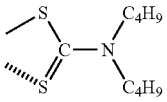
X-43
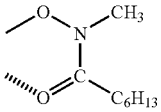
X-44
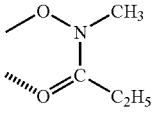
X-45
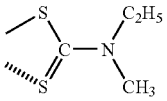
X-46
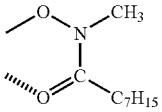
X-47
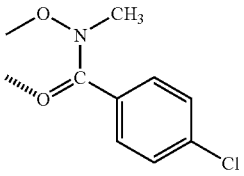
X-48
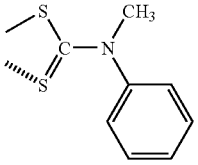
X-49
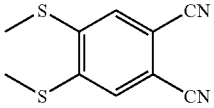
-continued
X-50
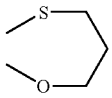
X-51
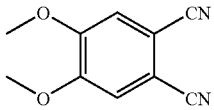
X-52
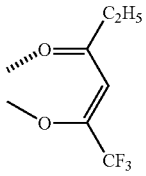
X-53
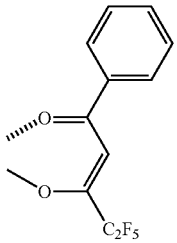
X-54
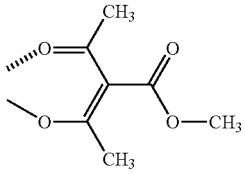
X-55
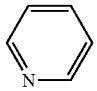
X-56
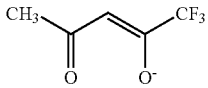
X-57
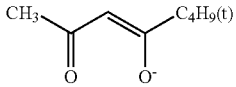
X-58
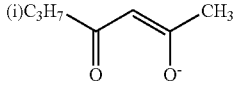
X-59
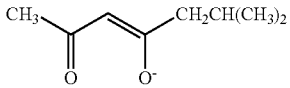
X-60
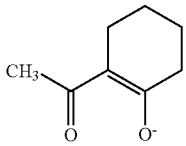

-continued
X-61
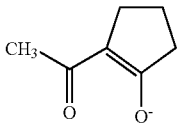
X-62
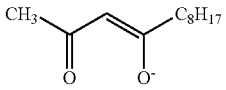
X-63
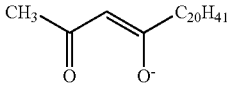
X-64
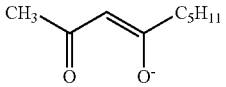
X-65
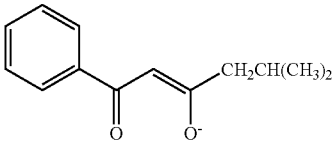
X-66
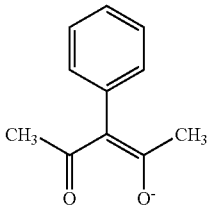
X-67
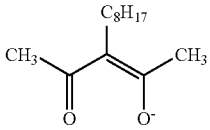
X-68
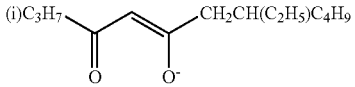
X-69
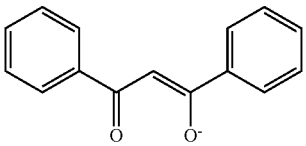
X-70
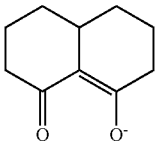
X-71
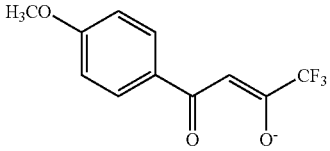
-continued
X-72
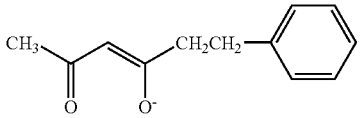
X-73
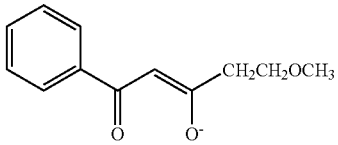
X-74
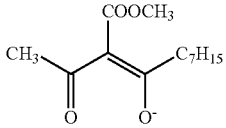
X-75
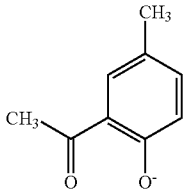
X-76
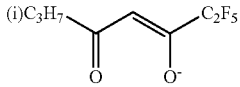
X-77
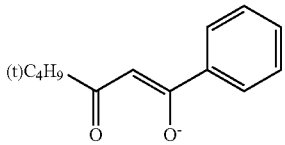
X-78
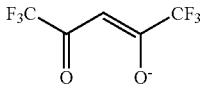
X-79
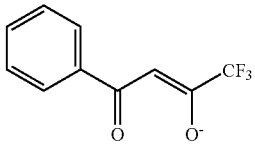
X-80
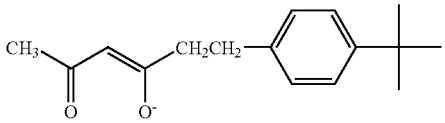
X-81
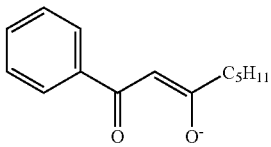
X-82
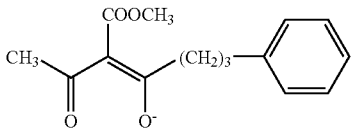

-continued
X-83
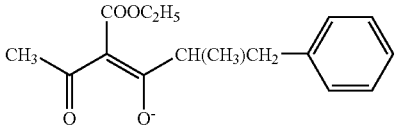
X-84
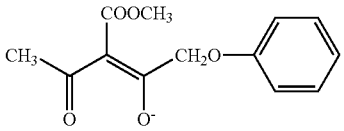
X-85
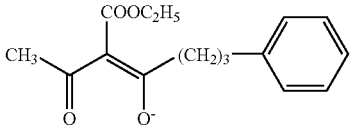
X-86
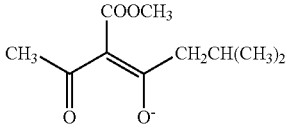
X-87
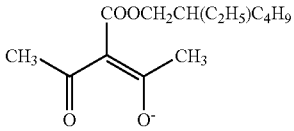
X-88
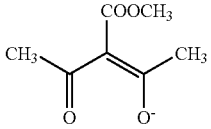
X-89
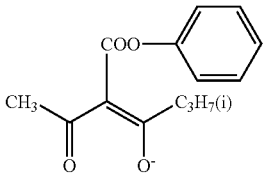
X-90
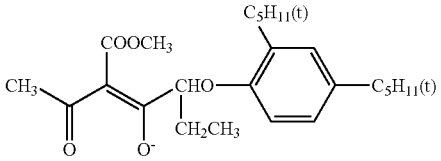
X-91
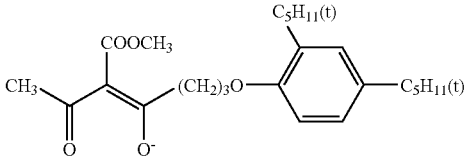
X-92
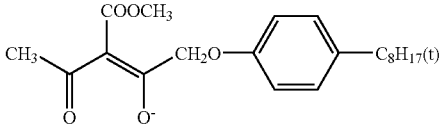
-continued
X-93
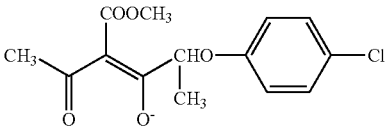
X-94
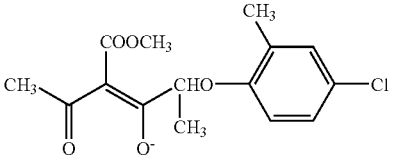
X-95
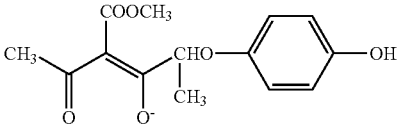
X-96
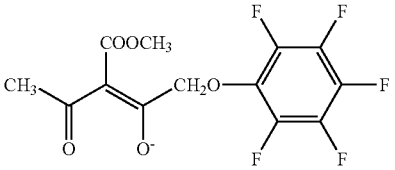
X-97
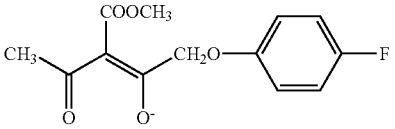
X-98
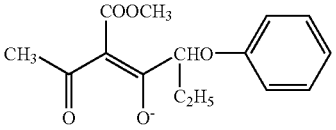
X-99
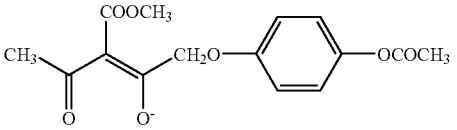
X-100
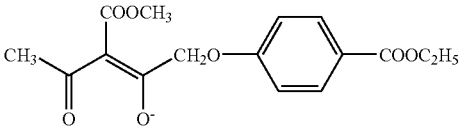
X-101
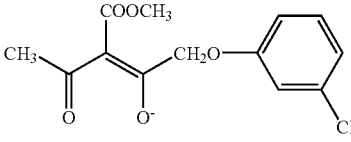
X-102
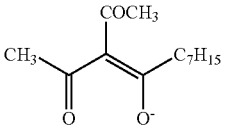
X-103
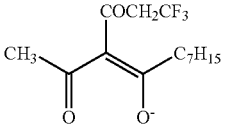

-continued

X-104

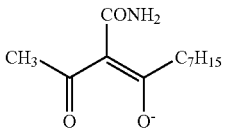

X-105

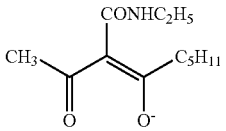

X-106

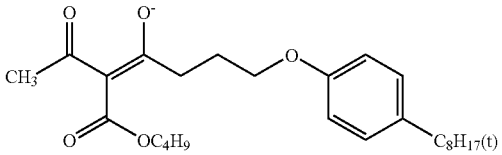

X107

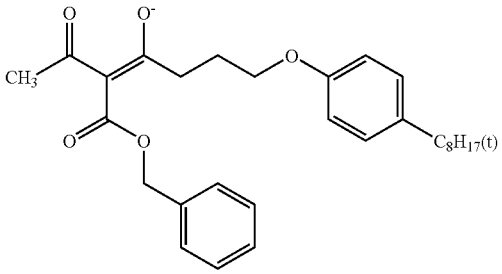

X-108

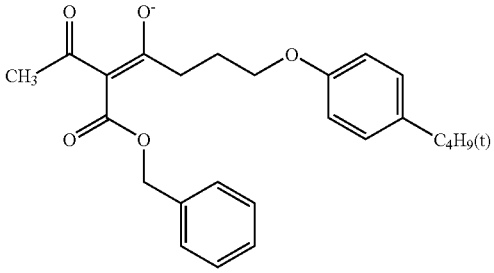

X-109

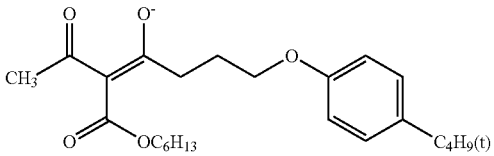

X-110

$ClO_4^-$

X-111

$BF_4^-$

X-112

$PF_6^-$

Compounds represented by Formula (9) are also preferable ligands.

Formula (9)

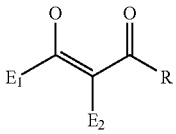

In the above formula, $E_1$ and $E_2$ are each an electron-withdrawing group having a Hammett's substitution constant (σp) of from 0.10 to 0.90, and R is an alkyl group, an aryl group, a heterocyclic group, an alkoxy group, an aryloxy group or an amino group, they may have a substituent.

The substituents represented by $E_1$ or $E_2$ each having a up value of from 0.10 to 0.90 are described below.

As the value of Hammett's substituent constant σp, the values described in the publication by Hansch, C. Leo et al such as J. Med. Chem. 16, 1207 (1973) and ibid 20, 304 (1977) are preferably utilized.

Examples of the substituent or atom having a σp value of from 0.10 to 0.90 include a chlorine atom; a bromine atom; an iodine atom; a carboxyl group; a cyano group; a nitro group; a halogen-substituted alkyl group such as trichloromethyl, trifluoromethyl, chloromethyl, trifluoromethylthiomethyl group, trifluoromethanesulfonylmethyl group and perfluorobutyl group; an aliphatic, aromatic or heterocyclic acyl group such as a formyl group, an acetyl group and a benzoyl group, an aliphatic, aromatic or heterocyclic sulphonyl group such as a trifluoromethanesulfonyl group, a methanesulfonyl group and a benzenesulfonyl group; a carbamoyl group such as a carbamoyl group, a methylcarbamoyl group, a phenylcarbamoyl group and a 2-chloro-phenylcarbamoyl group; an alkoxycarbonyl group such as a methoxycarbamoyl group, an ethoxycarbonyl group and diphenylmethylcarbonyl group; a substituted aromatic group such as a pentachlorophenyl group, a pentafluorophenyl group, a 2,4-dimethanesulfonylphenyl group and 2-trifluoromethyl-phenyl group; a heterocyclic ring residue such as a 2-benzoxazolyl group, a 2-benzothiazolyl group, a 1-phenyl-2-benzimidazolyl group and a 1-triazolyl group; an azo group such as a phenylazo group; a ditrifluoromethylamino group; a trifluoromethoxy group; an alkylsulfonyloxy group such as a methanesulfonyloxy group, an acyloxy group such as an acetyloxy group and a benzoyloxy group; an arylsulfonyloxy group such as a benzenesulfonyloxy group; a phospholyl group such as a dimethoxyphosphonyl group and a diphenylphospholyl group; a sulfamoyl group such as an N-ethylsulfamoyl group, an N,N-dipropylsulfamoyl group, an N-(2-dodecyloxyethyl)-sulfamoyl group, an N-ethyl-N-dodecylsulfamoyl group and an N,N-diethylsulfamoyl group.

Examples of the substituent having a σp value of not less than 0.35 include the cyano group; nitro group; carboxyl group; fluorine-substituted alkyl group such as trifluoromethyl group and perfluorobutyl group; aliphatic, aromatic or heterocyclic acyl group such as acetyl group, benzoyl group and formyl group, aliphatic, aromatic or heterocyclic sulfonyl group such as trifluoromethanesulfonyl group, methanesulfonyl group and benzenesulfonyl group; carbamoyl group such as carbamoyl, methylcarbamoyl group, phenylcarbamoyl group and 2-chloro-phenylcarbamoyl group; alkoxycarbonyl group such as methoxycarbonyl group, ethoxycarbonyl group and diphenylmethylcarbonyl group; fluorine- or carbonyl-substituted aromatic group such as pentafluorophenyl group and 2,4-dimethanesulfonylphenyl group; hetrocycric ring residue such as 1-tetrazolyl group; azo group such as phenylazo group; alkylsulfonyloxy group such as methanesulfonyloxy group; phospholyl group such as dimethoxyphospholyl group and diphenylphospholyl group; and sulfamoyl group.

Examples of the substituent having a σp value of not less than 0.60 include the cyano group; nitro group; and aliphatic, aromatic or heterocyclic sulfonyl group such as trifluoromethanesulfonyl group, difluoromethanesulfonyl group, methanesulfonyl group and benzenesulfonyl group.

$E_1$ and $E_2$ are preferably a halogenized alkyl group particularly a fluorine substituted alkyl group, a carbonyl group, a cyano group, an alkoxycarbonyl group, an alkylsulfonyl group and an alkylsulfonyloxy group.

Preferable substituent of R is an alkyl group, an alkoxy group, an aryloxy group or an amino group and the alkyl group, alkoxy group and aryloxy group are preferably preferred.

Concrete examples of the ligand represented by Formula (9) are listed below but the invention is not limited to them.

X-113

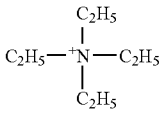

X-114

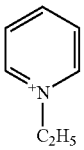

X-115

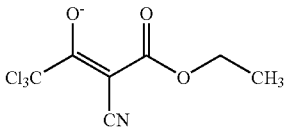

X-116

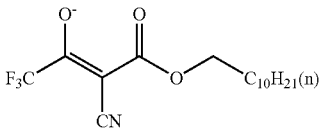

X-117

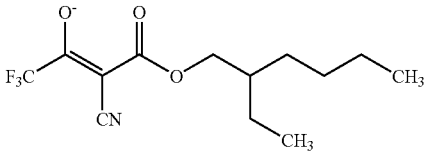

X-118

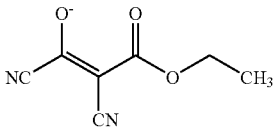

X-119

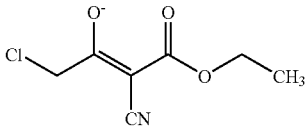

X-120

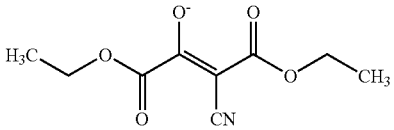

X-121

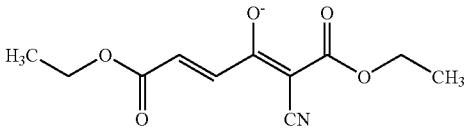

-continued

X-122

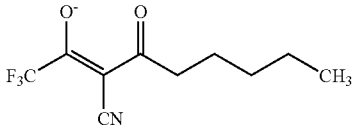

X-123

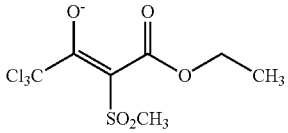

X-124

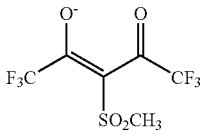

X-125

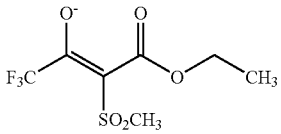

X-126

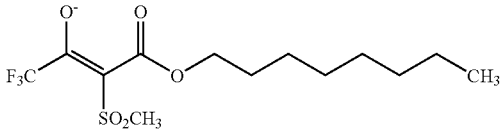

X-127

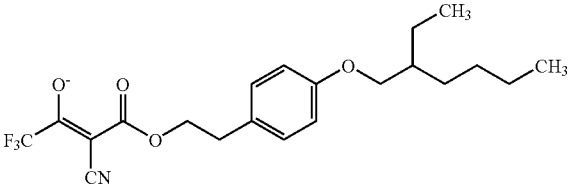

X-128

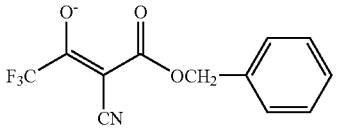

X-129

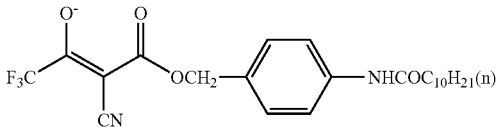

X-130

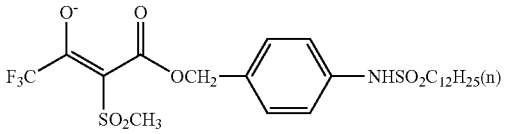

W1 is a counter ion when the counter ion is necessary for neutralizing the electric charge. The ionized state of the oil-soluble dye, anion, cation or net ionic charge thereof, is depended on the metal, ligand and substituent thereof. When the substituent is a dissociable group, the compound may have negative charge by dissociation thereof. In such the case, the charge of the whole molecular is neutralized by W1. Typical cations are an inorganic or organic ammonium ion such as a tetraalkylammonium ion and a pyridinium ion, an alkali metal ion and a proton. The anion may be concretely either an inorganic anion or an organic anion, for example, a halogen anion such as a fluorine anion, a bromine ion and an iodine ion, a substituted arylsulfonic acid ion such as a p-toluenesulfonic acid ion and a p-chlorobenzene sulfonic acid ion, an aryldisulfonic acid ion such as a 1,3-benzenedisulfonic acid ion, a 1,5-naphthalenedisulfonic acid ion and a 2,6-naphthalenedisulfonic acid ion, and an alkylsulfuric acid ion such as a methylsulfuric acid ion, a sulfuric acid ion, a thiocyanic acid ion, a perchloric acid ion, a tetrafluoroboric acid ion, a hexafluorophosphate ion, a picric acid ion, an acetic acid ion and a trifluoromethane-sulfonic acid ion.

Adding amount of the compound represented by Formula (2) is preferably from 0.5 to 3 times, and more preferably from 0.5 to 2 times, in molar ratio to the oil-soluble dye. When the ratio is less than 0.5 times, the light resistance tens to be considerably lowered and when the ratio is more than 5 times, the dispersion stability of the oil-soluble dye tends to be lowered so that bad influence is caused on the occasion of the toner production even though the occurrence of such the results are depended on the kind of the oil-soluble dye.

As such the copper compound, copper acetate, copper stearate, copper 2-ethylhexanoate, copper sulfate and copper (II)chloride can be cited.

Concrete examples of the compound represented by Formula (2) are listed below but the invention is not limited to them.

TABLE 1

| Compound | M | X1 | m | X2 | n | W1 | s |
|---|---|---|---|---|---|---|---|
| C-1 | $Cu^{2+}$ | X-4 | 1 | X-4 | 1 | — | 0 |
| C-2 | $Cu^{2+}$ | X-6 | 1 | X-6 | 1 | X-114 | 0 |
| C-3 | $Cu^{2+}$ | X-17 | 1 | X-17 | 1 | — | 0 |
| C-4 | $Cu^{2+}$ | X-26 | 1 | X-26 | 1 | — | 0 |
| C-5 | $Cu^{2+}$ | X-27 | 1 | X-27 | 1 | — | 0 |
| C-6 | $Cu^{2+}$ | X-51 | 1 | X-51 | 1 | X-114 | 0 |
| C-7 | $Cu^{2+}$ | X-52 | 1 | X-52 | 1 | — | 0 |
| C-8 | $Cu^{2+}$ | X-53 | 1 | X-53 | 1 | — | 0 |
| C-9 | $Cu^{2+}$ | X-54 | 1 | X-54 | 1 | — | 0 |
| C-10 | $Cu^{2+}$ | X-78 | 1 | X-78 | 1 | — | 0 |
| C-11 | $Cu^{2+}$ | X-102 | 1 | X-102 | 1 | — | 0 |
| C-12 | $Cu^{2+}$ | X-106 | 1 | X-106 | 1 | — | 0 |
| C-13 | $Cu^{2+}$ | X-110 | 1 | X-110 | 1 | — | 0 |
| C-14 | $Cu^{2+}$ | X-111 | 1 | X-111 | 1 | — | 0 |
| C-15 | $Cu^{2+}$ | X-112 | 1 | X-112 | 1 | — | 0 |
| C-16 | $Cu^{2+}$ | X-115 | 1 | X-115 | 1 | — | 0 |
| C-17 | $Cu^{2+}$ | X-116 | 1 | X-116 | 1 | — | 0 |
| C-18 | $Cu^{2+}$ | X-117 | 1 | X-117 | 1 | — | 0 |
| C-19 | $Cu^{2+}$ | X-118 | 1 | X-118 | 1 | — | 0 |
| C-20 | $Cu^{2+}$ | X-119 | 1 | X-119 | 1 | — | 0 |
| C-21 | $Cu^{2+}$ | X-120 | 1 | X-120 | 1 | — | 0 |
| C-22 | $Cu^{2+}$ | X-121 | 1 | X-121 | 1 | — | 0 |
| C-23 | $Cu^{2+}$ | X-122 | 1 | X-122 | 1 | — | 0 |
| C-24 | $Cu^{2+}$ | X-123 | 1 | X-123 | 1 | — | 0 |
| C-25 | $Cu^{2+}$ | X-124 | 1 | X-124 | 1 | — | 0 |
| C-26 | $Cu^{2+}$ | X-125 | 1 | X-125 | 1 | — | 0 |
| C-27 | $Cu^{2+}$ | X-126 | 1 | X-126 | 1 | — | 0 |
| C-28 | $Cu^{2+}$ | X-127 | 1 | X-127 | 1 | — | 0 |
| C-29 | $Cu^{2+}$ | X-128 | 1 | X-128 | 1 | — | 0 |
| C-30 | $Cu^{2+}$ | X-129 | 1 | X-129 | 1 | — | 0 |
| C-31 | $Cu^{2+}$ | X-130 | 1 | X-130 | 1 | — | 0 |
| C-32 | $Cu^{2+}$ | $SO_4^{(2-)}$ | 1 | — | 0 | — | 0 |
| C-33 | $Cu^{2+}$ | X-15 | 1 | X-15 | 1 | — | 0 |
| C-34 | $Cu^{2+}$ | X-4 | 1 | X-111 | 1 | — | 0 |
| C-35 | $Cu^{2+}$ | X-127 | 1 | X-111 | 1 | — | 0 |
| C-76 | $Cu^{2+}$ | X-127 | 1 | X-4 | 1 | — | 0 |
| C-77 | $Cu^{2+}$ | X-127 | 1 | X-4 | 2 | X-85 | 1 |

<<Compound Represented by Formula (3) or (4)>>

The substituents represented by $R_{31}$ or $R_{41}$ are synonym of those represented by $R_{11}$ in Formula (1), and are preferably a hydrogen atom, an alkyl group, an alkenyl group, an aryl group, a heterocyclic group, an acylamino group, an alkylsulfonylamino group, an arylsulfonylamino group, an amino group, an alkylthio group, an arylthio group, an alkoxy group, an aryloxy group, a ureido group, an alkoxycarbonylamino group, a carbamoyl group, a carboxyl group or an alkoxycarbonyl group, and more preferably the alkyl group particularly a methyl group, a tert-butyl group, a trifluoromethyl group, carbamoyl group and an alkoxycarbonyl group.

The groups represented by $R_{32}$ or $R_{42}$ are the same as those represented by $R_{13}$ in Formula (1), and preferable ones are also the same.

The linking groups having one or two carbon atoms or that forming a part of the ring structure represented by $L_{31}$ or $L_{41}$ are the same as those represented by $L_{11}$ in Formula (1), and preferable ones are also the same.

<<Compounds Represented by Formula (5) or (6)>>

The substituents represented by $R_{51}$, $R_{52}$, $R_{53}$, $R_{61}$ or $R_{62}$ are the synonym of those represented by $R_{11}$ in Formula (2), and $R_{51}$ is preferably a hydrogen atom, an alkyl group, an aryl group, a heterocyclic group, a carbamoyl group, an alkoxycarbonyl group, an arylcarbonyl group, a cyano group, a sulfamoyl group, an alkylsulfamoyl group or an arylsulfonyl group, and more preferably the aryl group, heterocyclic group, carbamoyl group, an akoxycarbamoyl group, alkoxycarbonyl group or cyano.

$R_{52}$ is preferably a hydrogen atom, a halogen atom, an alkyl group, an acylamino group, an alkoxycarbonyl group, an amino group, an alkylthio group, an amino group, an alkylthio group or an arylthio group, and more preferably the hydrogen atom, halogen atom, alkyl group or acylamino group.

$R_{61}$ is preferably a hydrogen atom, an alkyl group, an aryl group, a heterocyclic group, an acylamino group, an alkylsulfonylamino group, an arylsulfonylamino group, an amino group, an alkylthio group, an arylthio group, an alkoxy group, an aryloxy group, a ureido group, an alkoxycarbonylamino group, an acyl group, an alkoxycarbonyl group or a carbamoyl group, and more preferably the hydrogen atom, alkyl group, aryl group, a heterocyclic group, acylamino group, or alkoxy group.

The groups represented by $R_{53}$ or $R_{62}$ are the same as those represented by $R_{13}$ in Formula (2) and the preferable ones are also the same.

The linking groups having one or two carbon atoms or that forming a part of the ring structure are the same as those represented by $L_{11}$ in Formula (2) and preferably ones are also the same.

<<Compounds represented by Formula (7) or (8)>>

The substituents represented by $R_{71}$, $R_{72}$, $R_{73}$, $R_{81}$, $R_{82}$ or $R_{83}$ are the same as those represented by $R_{11}$ in Formula (2), and that represented by $R_{71}$ or $R_{72}$ is preferably a hydrogen atom, an alkyl group, an aryl group, a heterocyclic group, a carbamoyl group, an alkoxycarbonyl group, an aryloxycarbonyl group, a carboxyl group, a cyano group, a sulfamoyl group, an alkylsulfonyl group, an arylsulfonyl group or a nitro group, and more preferably the alkoxycarbonyl group or cyano group.

$R_{81}$ is preferably a hydrogen atom, an alkyl group, an aryl group, a heterocyclic group, an acylamino group, an alkylsulfonylamino group, an arylsulfonylamino group, an amino group, an alkylthio group, an arylthio group, an alkoxy group, an aryloxy group, a ureido group, an alkoxycarbonylamino group, an acyl group, a carboxyl group, an alkoxycarbonyl group or a carbamoyl group, and more preferably the hydrogen atom, alkyl group, aryl group, acyl group, acylamino group, alkoxycarbonyl group or carbamoyl group.

The groups represented by $R_{82}$ are the same as those represented by $R_{31}$ in Formula (3) and preferably ones are also the same.

The groups represented by $R_{73}$ or $R_{83}$ are the same as those represented by $R_{13}$ in Formula (2), and preferably ones are also the same.

The linking group having one or two carbon atoms and that forming a part of the ring structure represented by $L_{71}$ or $L_{81}$ are the same as those represented by $L_{11}$ in Formula (2), and preferably ones are also the same.

Concrete typical examples of the oil-soluble dye capable of chelating of the invention represented by Formulas (1) and (3)-(8) and those of copper compound represented by Formula (2) are described below, but the invention is not limited to them.

L-1

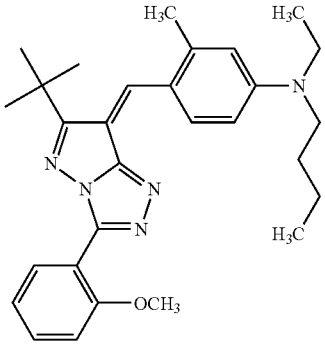

L-2

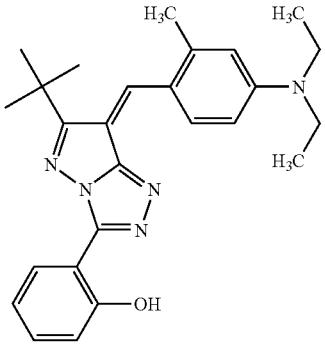

L-3

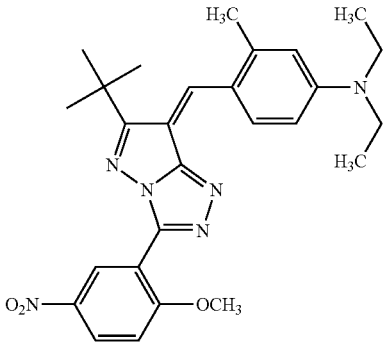

-continued

L-4

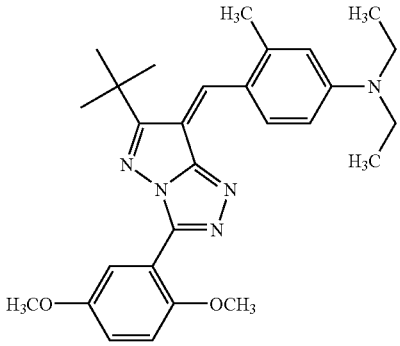

L-5

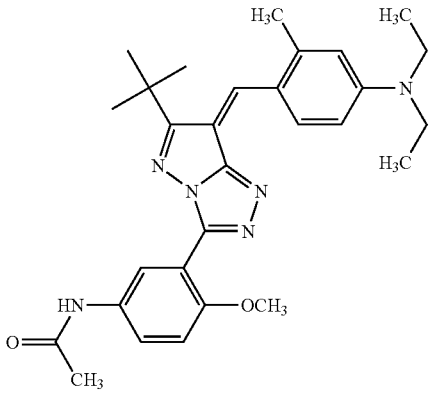

L-6

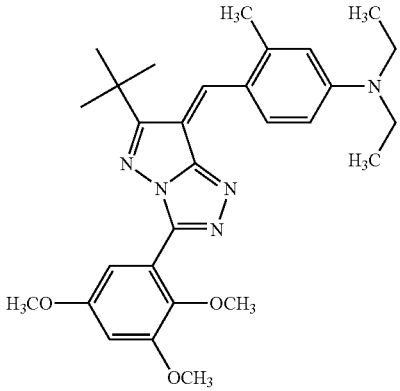

L-7

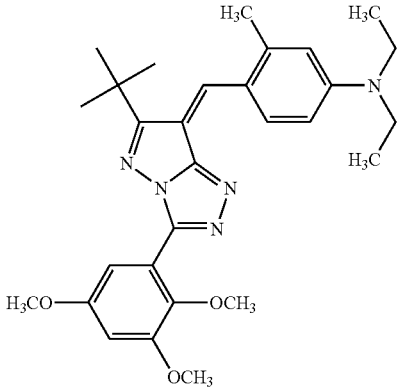

-continued
L-8
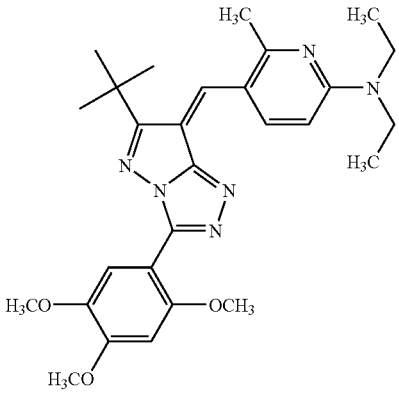
L-9
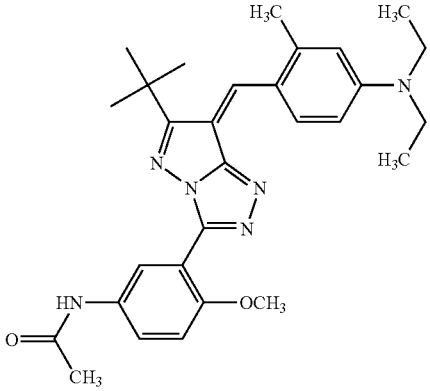
L-10
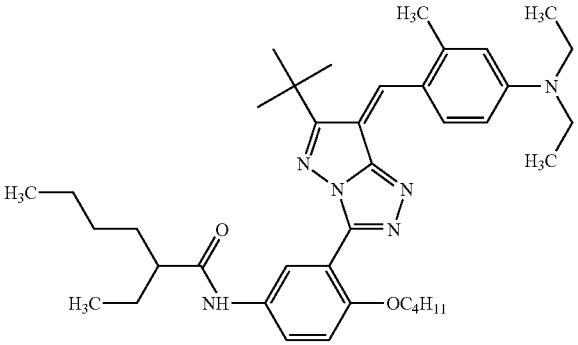
L-11
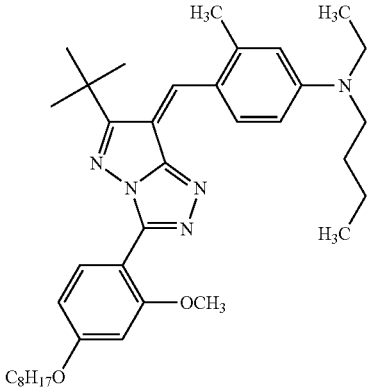
-continued
L-12
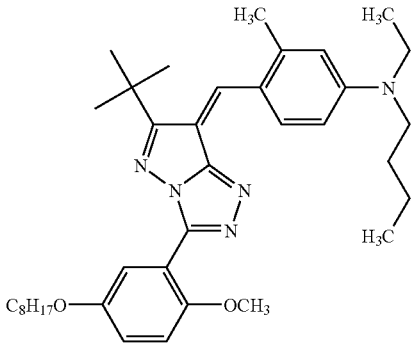
L-13
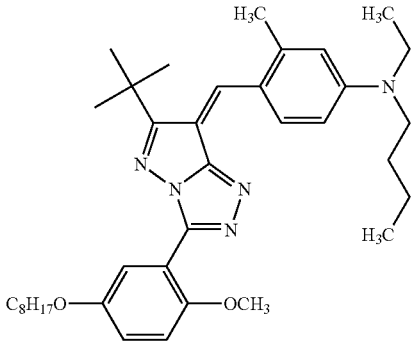
L-14
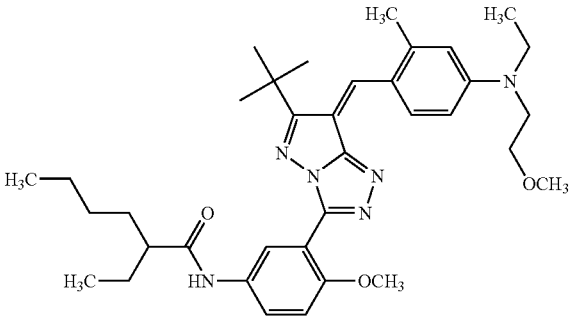
L-15
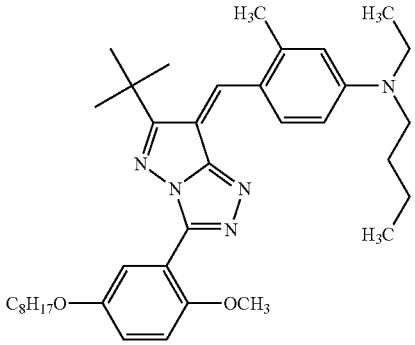

-continued
L-16
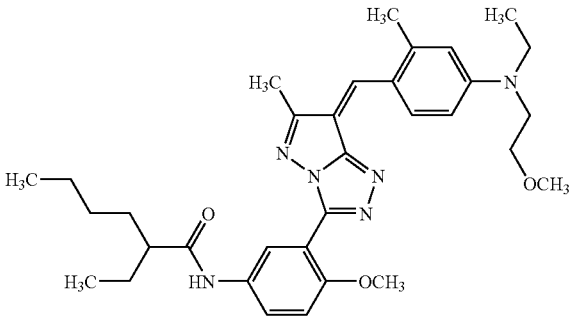
L-17
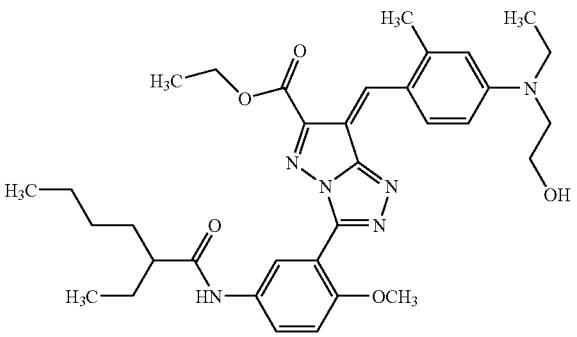
L-18
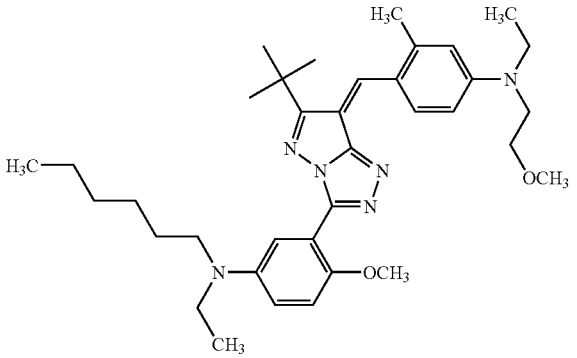
L-19
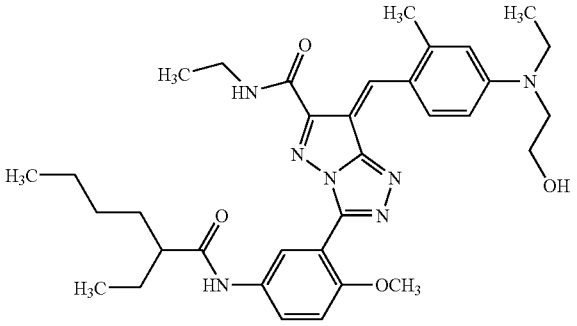
-continued
L-20
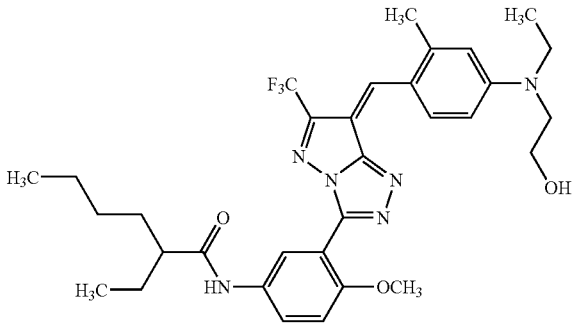
L-21
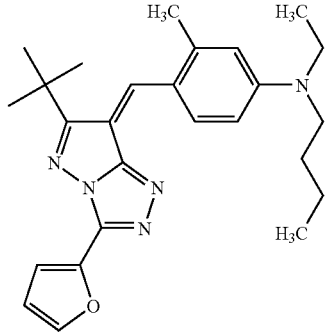
L-22
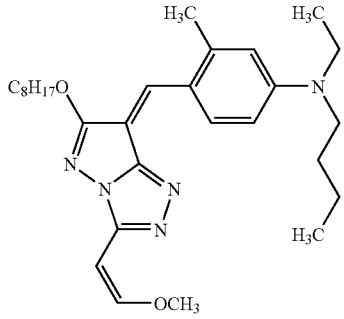
L-23
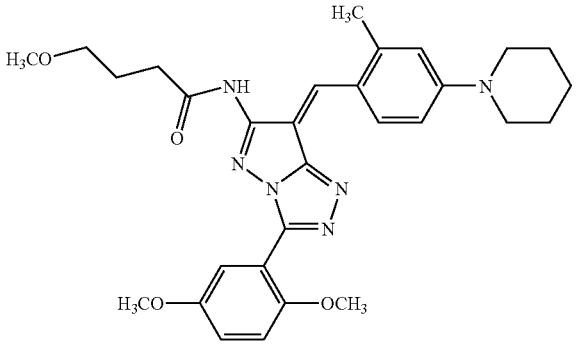

-continued
L-24
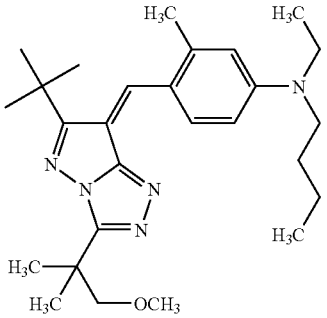
L-25
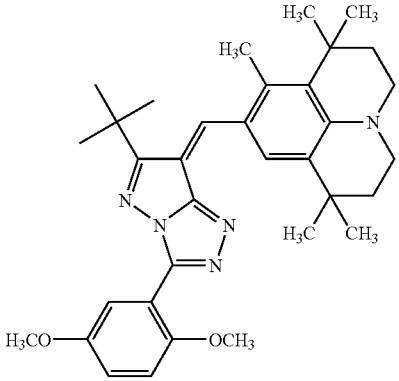
L-26
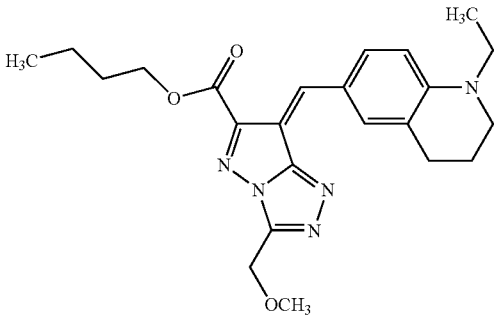
L-27
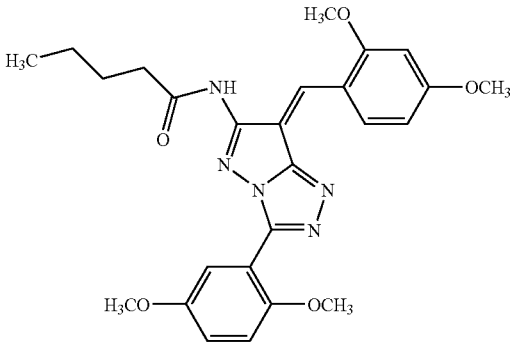
-continued
L-28
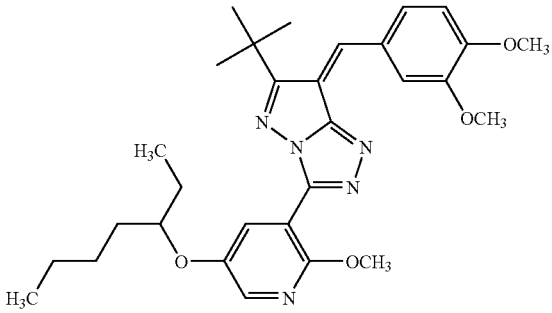
L-29
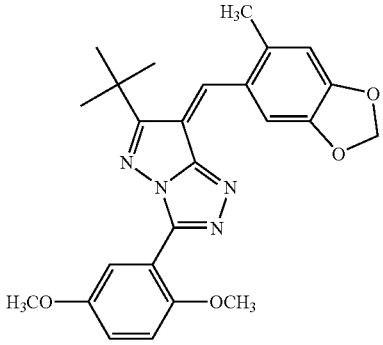
L-30
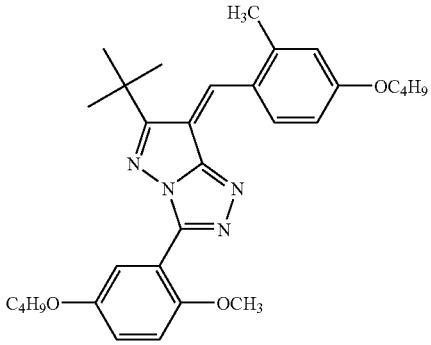
L-31
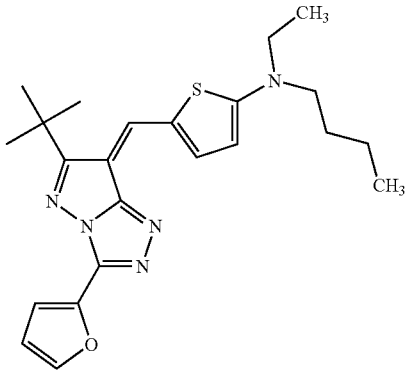

-continued
L-32
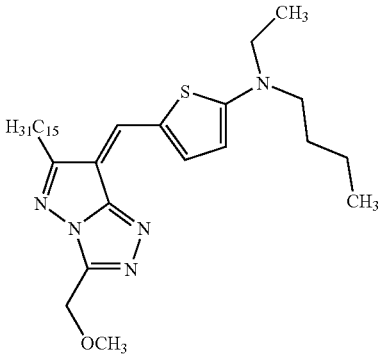
L-33
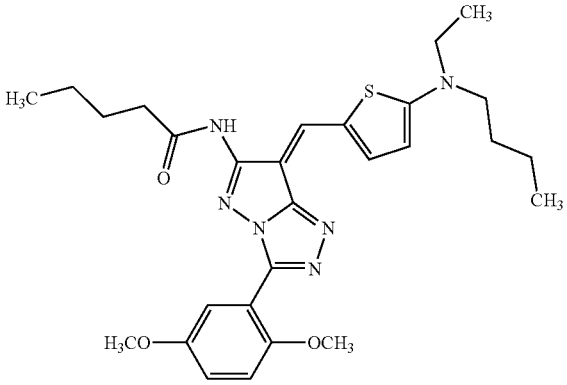
L-34
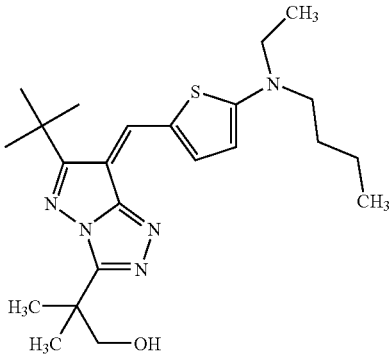
L-35
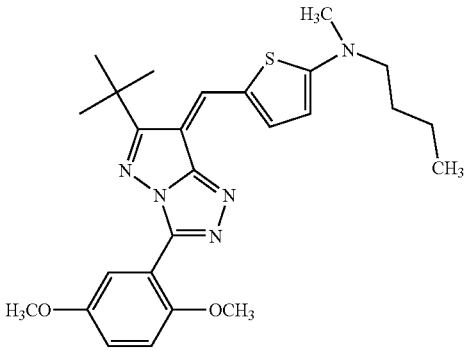
-continued
L-36
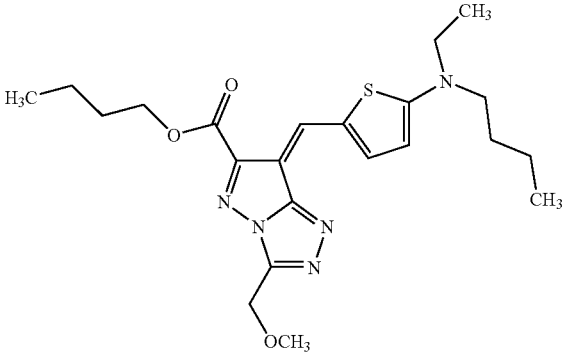
L-37
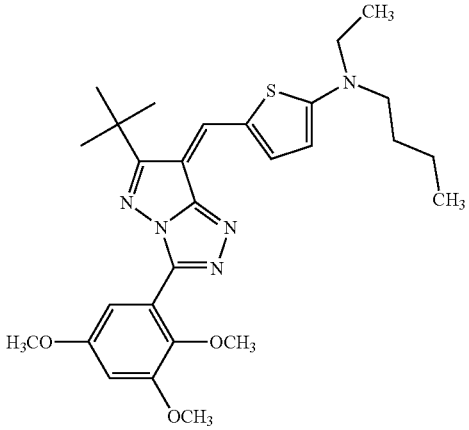
L-38
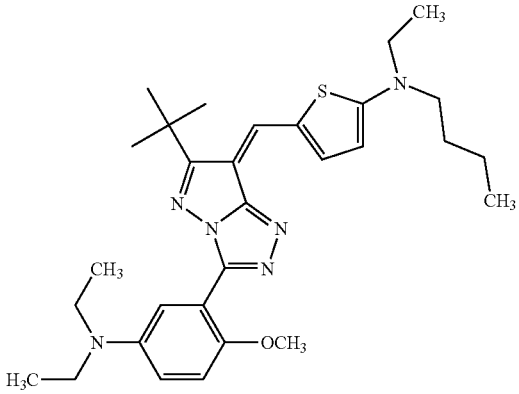
L-39
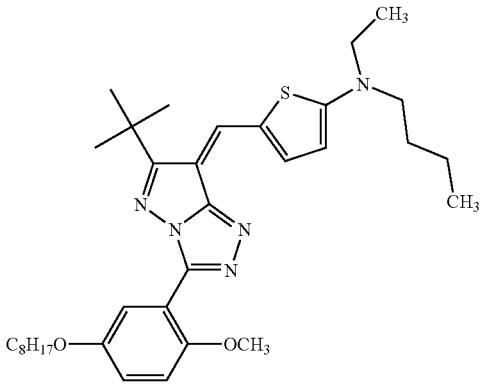

-continued
L-40
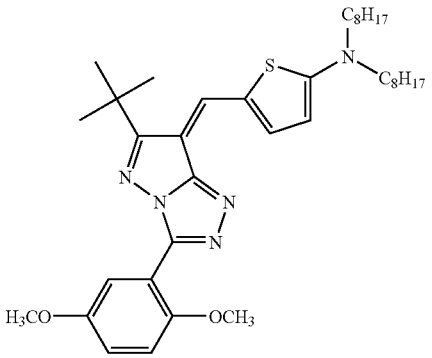
L-41
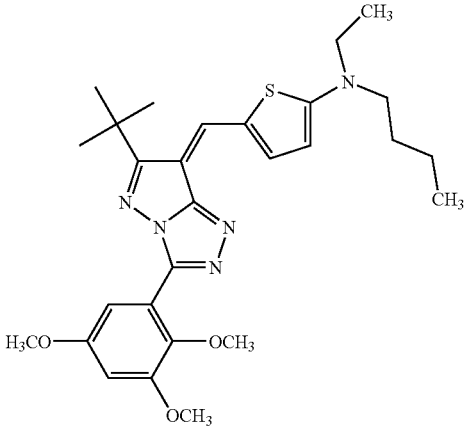
L-42
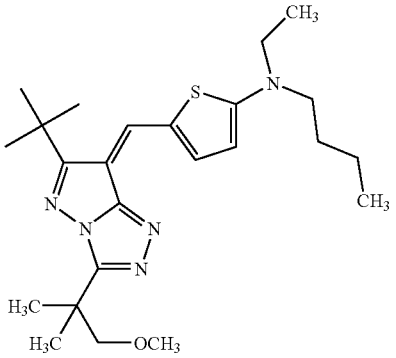
L-43
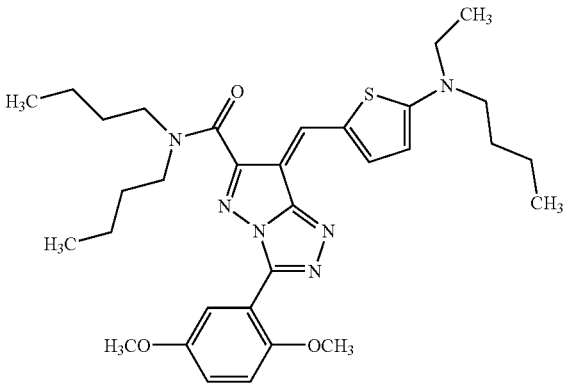
-continued
L-44
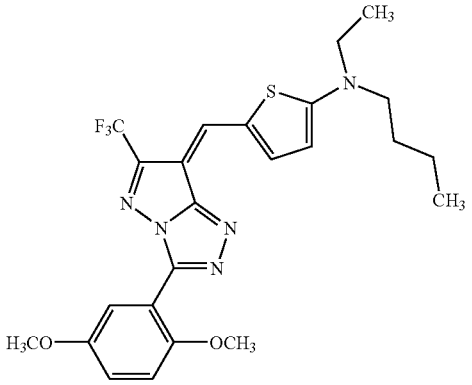
L-45
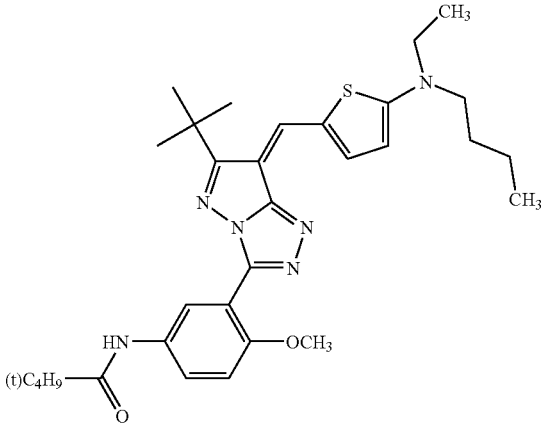
L-46
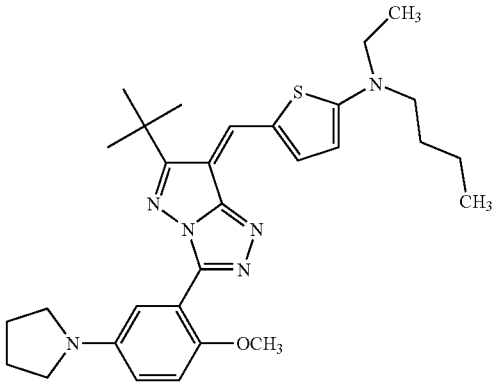
L-47
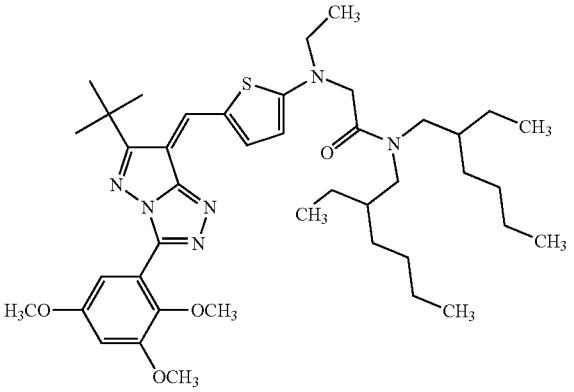

-continued
L-48
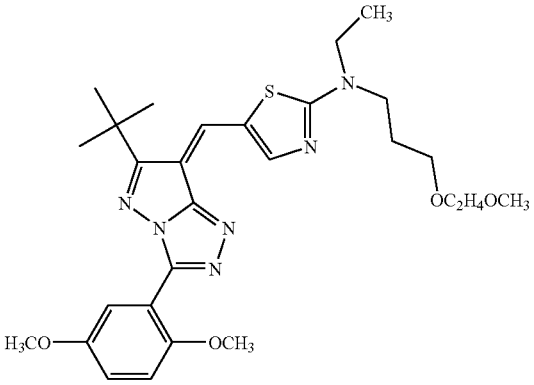
L-49
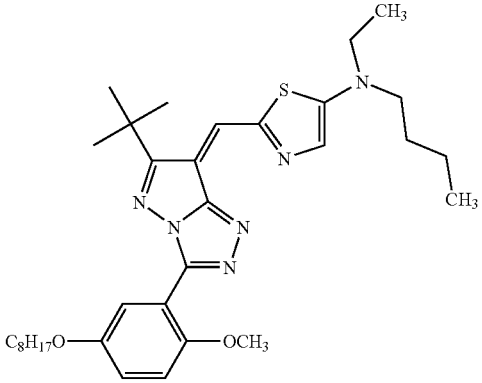
L-50
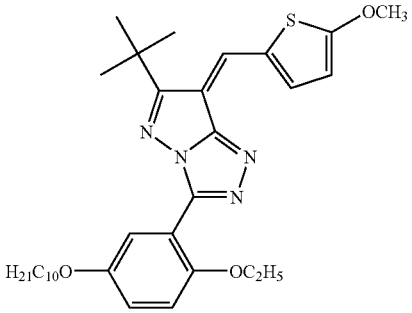
L-51
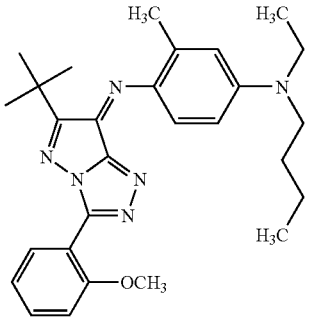
-continued
L-52
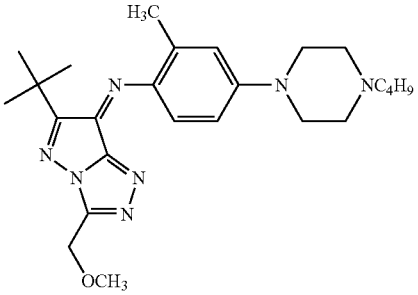
L-53
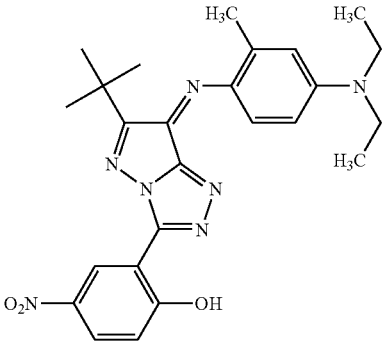
L-54
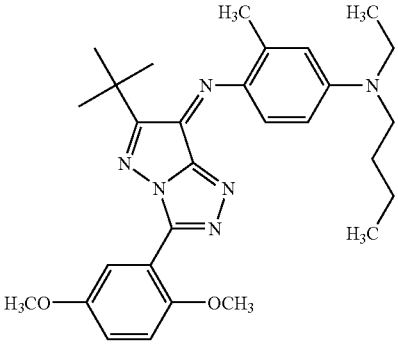
L-55
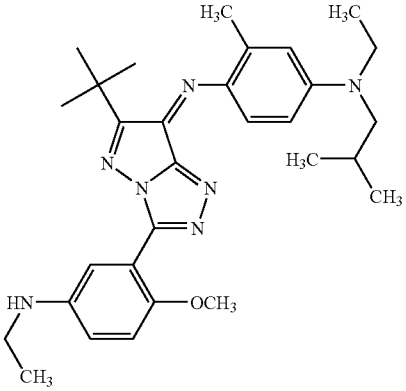

-continued
L-56
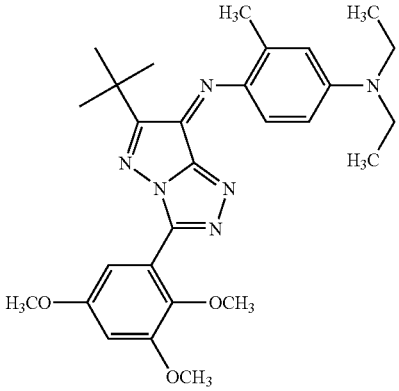
L-57
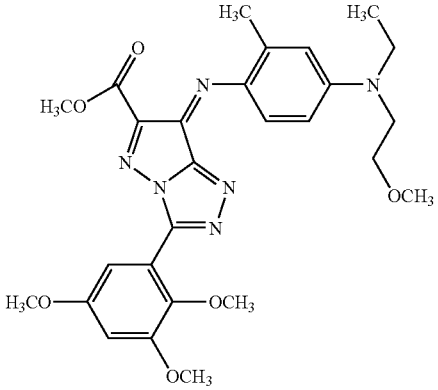
L-58
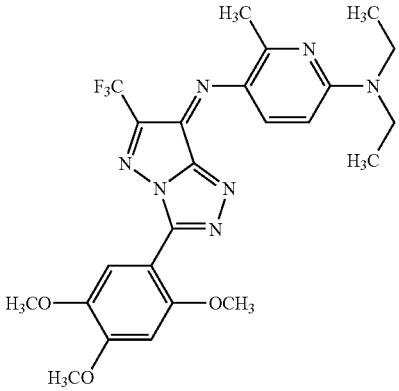
L-59
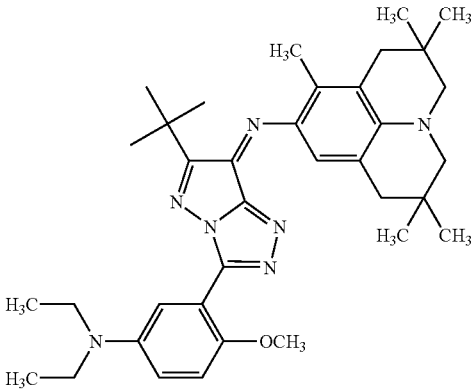
-continued
L-60
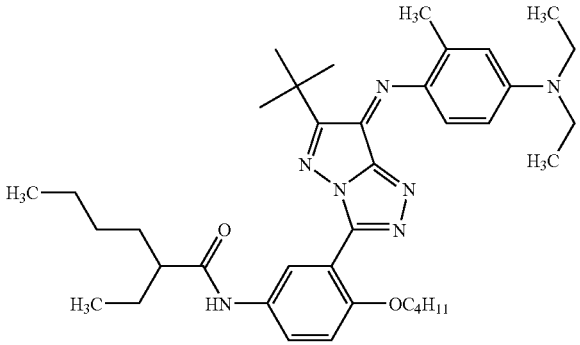
L-61
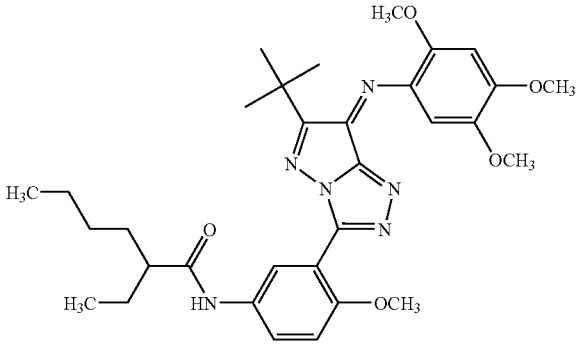
L-62
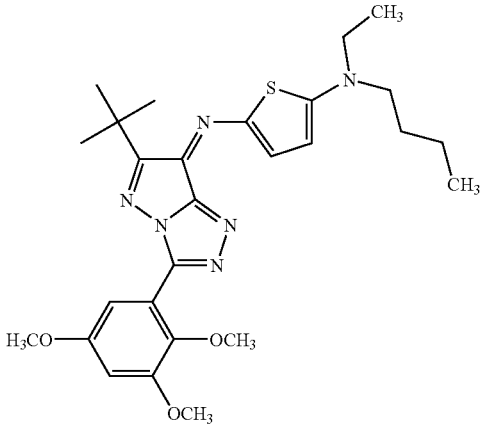
L-63
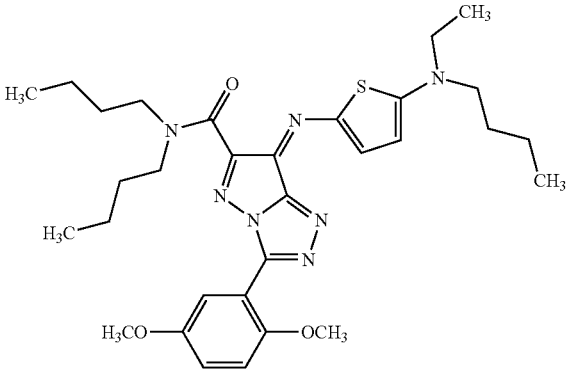

-continued
L-64
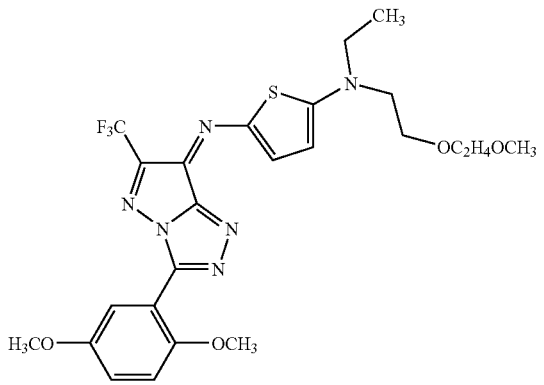
L-65
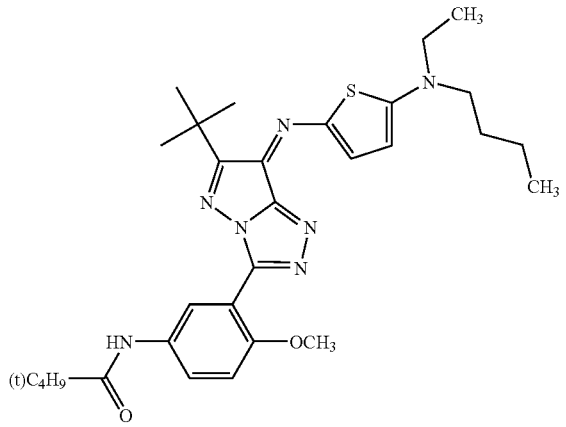
L-66
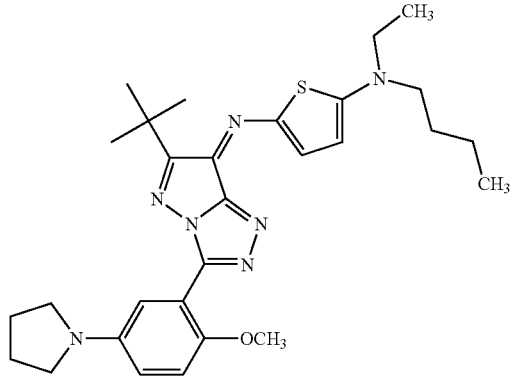
L-67
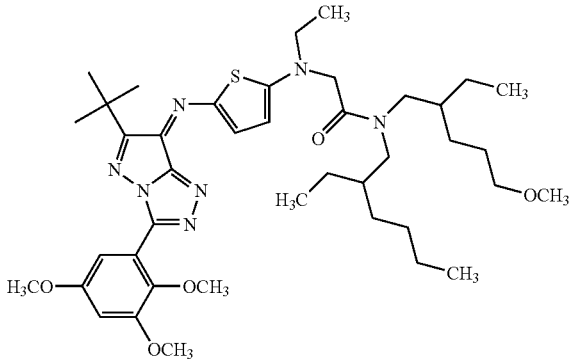
-continued
L-68
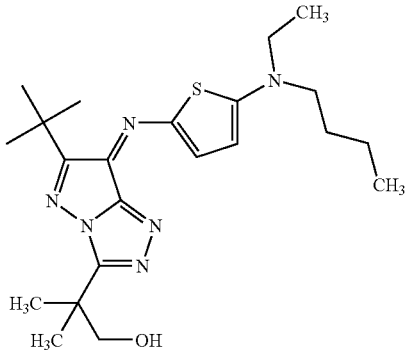
L-69
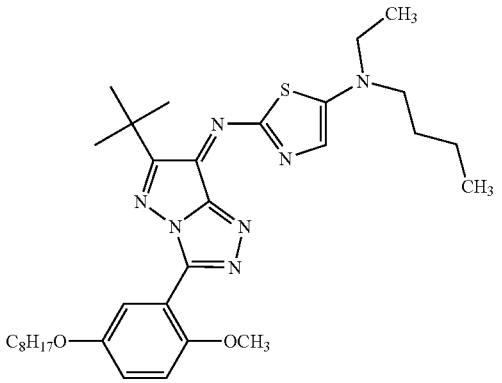
L-70
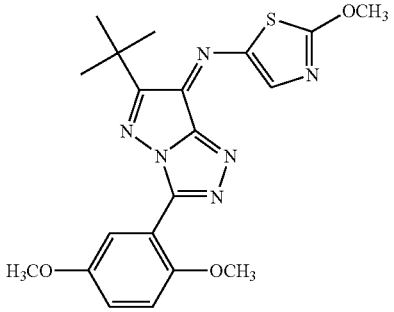
L-71
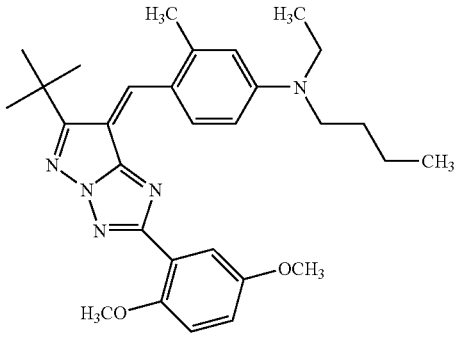

-continued
L-72
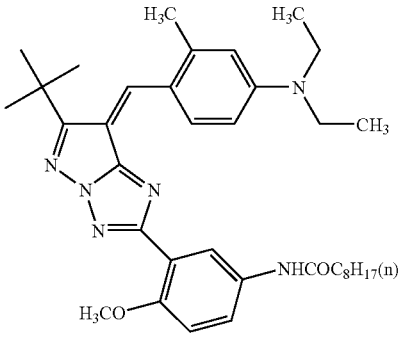
L-73
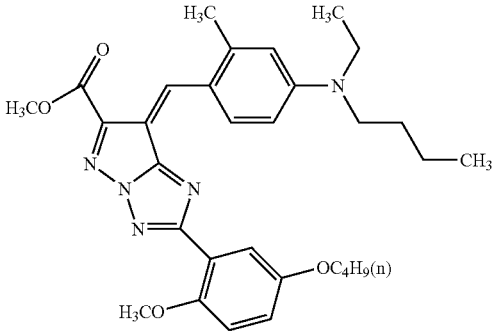
L-74
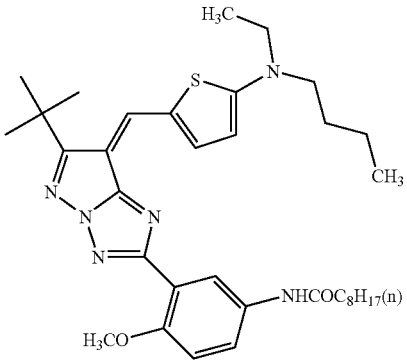
L-75
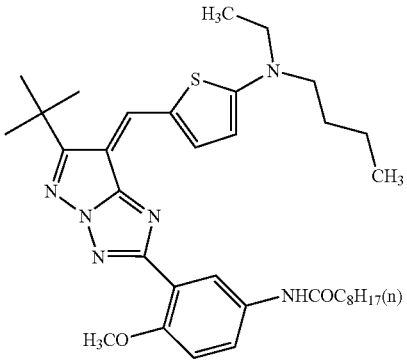
-continued
L-76
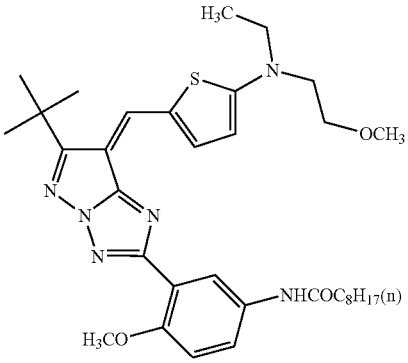
L-77
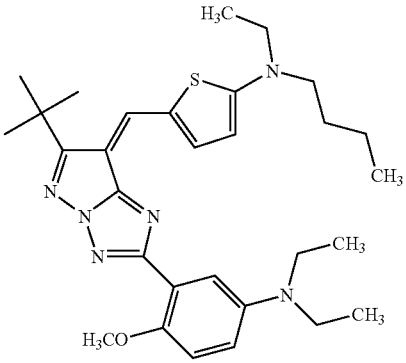
L-78
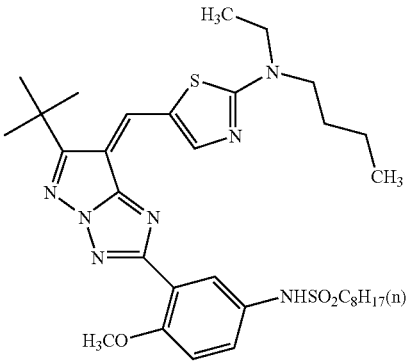
L-79
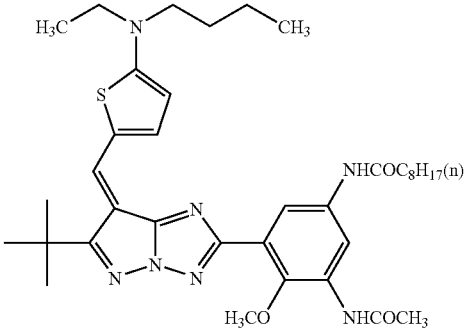

-continued
L-80
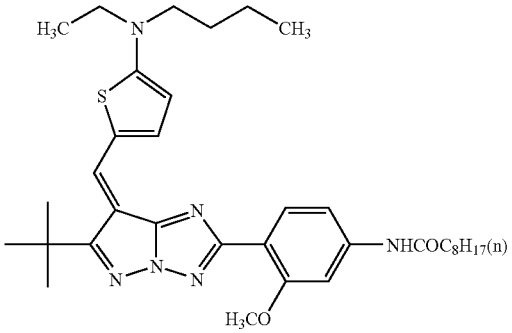
L-81
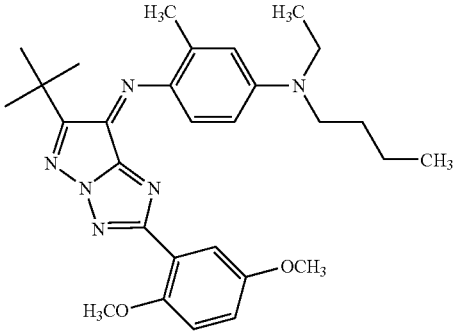
L-82
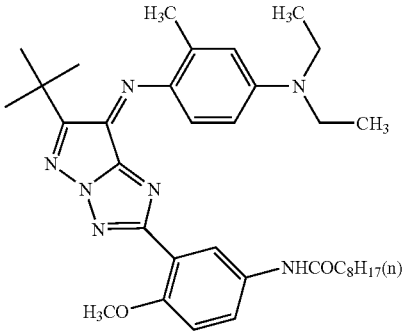
L-83
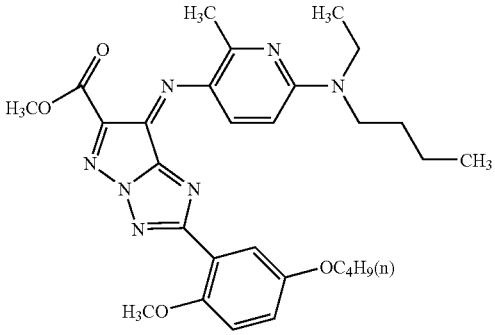
-continued
L-84
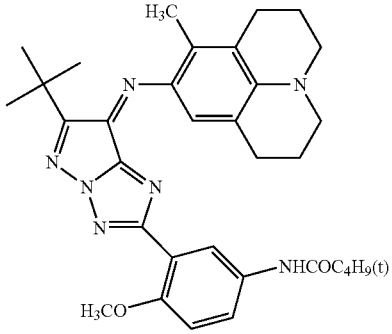
L-85
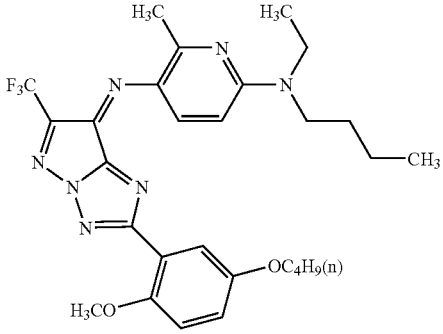
L-86
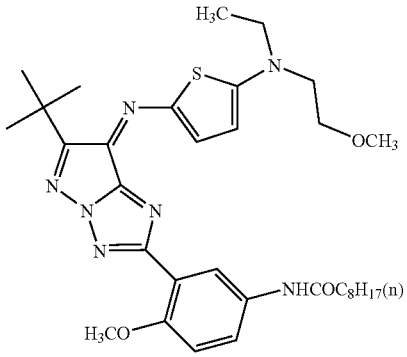
L-87
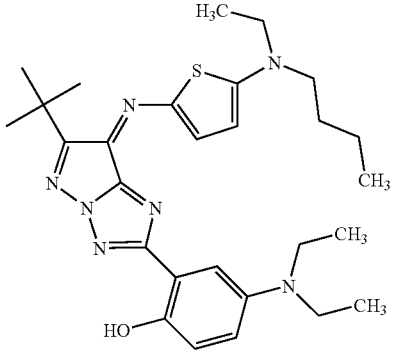

-continued
L-88
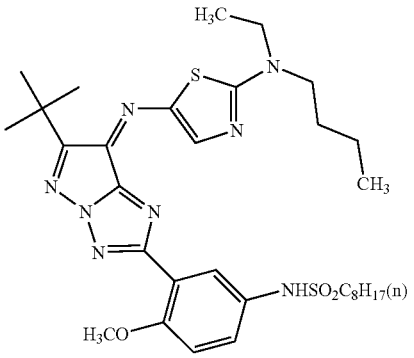
L-89
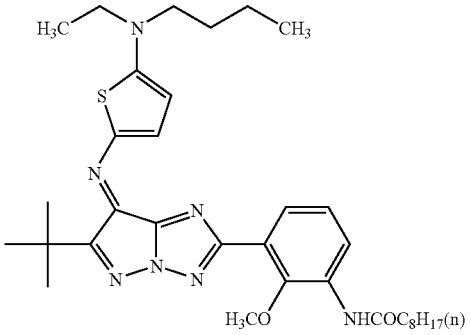
L-90
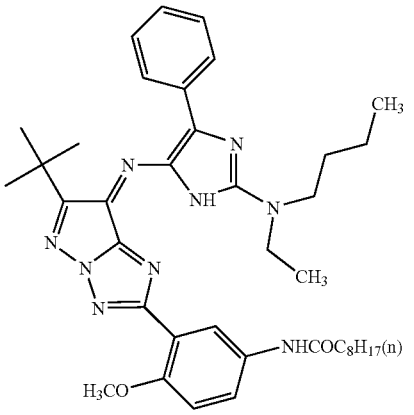
L-91
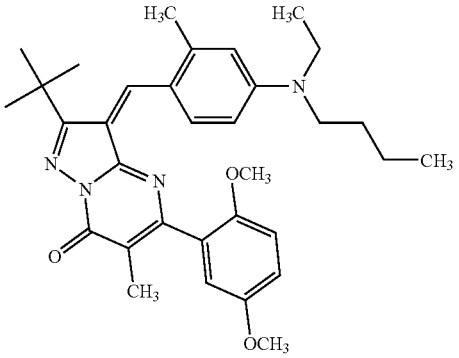
-continued
L-92
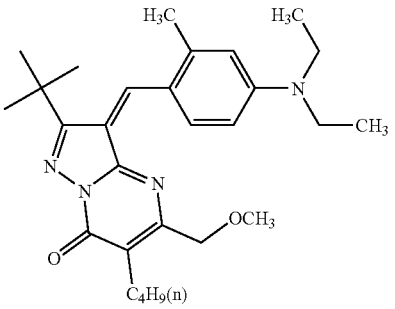
L-93
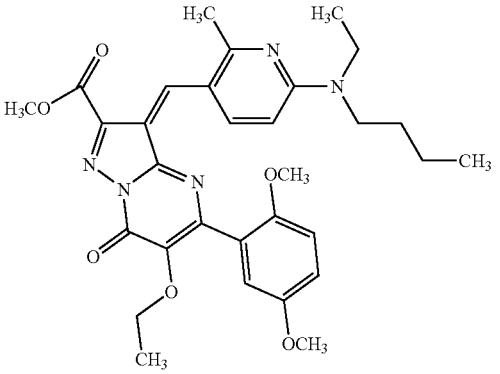
L-94
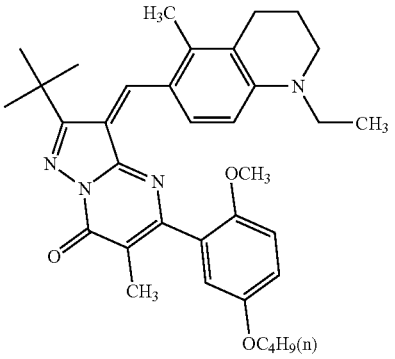
L-95
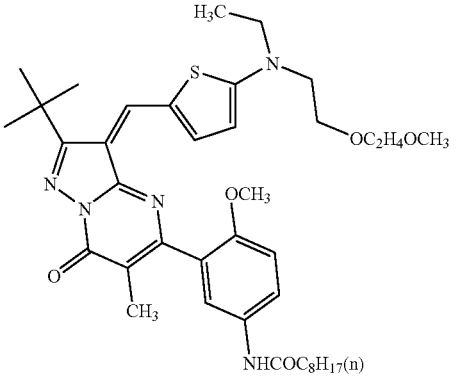

-continued
L-96
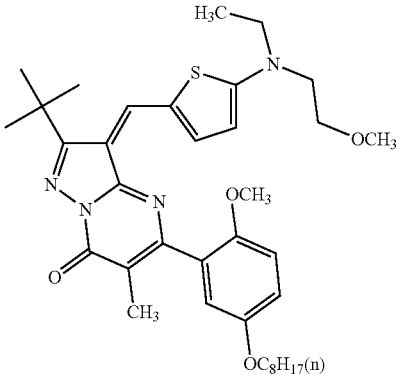
L-97
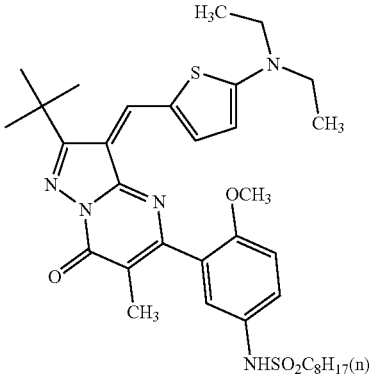
L-98
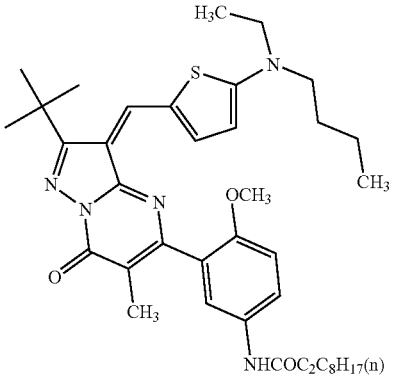
L-99
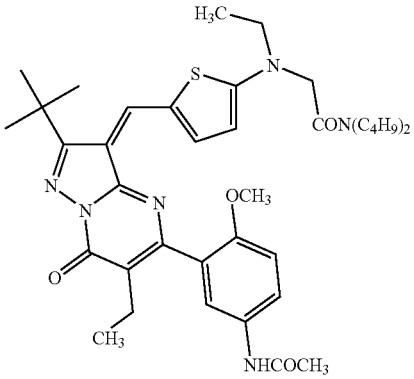
-continued
L-100
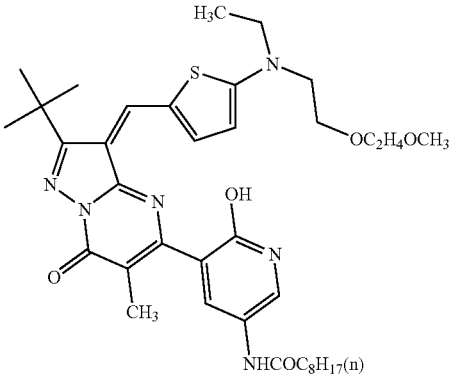
L-101
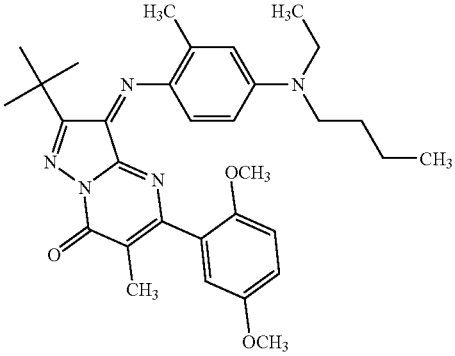
L-102
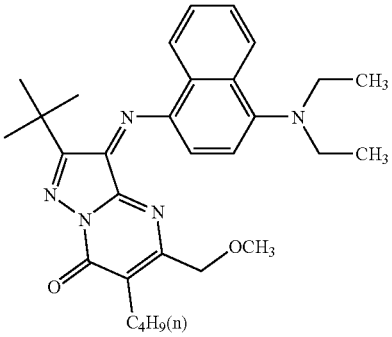
L-103
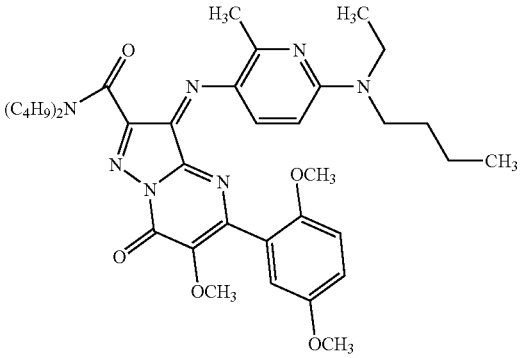

-continued
L-104
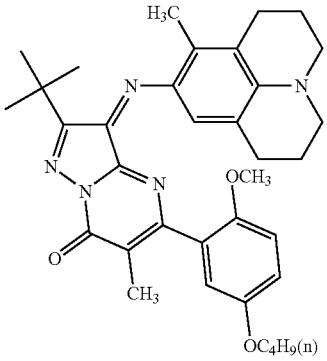
L-105
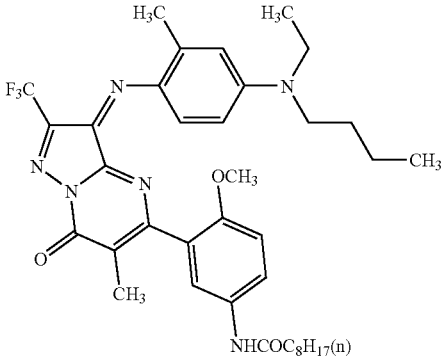
L-106
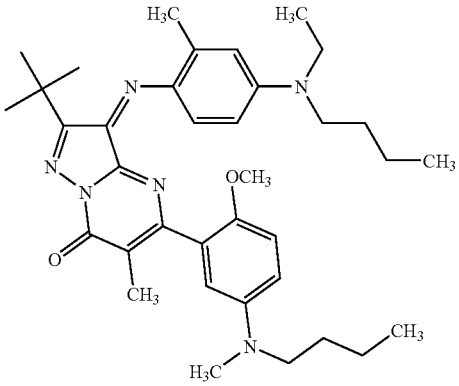
L-107
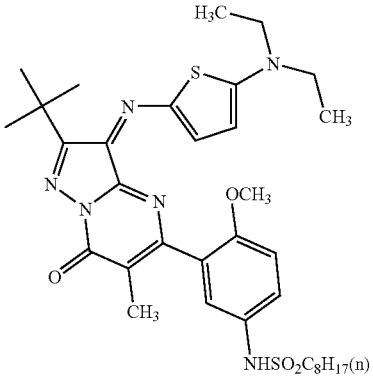
-continued
L-108
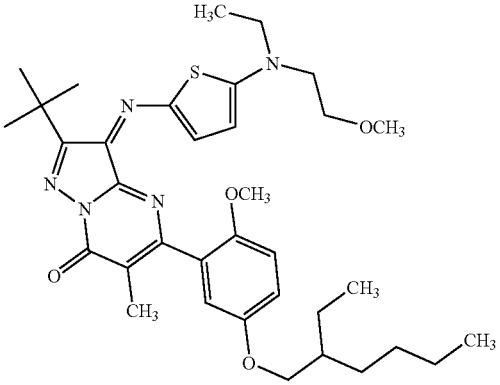
L-109
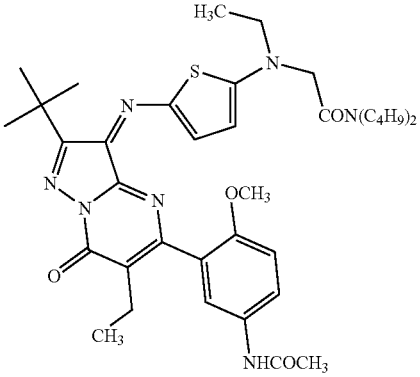
L-110
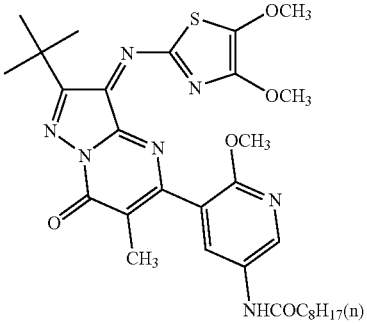
L-111
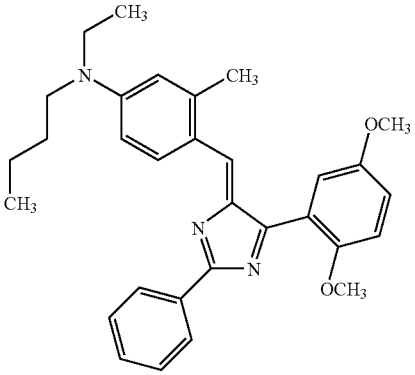

-continued
L-112
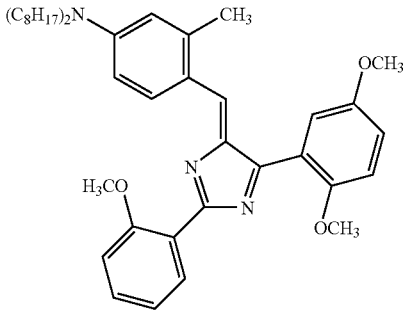
L-113
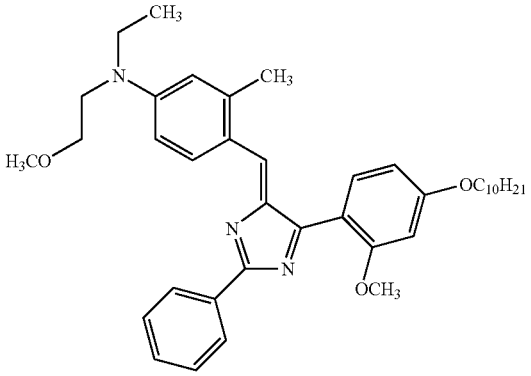
L-114
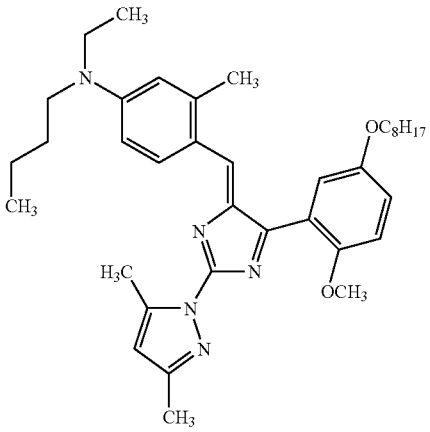
L-115
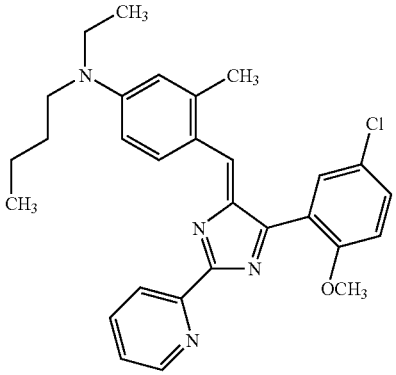
-continued
L-116
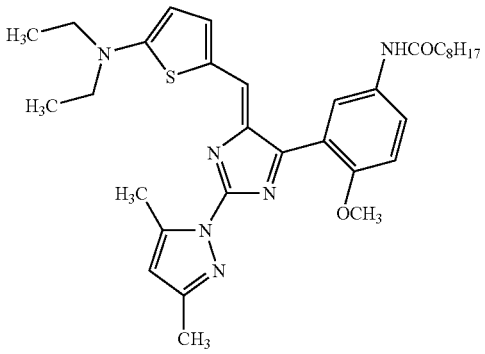
L-117
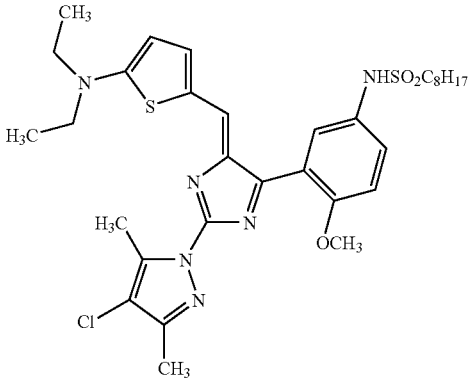
L-118
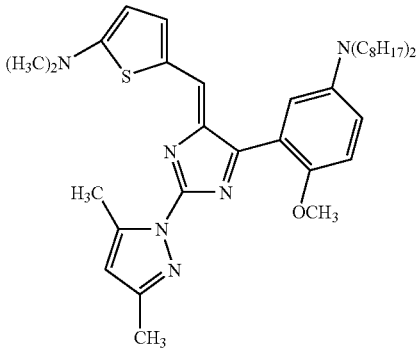
L-119
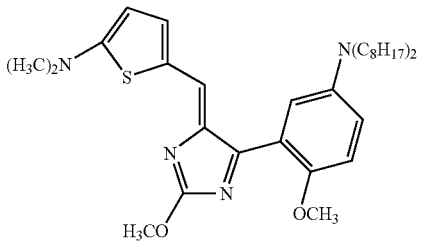

-continued
L-120
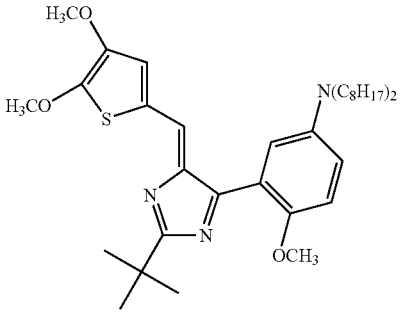
L-121
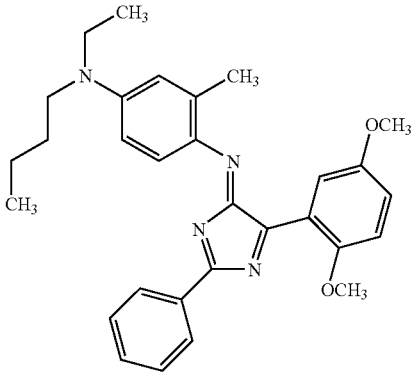
L-122
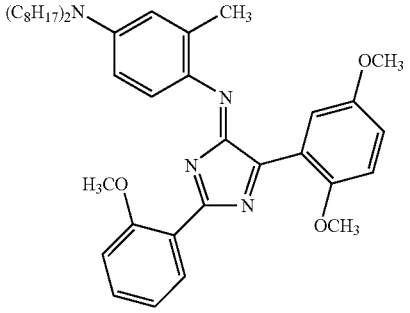
L-123
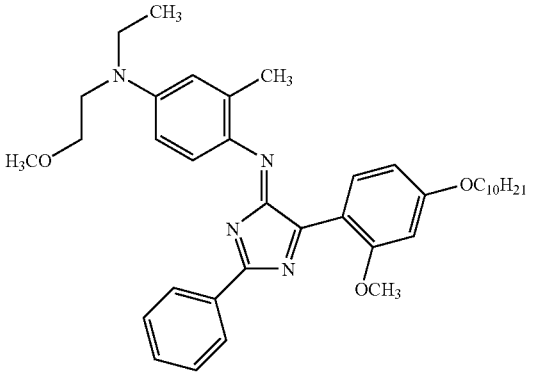
-continued
L-124
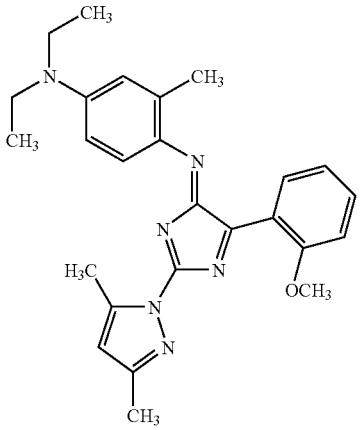
L-125
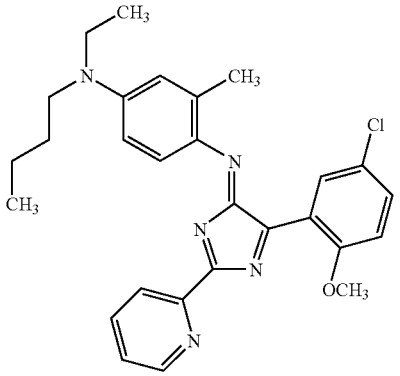
L-126
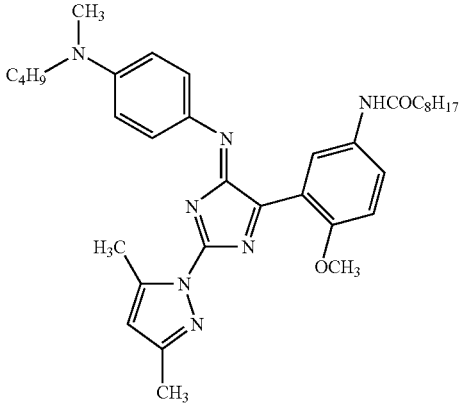
L-127
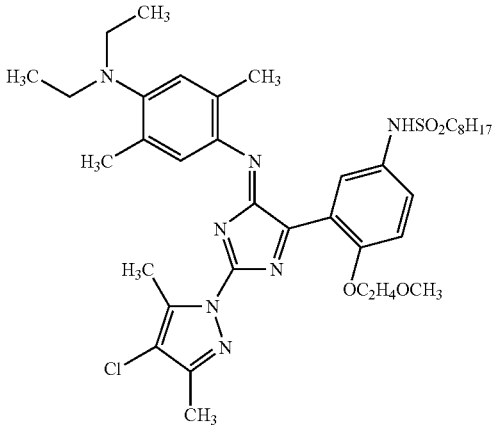

-continued
L-128
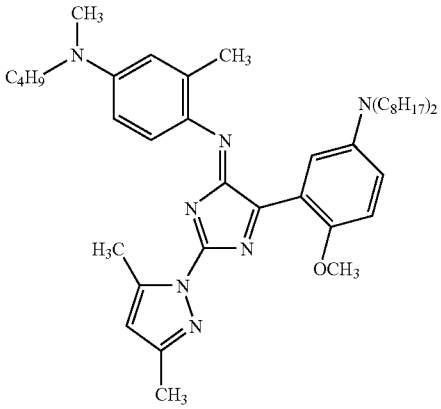
L-129
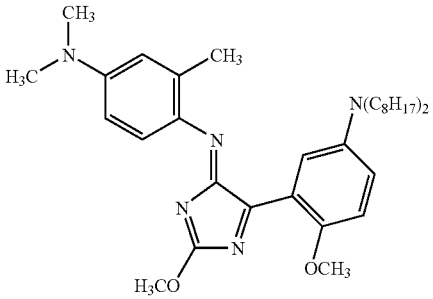
L-130
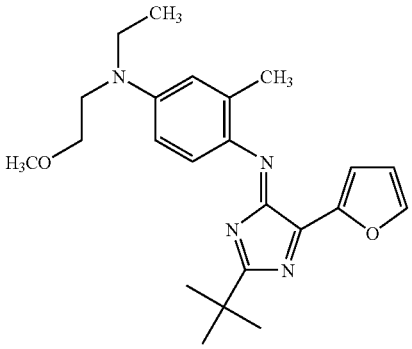
L-131
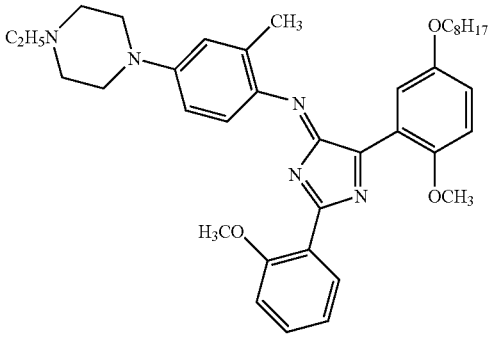
-continued
L-132
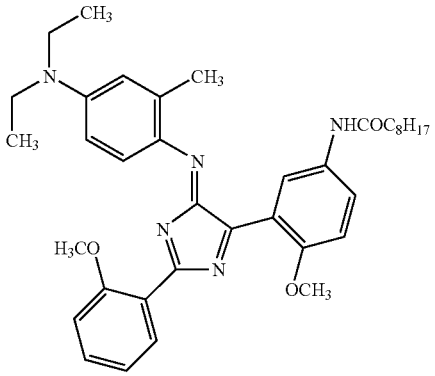
L-133
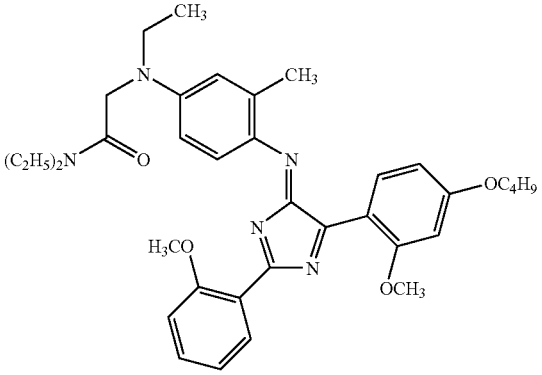
L-134
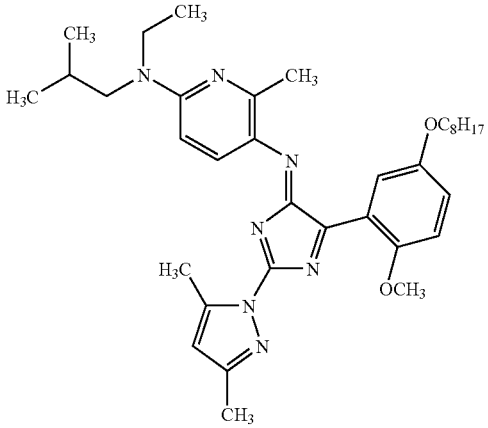
L-135
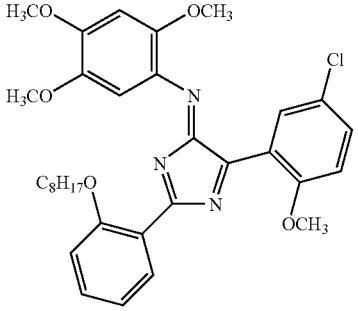

-continued
L-136
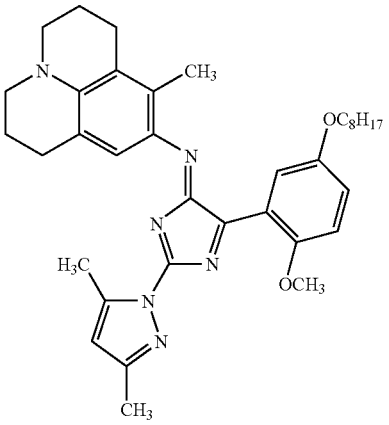
L-137
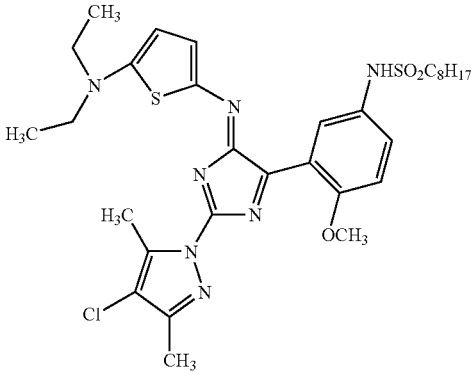
L-138
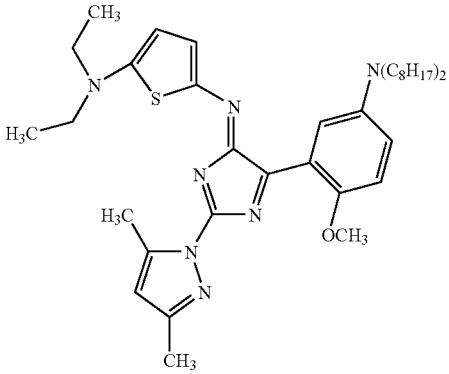
L-139
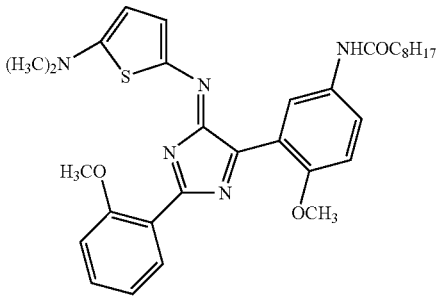
-continued
L-140
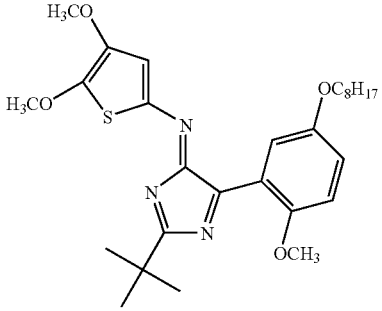
L-141
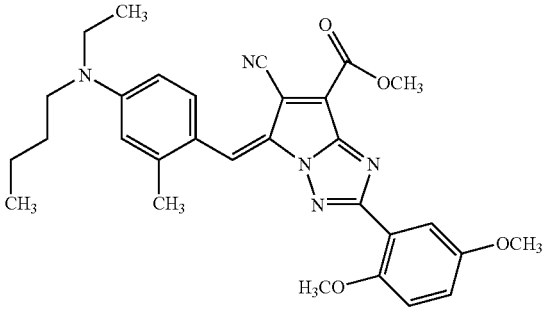
L-142
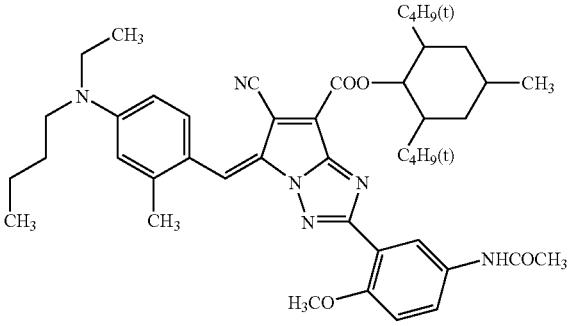
L-143
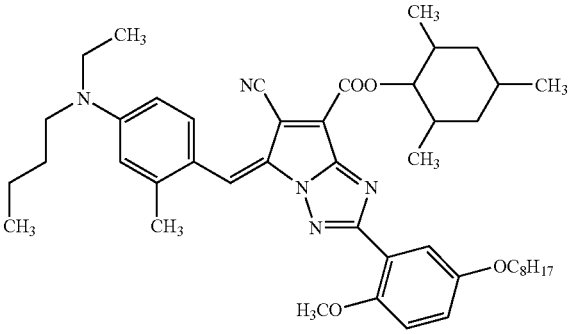

-continued
L-144
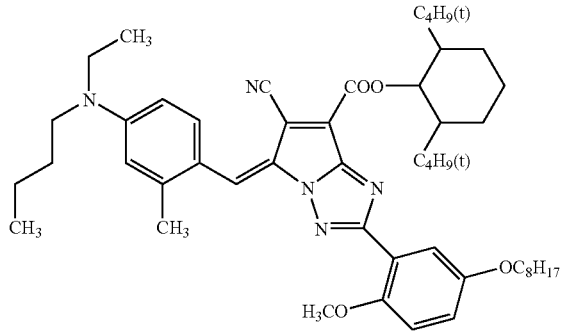
L-145
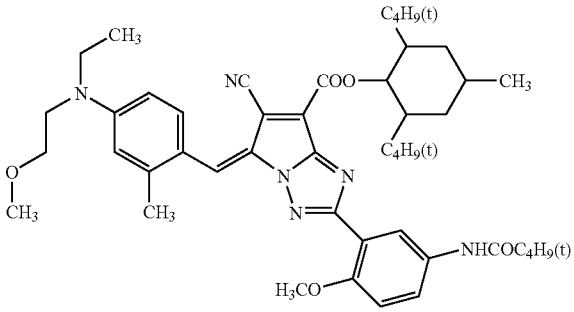
L-146
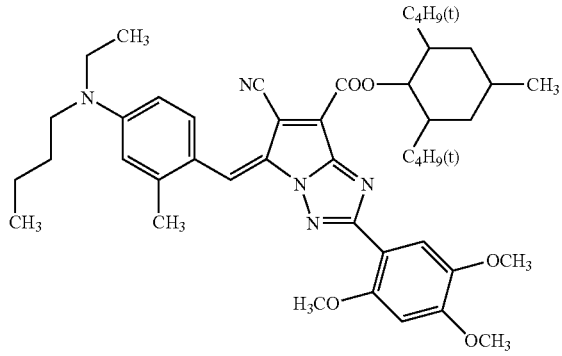
L-147
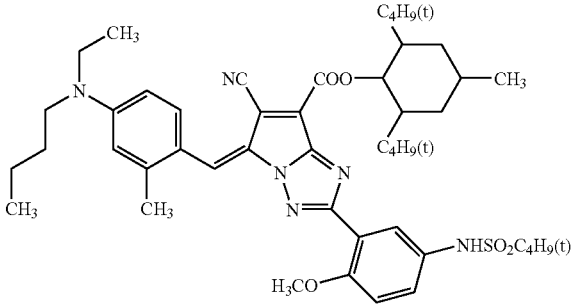
-continued
L-148
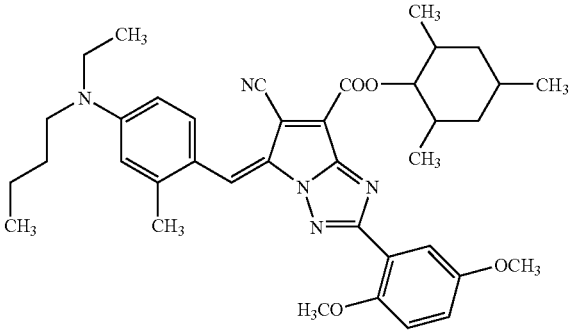
L-149
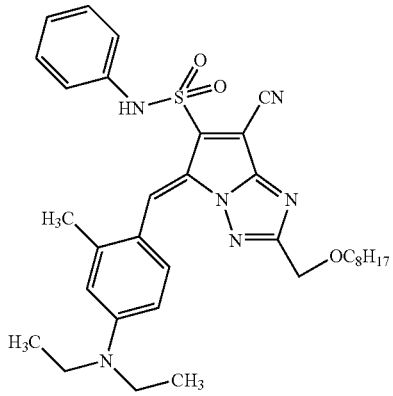
L-150
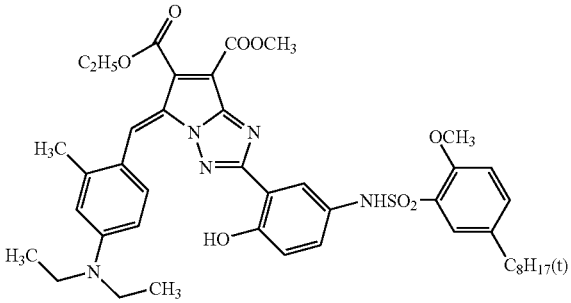
L-151
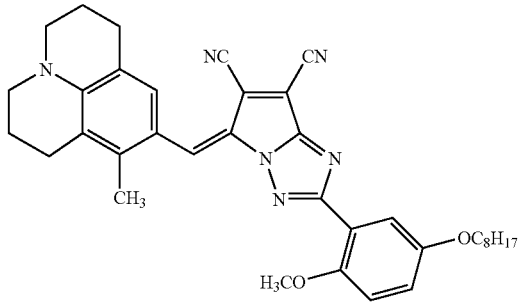

-continued
L-152
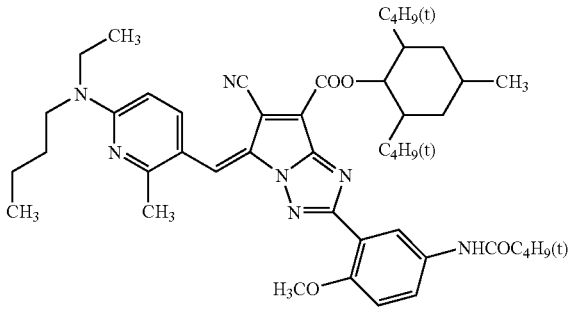
L-153
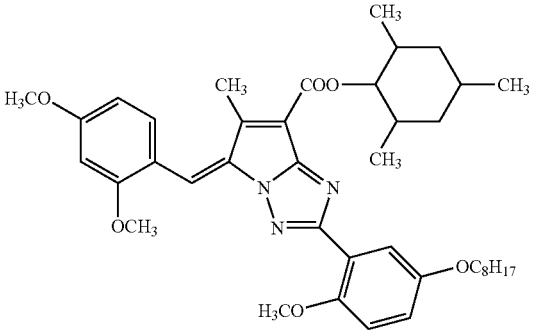
L-154
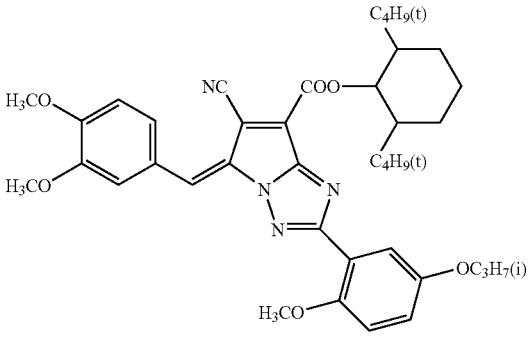
L-155
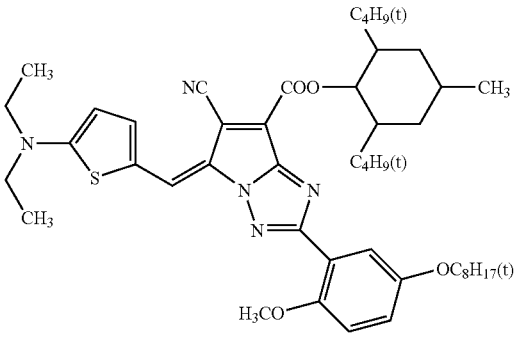
-continued
L-156
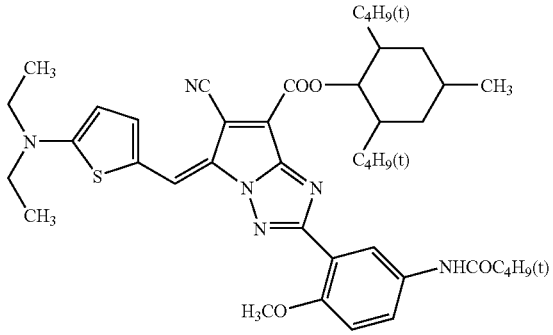
L-157
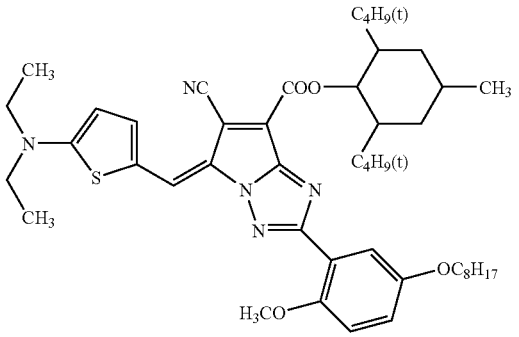
L-158
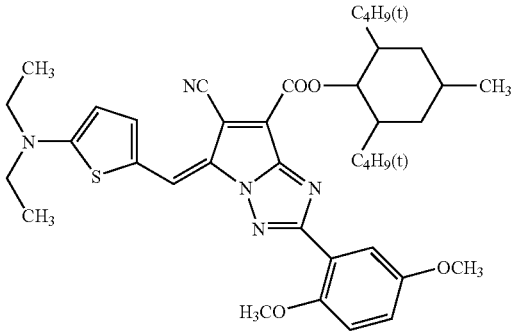
L-159
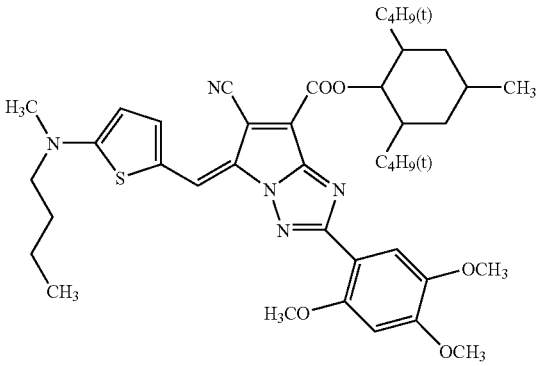

-continued
L-160
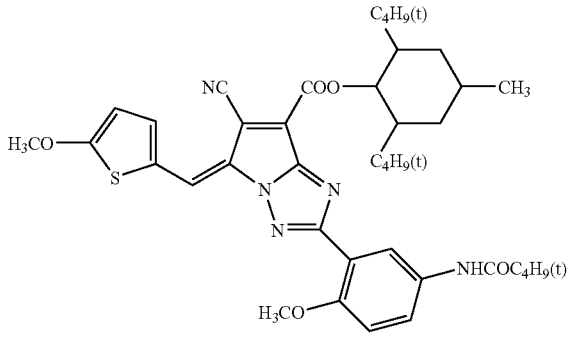
L161
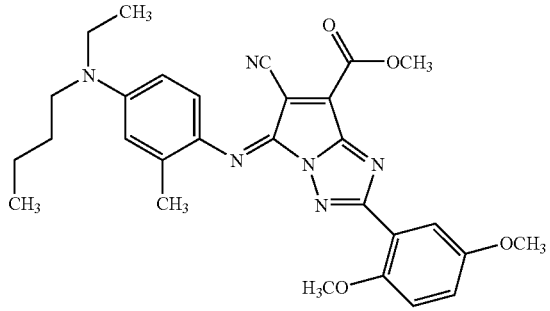
L-162
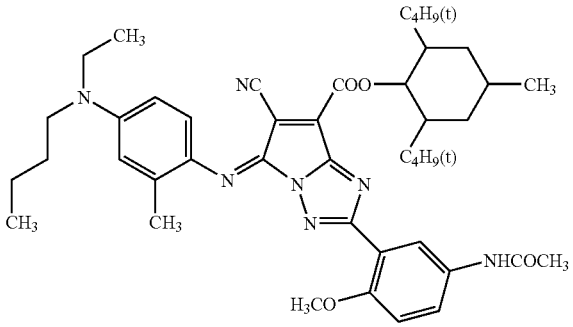
L-163
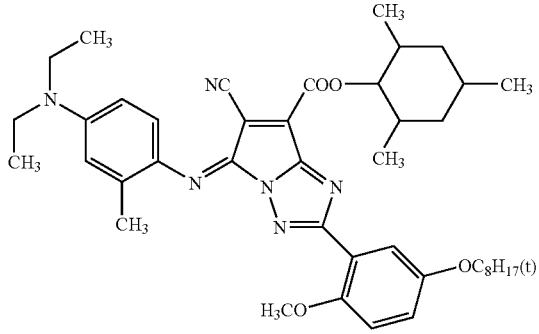
-continued
L-164
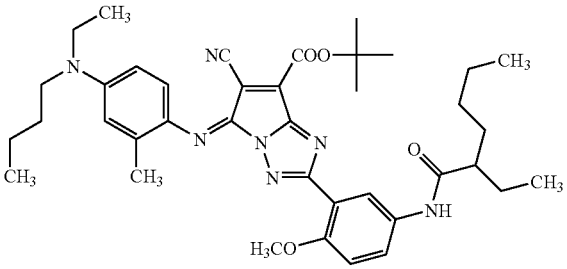
L-165
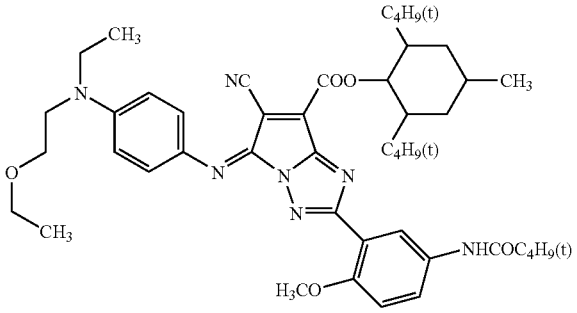
L-166
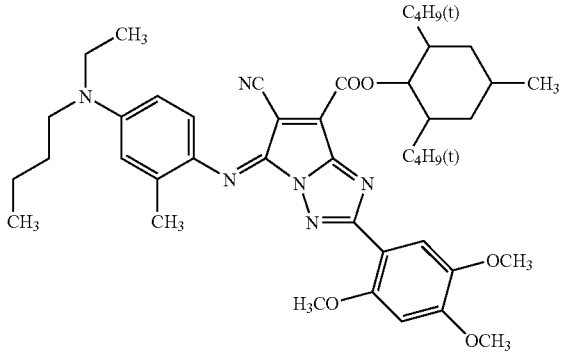
L-167
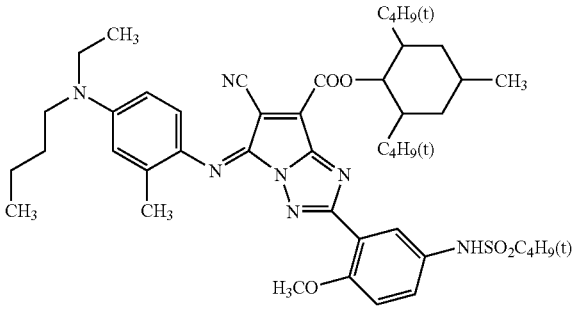

-continued
L-168
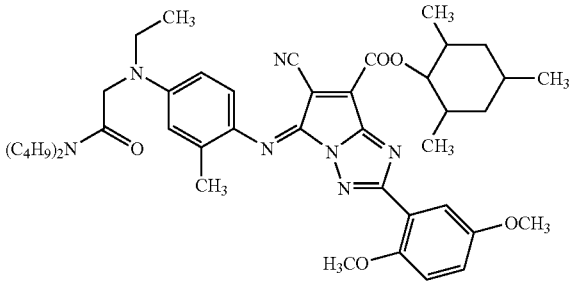
L-169
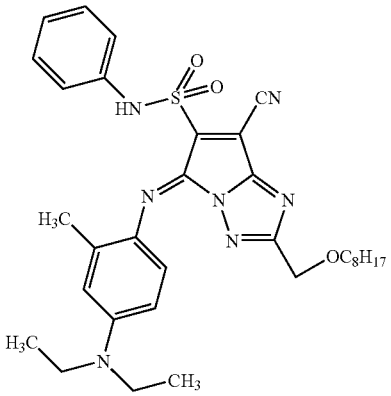
L-170
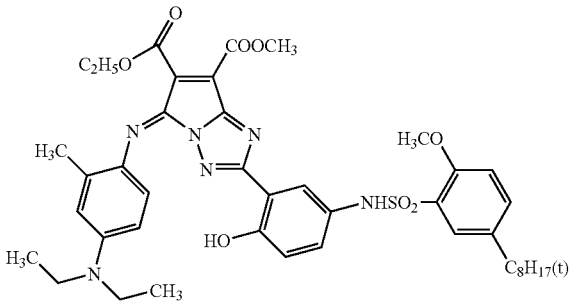
L-171
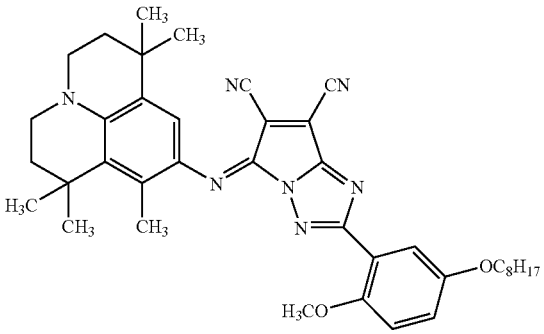
-continued
L-172
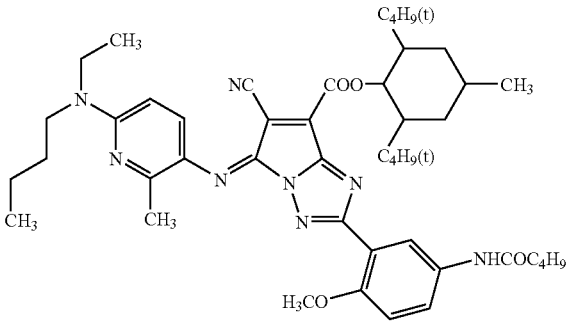
L-173
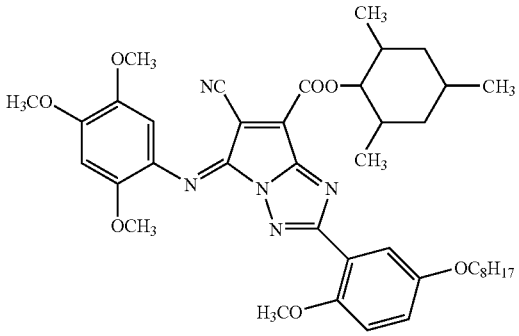
L-174
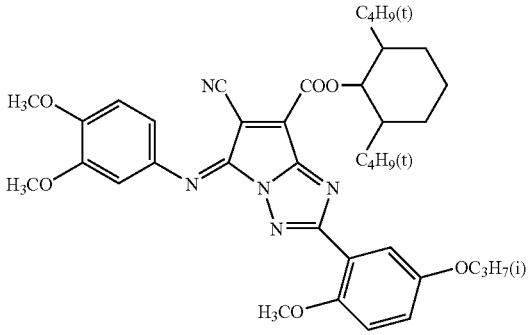
L-175
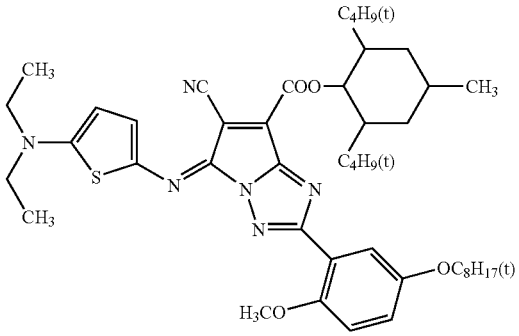

-continued
L-176
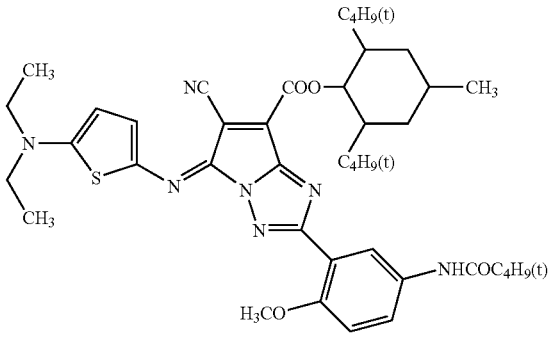
L-177
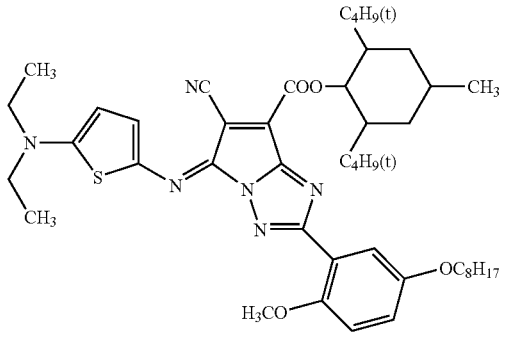
L-178
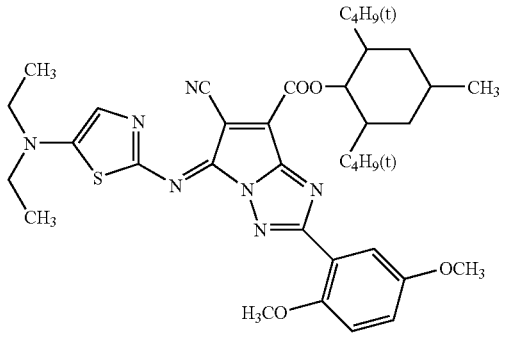
L-179
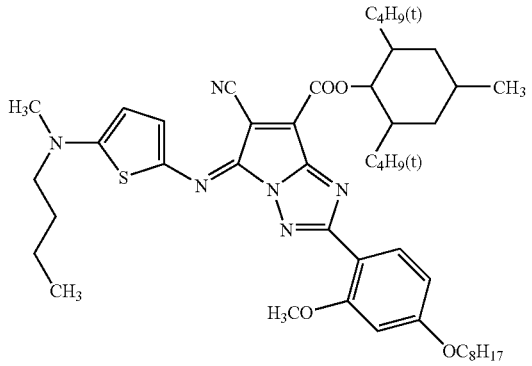
-continued
L-180
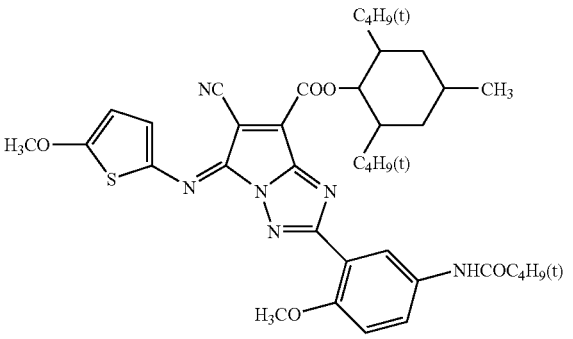
L-181
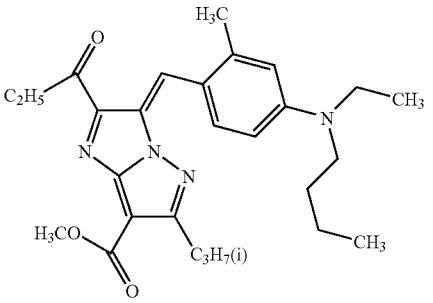
L-182
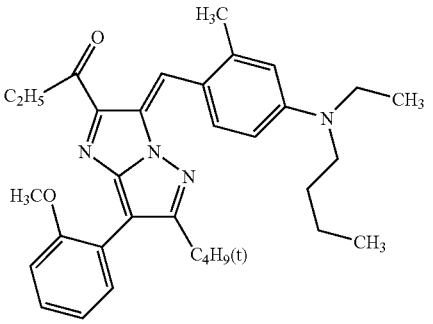
L-183
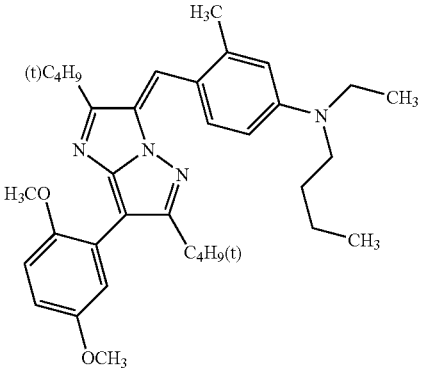

-continued
L-184
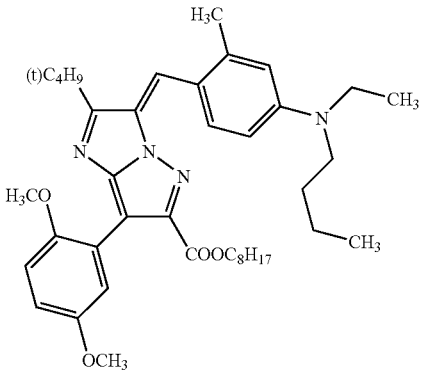
L-185
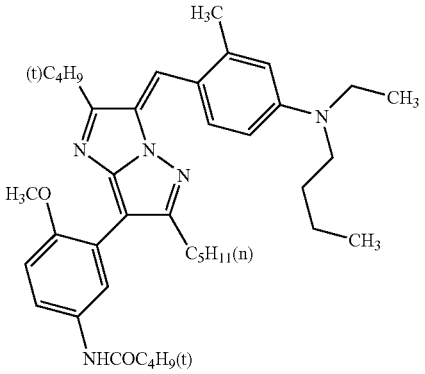
L-186
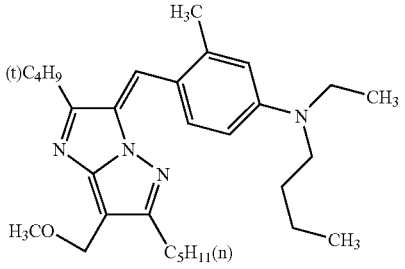
L-187
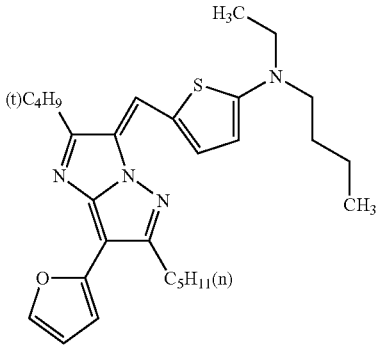
-continued
L-188
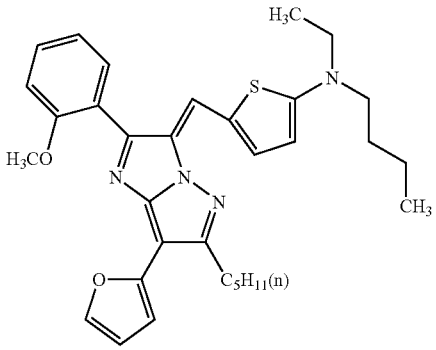
L-189
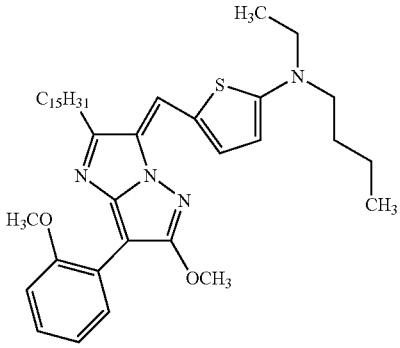
L-190
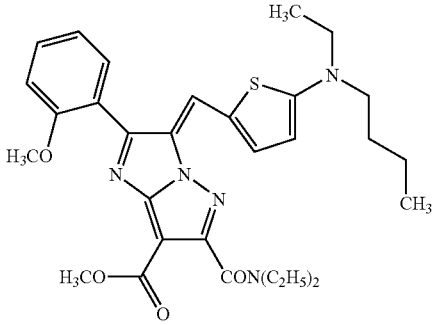
L-191
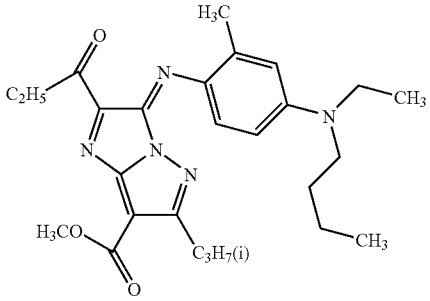

-continued
L-192
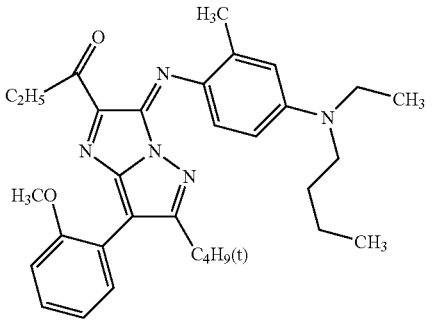
L-193
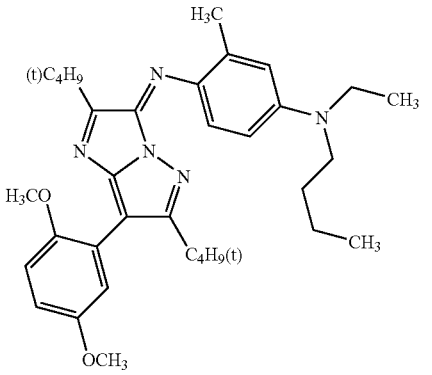
L-194
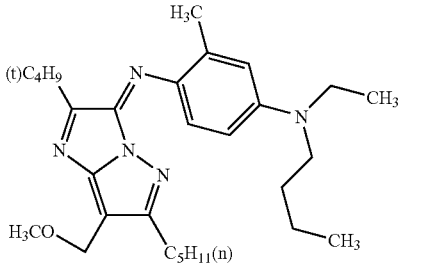
L-195
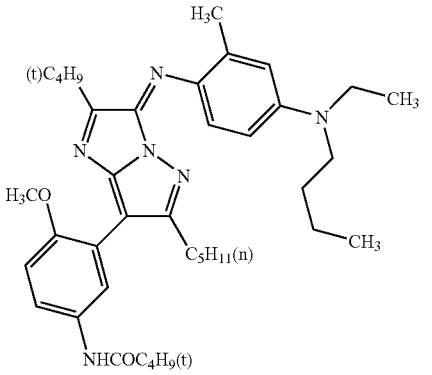
-continued
L-196
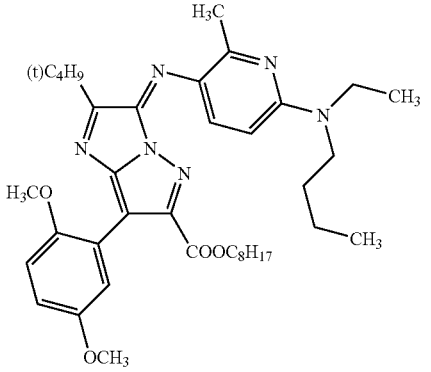
L-197
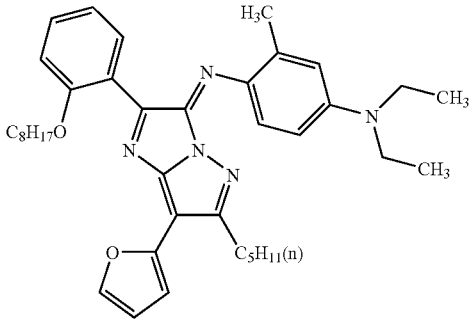
L-198
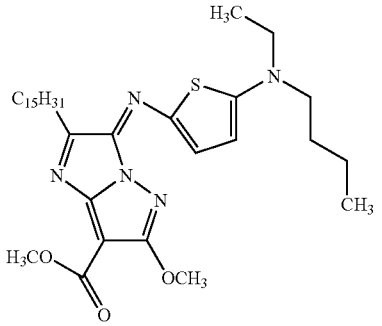
L-199
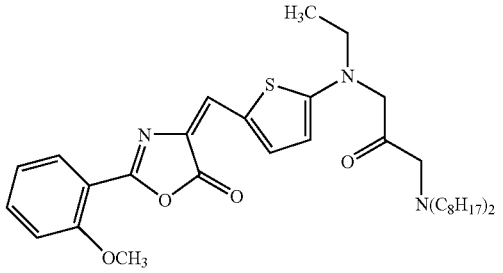
L-200
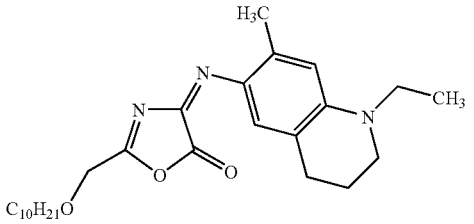

-continued
L-201
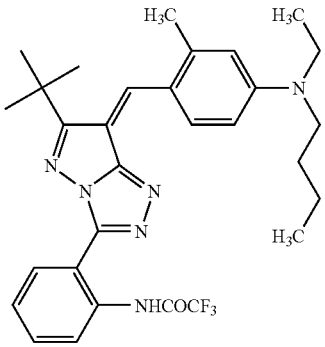
L-202
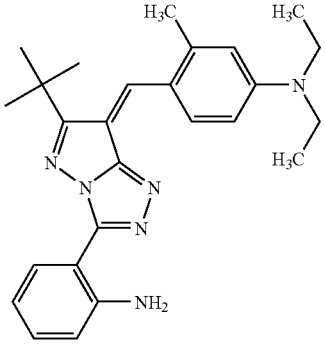
L-203
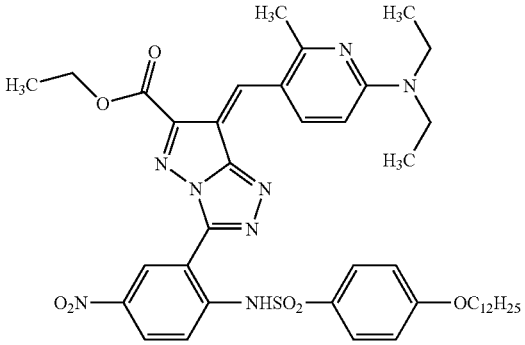
L-204
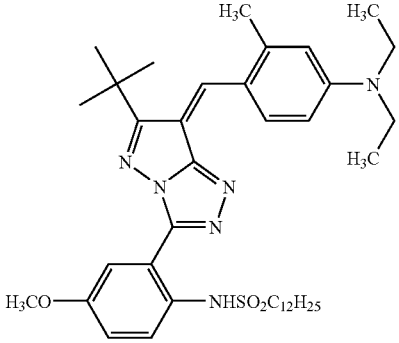
-continued
L-205
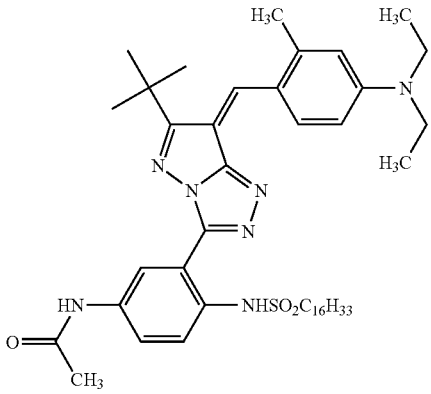
L-206
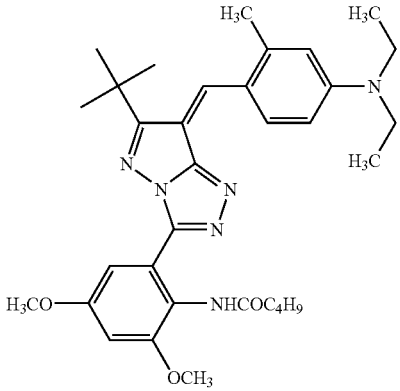
L-207
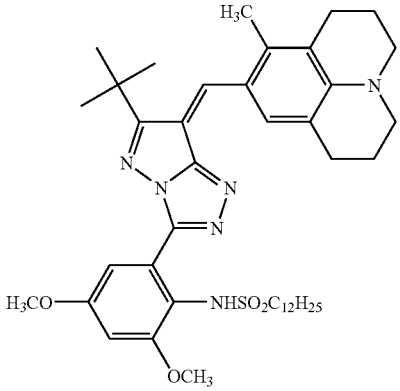
L-208
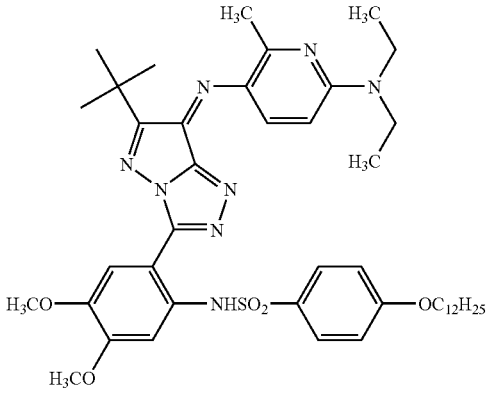

-continued
L-209
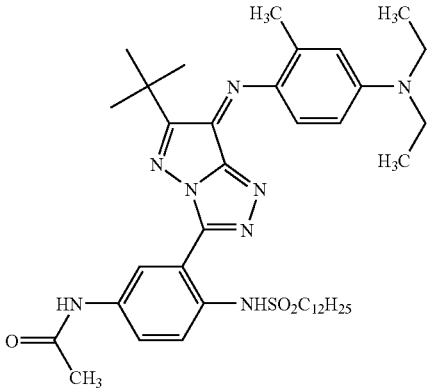
L-210
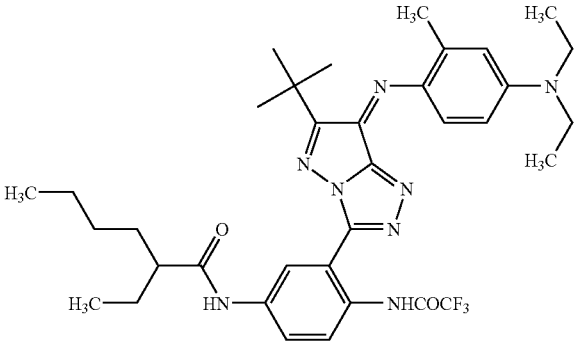
L-211
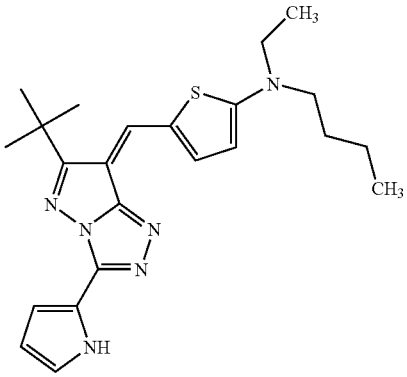
L-212
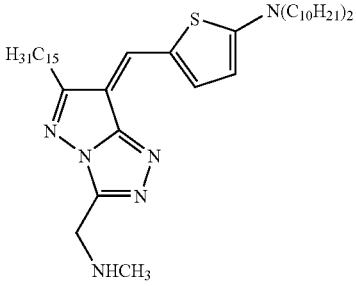
-continued
L-213
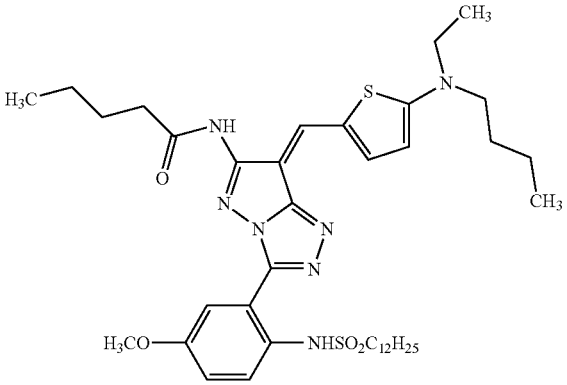
L-214
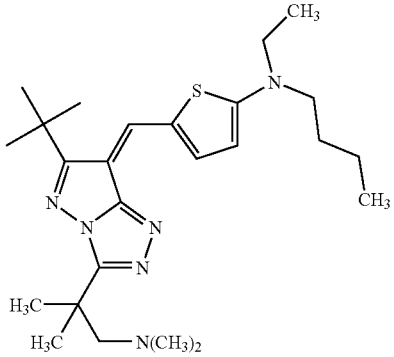
L-215
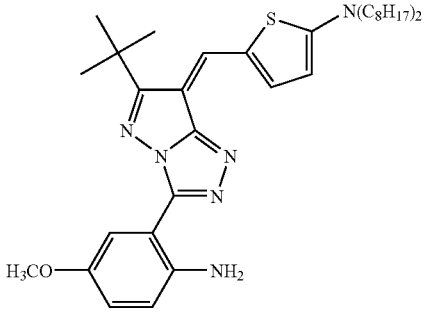
L-216
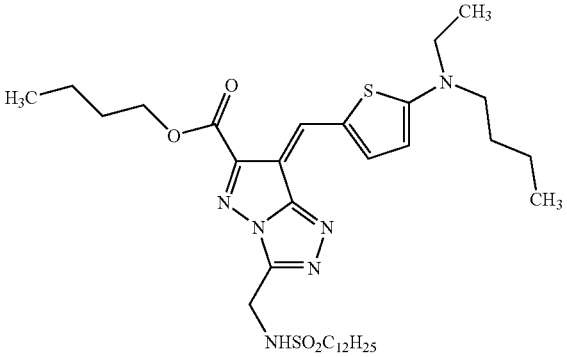

-continued
L-217
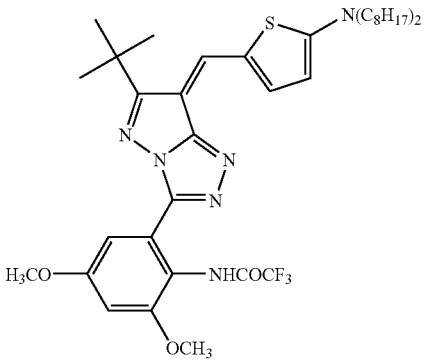
L-218
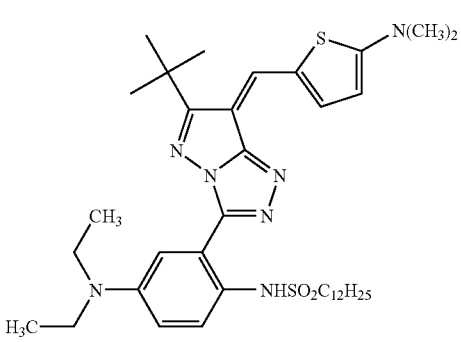
L-219
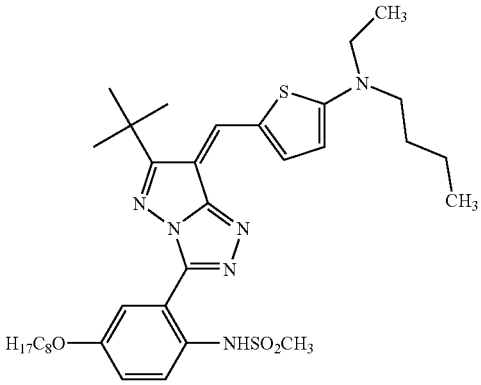
L-220
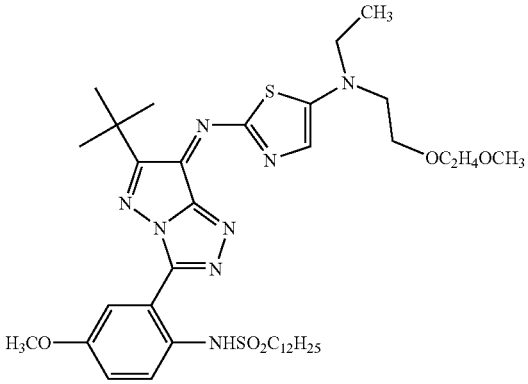
-continued
L-221
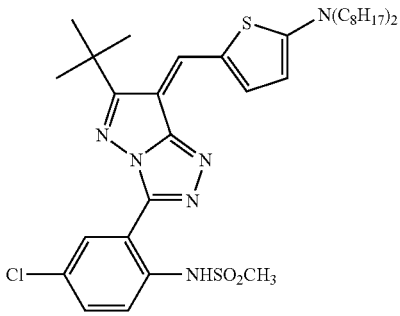
L-222
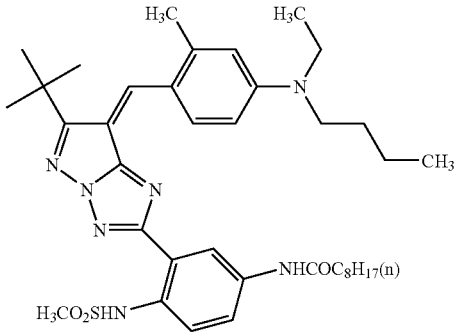
L-223
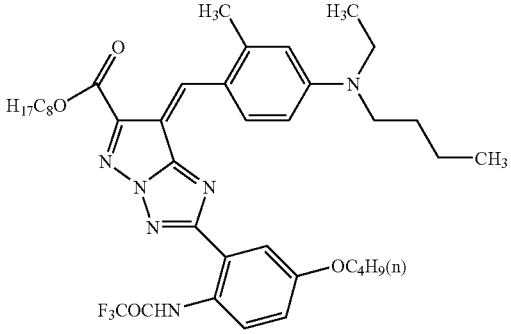
L-224
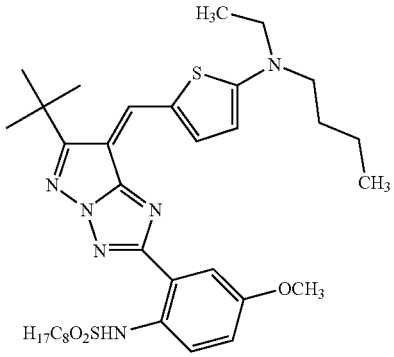

-continued
L-225
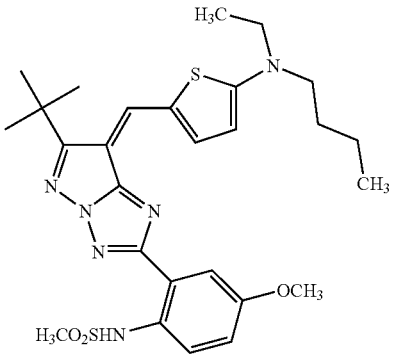
L-226
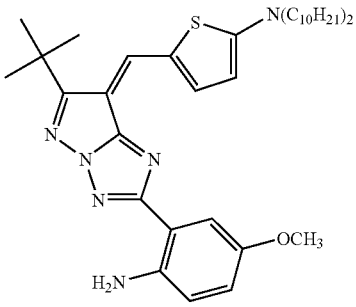
L-227
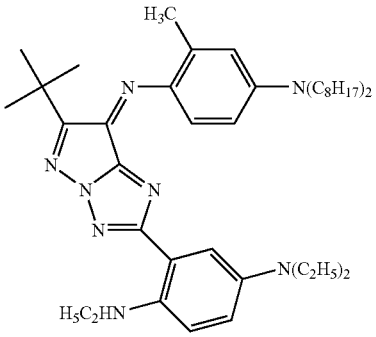
L-228
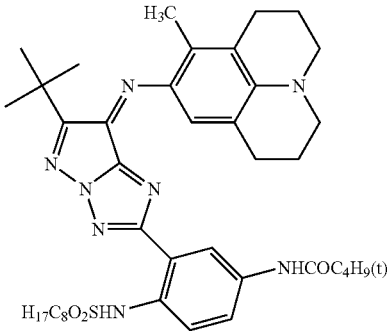
-continued
L-229
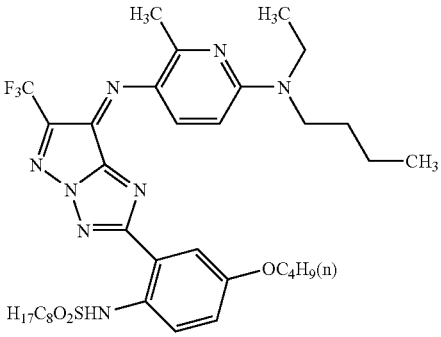
L-230
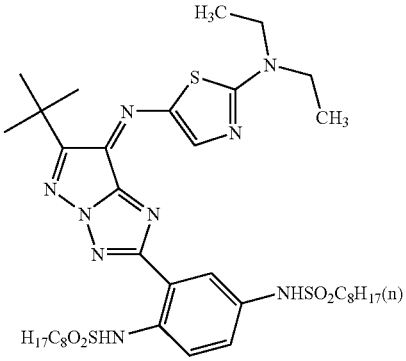
L-231
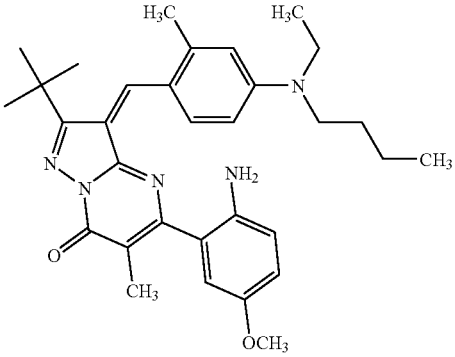
L-232
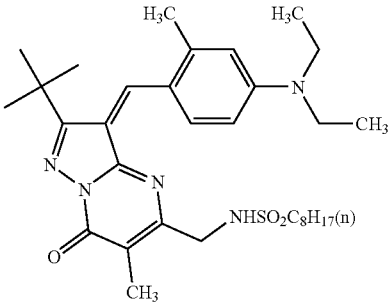

-continued
L-233
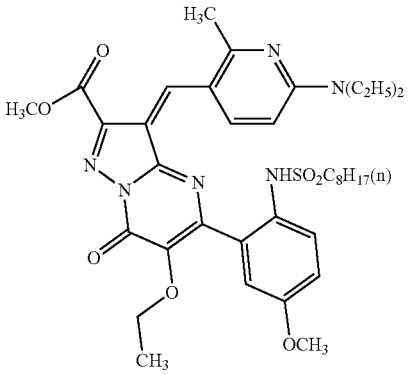
L-234
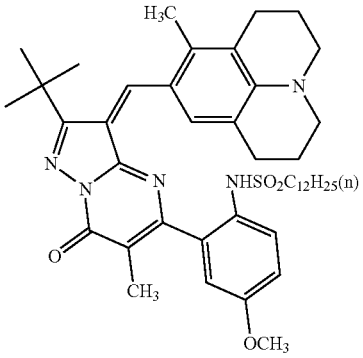
L-235
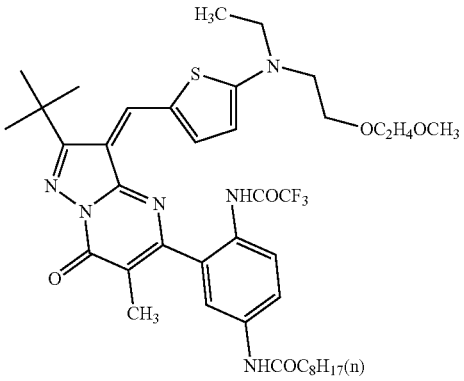
L-236
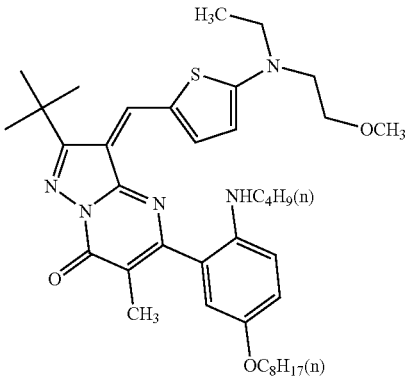
-continued
L-237
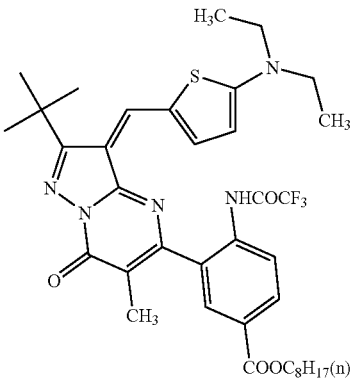
L-238
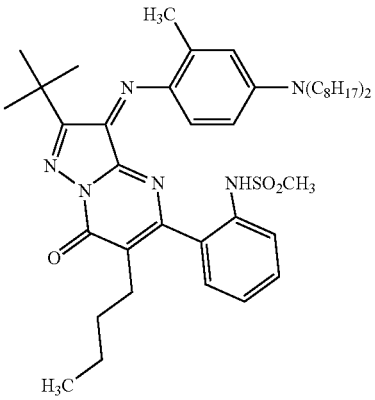
L-239
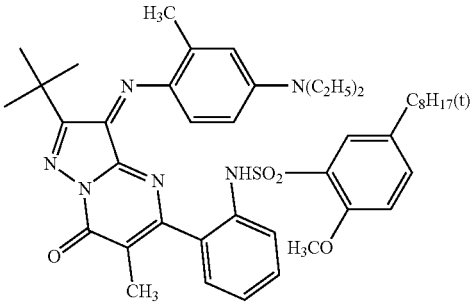
L-240
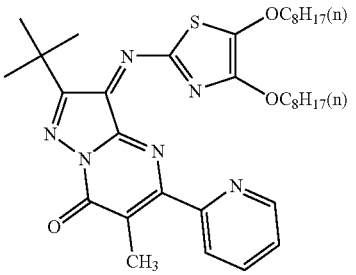

-continued
L-241
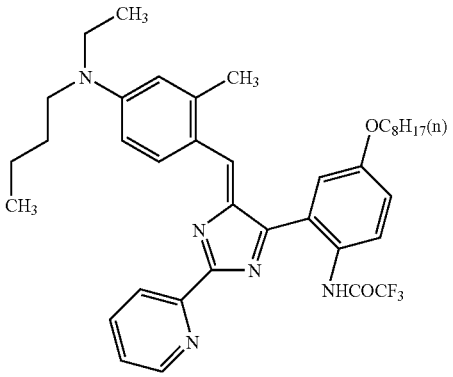
L-242
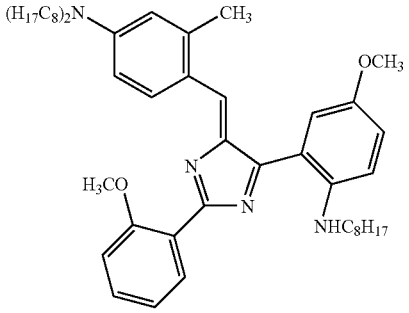
L-243
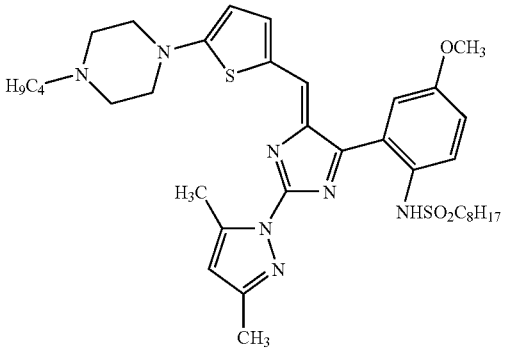
L-244
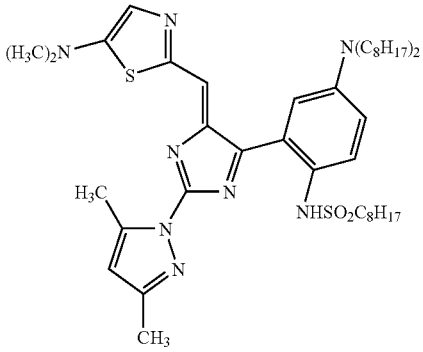
-continued
L-245
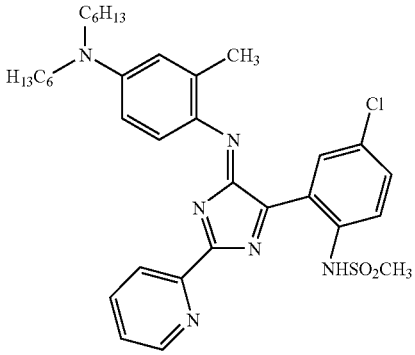
L-246
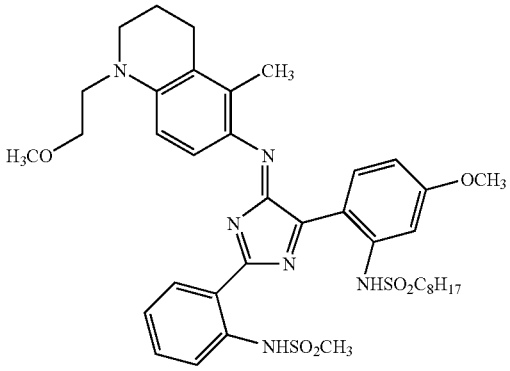
L-247
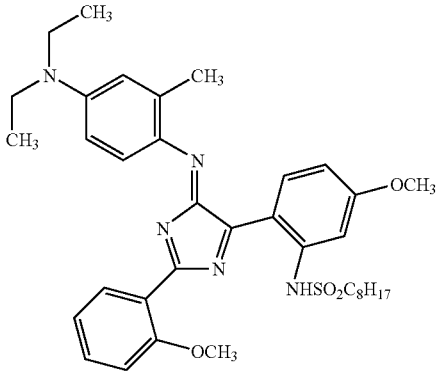
L-248
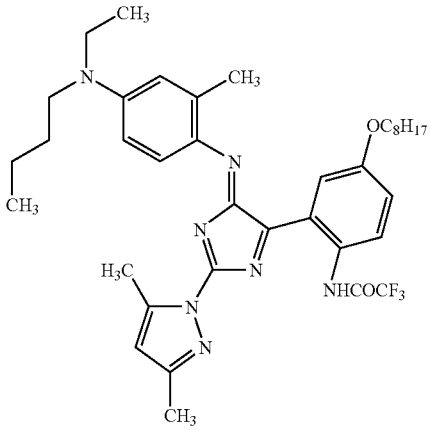

-continued
L-249
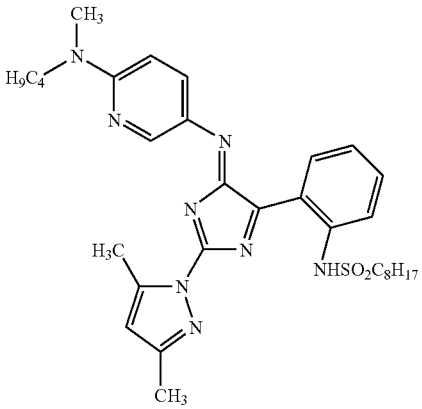
L-250
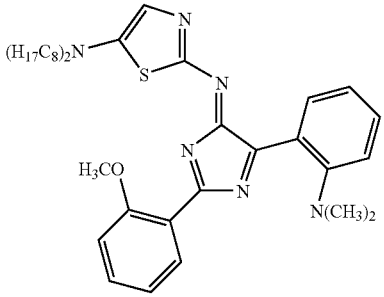
L-251
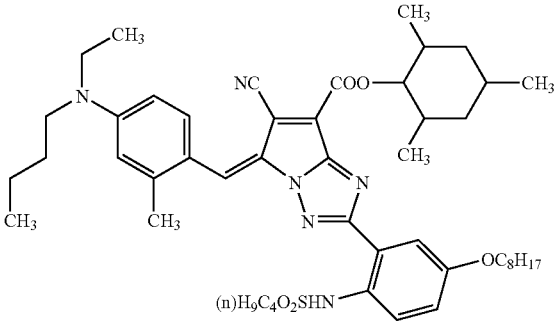
L-252
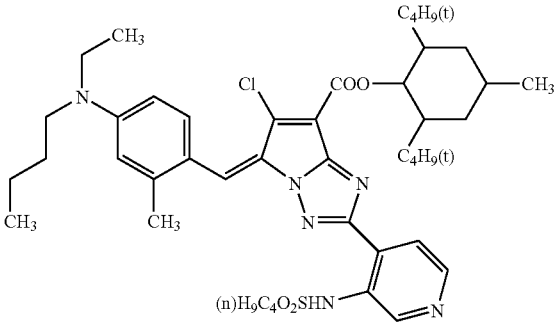
-continued
L-253
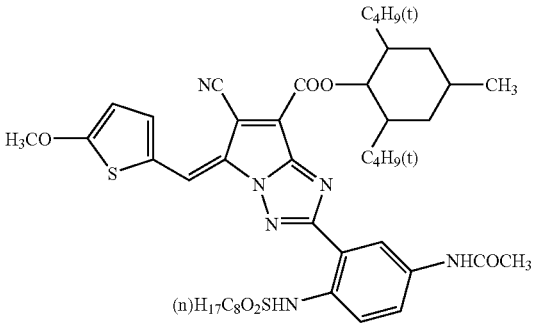
L-254
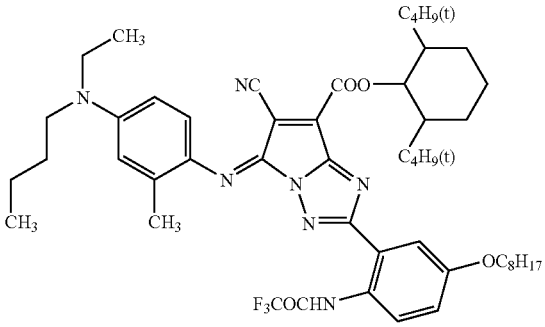
L-255
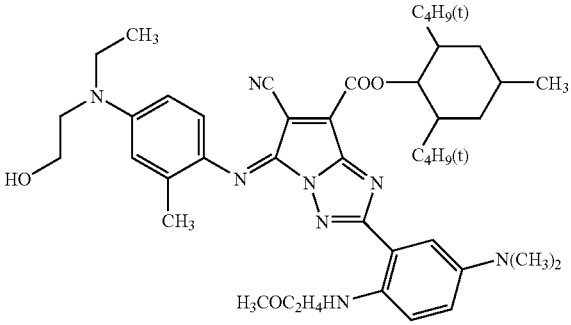
L-256
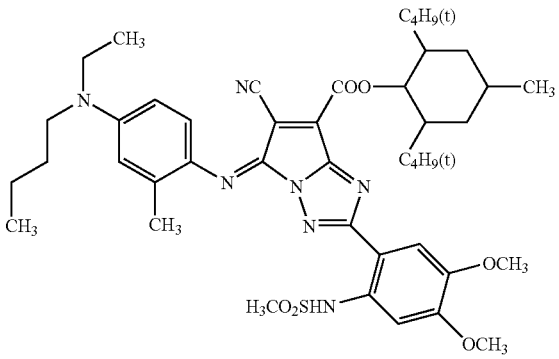

-continued
L-257
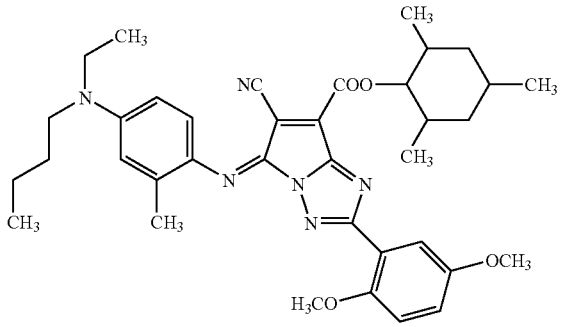
L-258
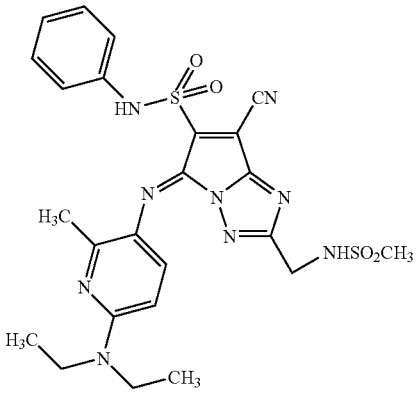
L-259
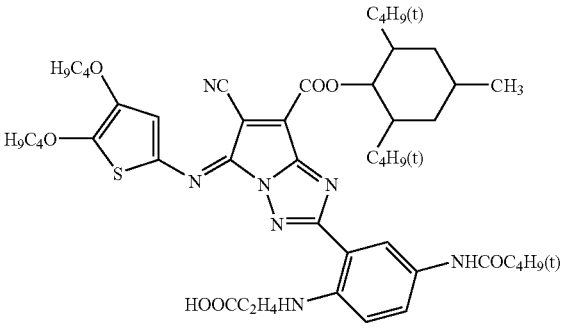
L-260
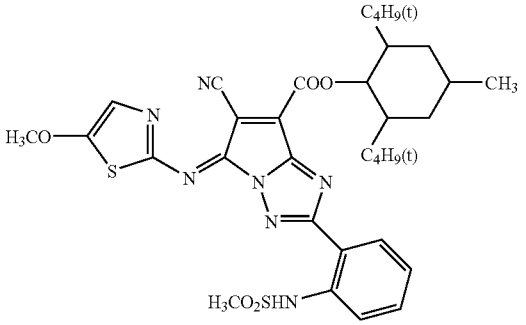
-continued
L-261
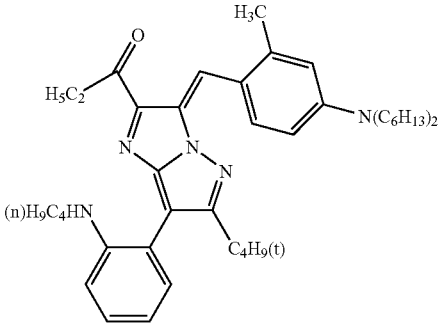
L-262
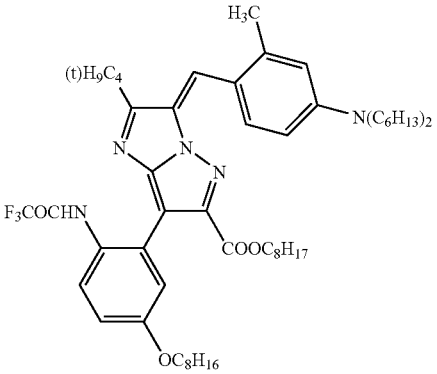
L-263
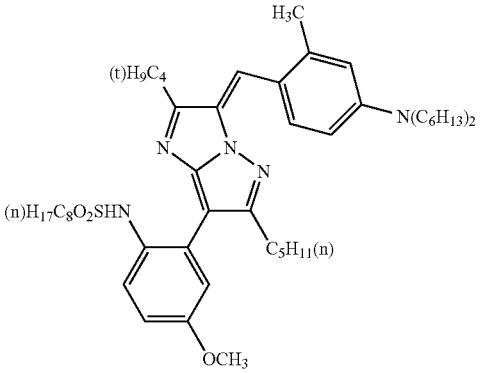
L-264
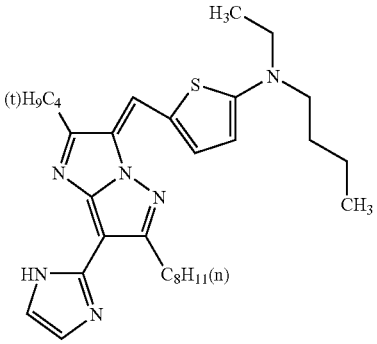

-continued

L-265

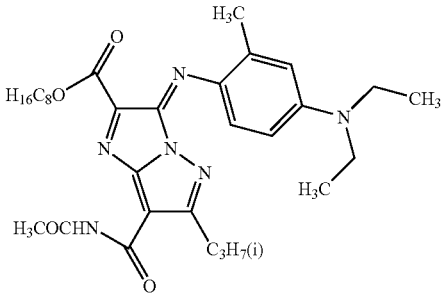

L-266

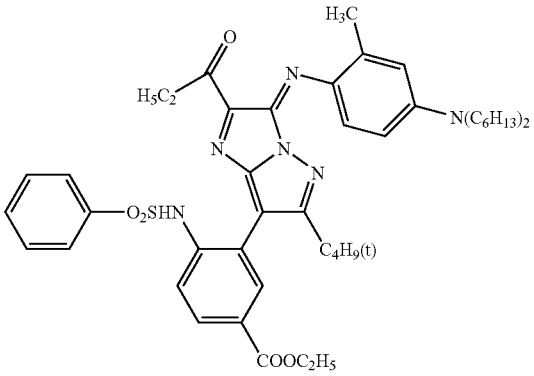

L-267

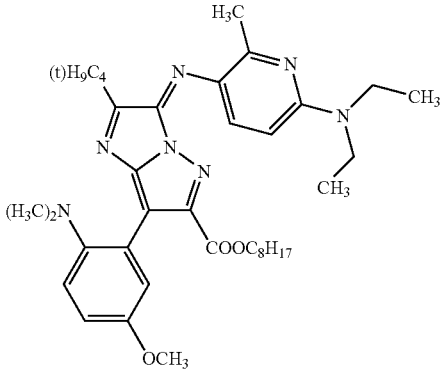

L-268

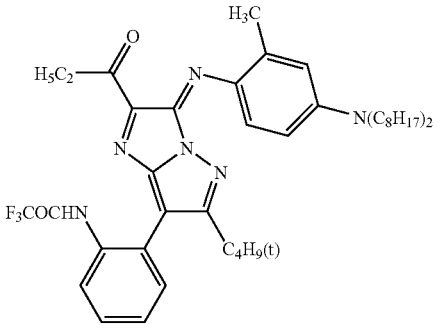

-continued

L-269

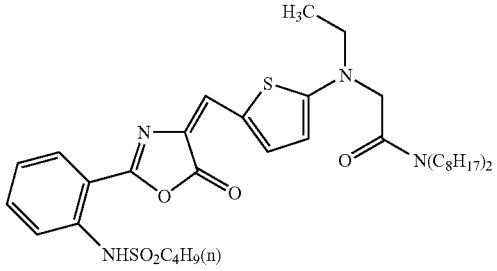

L-270

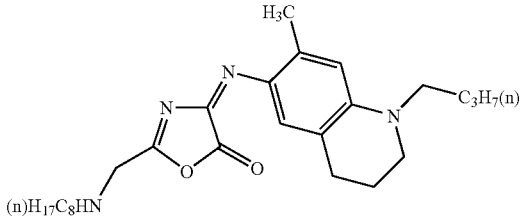

The oil-soluble dye ligands represented by Formula (1), (3)-(8) relating to the invention can be synthesized by referring known methods described in, for example, JP-A Nos. 10-193807, 11-78258, 10-265690, 6-250357, 63-226653, 2-155693, 2-53865 and 2-53866, European Patent No. 436, 736, British Patent No. 1,252,418, and JP-A Nos. 64-63194, 2-208094, 3-205189, 2-265791, 2-310087, 2-53866, 4-91987, 63-205288, and 3-226750, British Patent No. 1,183, 515, JP-A Nos. 4-190348, 63-113077, 3-275767, 4-13774 and 4-89287.

The ligands of the copper compound represented by Formula (9) can be synthesized by referring JP-A Nos. 2000-332259 and 2003-237246.

Examples of synthesizing method of a compound represented by Formulas (1), and (3)-(9) are described below, and another compound can be also synthesized in a similar manner but the method is not limited to them.

SYNTHESIZING EXAMPLE 1

<<Synthesis of L-35>>

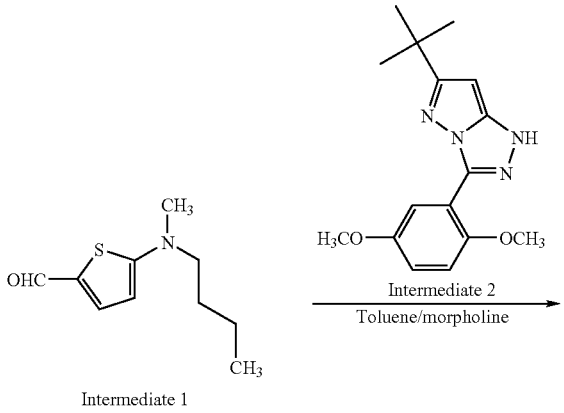

-continued

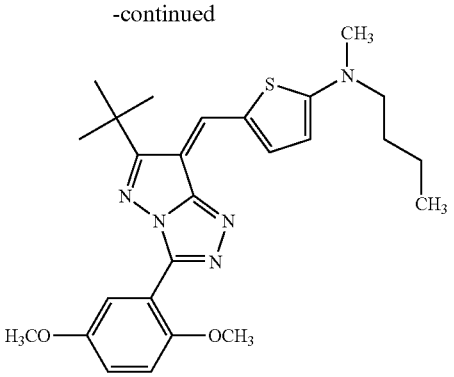

L-35

To 2.21 g of Intermediate 1 and 3.00 g of Intermediate 2, 50 ml of toluene and 1.00 g of morpholine were added while stirring and reacted for 4 hours by heating and refluxing for while dehydrating by an esterifying tube. After completion of the reaction, the reacting liquid was concentrated and purified by chromatography and recrystallized by methanol to obtained 4.25 g of L-35. It was confirmed that the obtained compound was the objective substance by identifying by MASS, H-NMR and IR spectrum.

SYNTHESIZING EXAMPLE 2

<<Synthesis of L-124>>

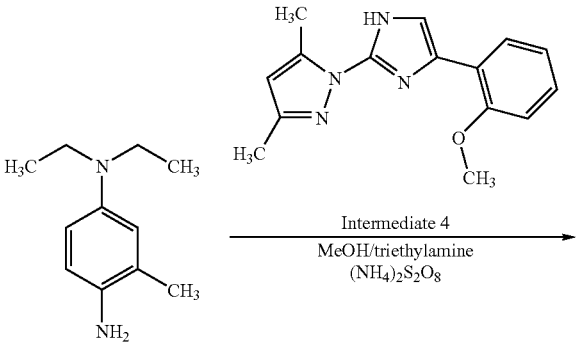

Intermediate 3

-continued

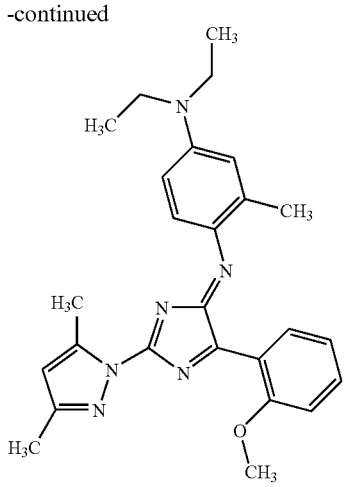

L-124

To 5.36 g of Intermediate 4, 120 ml of methanol and 21.2 ml of triethylamine were added and dissolved by stirring. After that, 13.0 g of ammonium persulfate dissolved in 20 ml of water was added and 3.74 g of Intermediate 3 dissolved in 20 ml of water and 20 ml of methanol was dripped into the reactive liquid over 20 minutes while stirring. After completion of the dripping, the liquid was stirred for 1 hour at room temperature and precipitated inorganic salt was filtered and washed by methanol. The filtrate was concentrated and the resultant residue was dissolved by 200 ml of ethyl acetate and 1N hydrochloric acid was added for making the pH to 1 to separate liquid. After the separation, the liquid was neutralized, washed and concentrated. The concentrated substance was purified by column chromatography and recrystallized by acetonitrile to obtain 7.52 g of L-124. It was confirmed that the obtained compound was the objective substance by identifying by MASS, H-NMR and IR spectrum.

SYNTHESIZING EXAMPLE 3

<<Synthesis of L-164>>

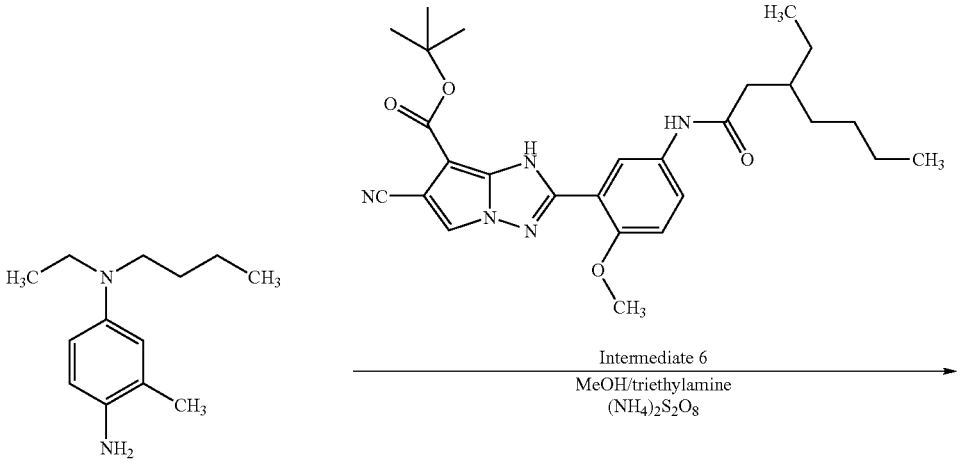

Intermediate 5

-continued

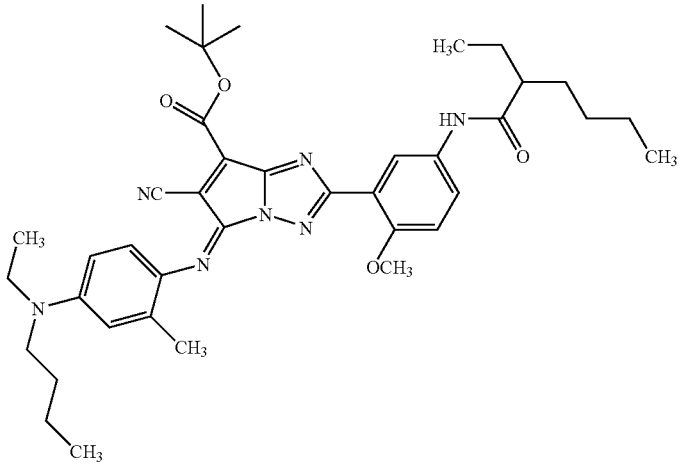

L-164

To 9.87 g of Intermediate 6, 120 ml of methanol and 21.2 ml of triethylamine were added and dissolved by stirring. After that, 13.0 g of ammonium persulfate dissolved in 20 ml of water was added and 4.33 g of Intermediate 5 dissolved in 20 ml of water and 20 ml of methanol was dripped into the reactive liquid over 20 minutes while stirring. After completion of the dripping, the liquid was stirred for 1 hour at room temperature and precipitated inorganic salt was filtered and washed by methanol. The filtrate was concentrated and the resultant residue was dissolved by 200 ml of ethyl acetate and 1N hydrochloric acid was added for adjusting the pH to 1 to separate liquid. After the separation, the liquid was neutralized, washed and concentrated. The concentrated substance was purified by column chromatography and recrystallized by acetonitrile to obtain 11.13 g of L-164. It was confirmed that the obtained compound was the objective substance by identifying by MASS, H-NMR and IR spectrum.

SYNTHESIZING EXAMPLE 4

<<Synthesis of L-225>>

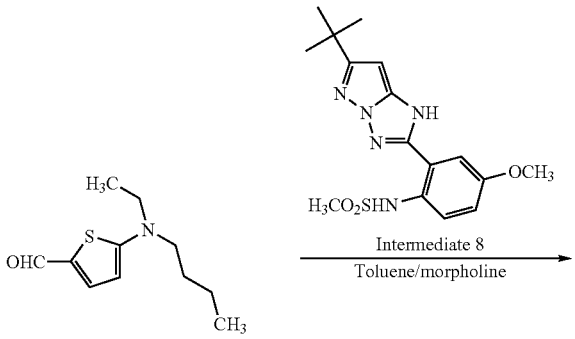

Intermediate 7

-continued

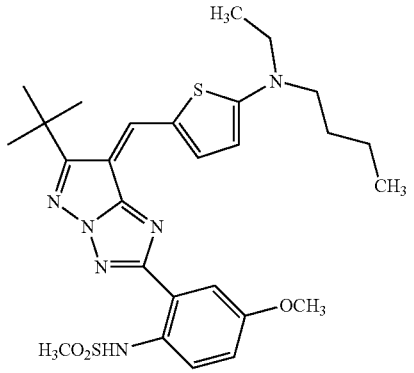

L-225

To 2.36 g of Intermediate 1 and 3.36 g of Intermediate 2, 50 ml of toluene and 1.00 g of morpholine were added while stirring and reacted for 4 hours by heating and refluxing for while dehydrating by an esterifying tube. After completion of the reaction, the reacting liquid was concentrated and purified by chromatography and recrystallized by methanol to obtain 4.73 g of L-225. It was confirmed that the obtained compound was the objective substance by identifying by MASS, H-NMR and IR spectrum.

SYNTHESIZING EXAMPLE 5

<<Synthesis of L-245>>

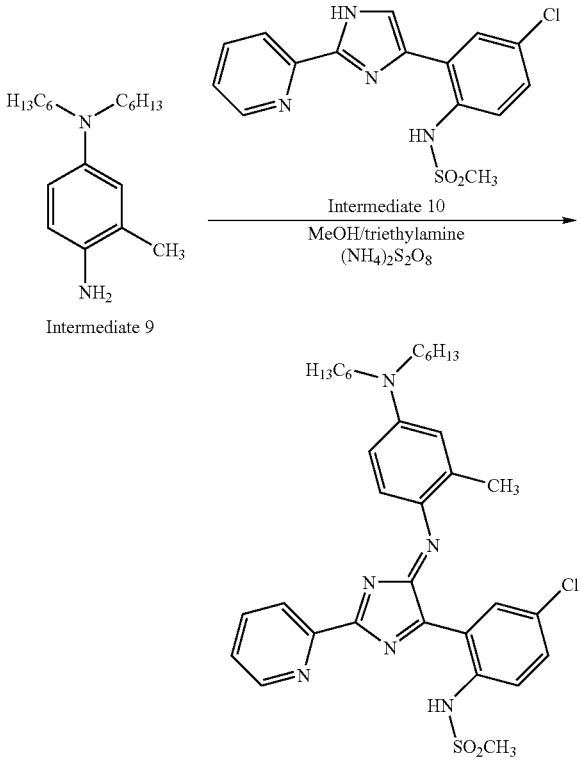

To 6.98 g of Intermediate 5, 120 ml of methanol and 21.2 ml of triethylamine were added and dissolved by stirring. After that, 13.0 g of ammonium persulfate dissolved in 20 ml of water was added and 5.80 g of Intermediate 1 dissolved in 20 ml of water and 20 ml of methanol was dripped into the reactive liquid over 20 minutes while stirring. After completion of the dripping, the liquid was stirred for 1 hour at room temperature and precipitated inorganic salt was filtered and washed by methanol. The filtrate was concentrated and the resultant residue was dissolved by 200 ml of ethyl acetate and IN hydrochloric acid was added for adjusting the pH to 1 to separate liquid. After the separation, the liquid was neutralized, washed and concentrated. The concentrated substance was purified by column chromatography and recrystallized by acetonitrile to obtain 10.80 g of L-245. It was confirmed that the obtained compound was the objective substance by identifying by MASS, H-NMR and IR spectrum.

(Colored Microscopic Particle)

The electrophotographic toner of the invention comprises colored microscopic particles dispersed in the thermoplastic resin, and one of preferable embodiments of the colored microscopic particle is characterized in that the particle contains a resin different from the thermoplastic resin in the composition and the oil-soluble dye. Namely, the toner is characterized in that the colored microscopic particles containing the metal and the oil-soluble dye capable of chelating or those further containing the resin different from the thermoplastic resin are dispersed in the thermoplastic resin in stead of that the oil-soluble dye is directly dispersed or dissolved in the thermoplastic resin as in usually known toner using oil-soluble dye.

The oil-soluble dye in the colored microscopic particle is dissolved in molecular level in the resin. Therefore, it is considered that a constituent cutting off light such as a concealing particle can be removed so that the transparency of each of the color is raised and the transparency of the overlapped colors is also increased.

FIG. 1 shows a schematic drawing of the cross section of a toner particle in which the colored microscopic particles are dispersed in the thermoplastic resin.

Figure 2:
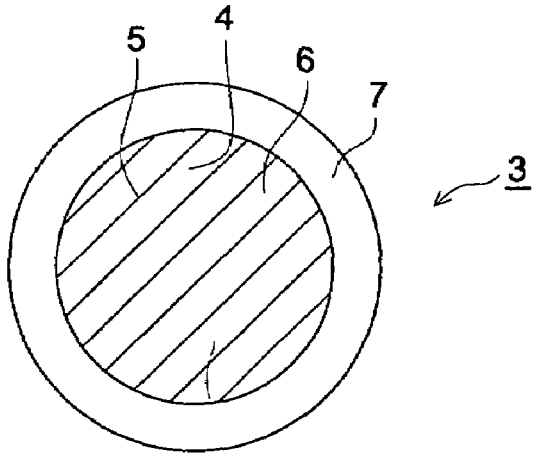
FIG. 2 shows a schematic cross section of a core/shell structured colored microscopic particle constituted of a core covered by an outer resin layer (or shell).

FIG. 2 shows a schematic drawing of the cross section of a colored microscopic particle constituted by a core and an outer resin layer (shell) covering the core.

In FIGS. 1 and 2, 1 is the toner particle, 2 is thermoplastic resin, 3 is the colored microscopic particle, 4 is the resin, 5 is the oil-soluble dye, 6 is the core and 7 is the outer resin layer (shell).

In the toner of the invention, the colored microscopic particles 3 are dispersed in the thermoplastic resin 2 and the colored microscopic particles each contain the resin 4 different from the thermoplastic resin in the composition and the oil-soluble dye 5 as shown in FIG. 1.

The colored microscopic particle 3 may be covered with the outer resin layer (shell) 7. In such the case, the combination of the resin of the core of the colored microscopic particle 3 and the thermoplastic resin (binder resin) is not limited and the degree of freedom of selection of the material is large, and advantage of the cost is also large because the four color toners can be produced under the same condition when the shell resin is the same. Furthermore, sublimation of the oil-soluble dye and contamination of the oil are not caused because the oil-soluble dye as the colorant is not moved out from the particle, such the problems are posed in the usual toner using the oil-soluble dye.

(Producing Method of the Colored Microscopic Particle)

The production method of the colored microscopic particle is described below.

The colored microscopic particle of the invention can be obtained by dissolving or dispersing the resin, oil-soluble dye and the metal compound such as the copper compound represented by Formula (2) in the organic solvent and emulsified in water and then removing the organic solvent. When the resin different from the thermoplastic resin in the composition is contained so as to cover the color fine particle by the shell, a monomer having a polymerizable unsaturated double bond is added to the color fine particle and emulsion polymerized in the presence of a surfactant so as to precipitate onto the core surface simultaneously with the polymerization to obtain the colored microscopic particle having the core/shell structure. Besides, the colored microscopic particle can be obtained by various methods, for example, a method in which an aqueous dispersion of resin fine particles is previously prepared by emulsion polymerization and a organic solvent solution of the oil-soluble dye and the copper compound and the organic solvent solution is mixed with the dispersion of the resin fine particle so as to permeate the oil-soluble dye into the resin fine particle and the shell is formed onto the colored resin particle.

The shell is preferably formed by organic resin. For forming the shell, a method can be applied in which the resin dissolved in an organic solvent is gradually dripped and for absorbing the resin onto the colored microscopic particle simultaneously the precipitation of the resin. It is preferable in the invention to apply a method in which the colored microscopic particle containing the oil-soluble dye and the copper compound for forming the core is previously prepared and then the monomer having a polymerizable unsaturated double bond is added and emulsion polymerized in the presence of a surfactant so that the polymer is precipitated onto the core surface simultaneously with the polymerization to form the shell.

(Core/Shell Structure)

In the invention, the core/shell structure is a state in which two or more kinds of resin and the oil-soluble dye exist in a phase-separated form. Therefore, the structure may be not only the state in which the shell completely covers the core but also-the shell partially covers the core. It is allowed that a part of the resin of the shell forms a domain in the core particle. Moreover, one having a multi-layer structure including one or more layers between the shell and the core is also allowed.

In the invention, it is preferable that the colored microscopic particle has the core/shell structure having a colored core comprising the oil-soluble dye and the resin and the outer resin layer covering the core to form the shell.

(Thermoplastic Resin)

The thermoplastic rein or binder resin to be contained in the toner of the invention is preferably one showing high adhesiveness with the colored microscopic particle and solvent soluble one is particularly preferable. When the precursor of the polymer is solvent-soluble, a curable resin having a three dimensional structure also can be applied. As the thermoplastic resin, ones usually used for binder resin of toner can be used without any limitation. For example, a styrene type resin, an acryl type resin such as an alkyl acrylate and an alkyl methacrylate, a styrene-acryl type resin, a polyester type resin, a silicone type resin, an olefin type resin, an amide type resin and an epoxy type resin are suitably used. A resin having high transparency, low viscosity in molten state and high sharp-melting property is required for raising the transparency and the color reproducibility of the overlapped image. The styrene type resin, acryl type resin and polyester type resin are suitable as the binder resin having such the properties.

A resin having a number average molecular weight (Mn) of from 3,000-6,000 and preferably from 3,500 to 5,500, a ratio of weight average molecular weight to number average molecular weight Mw/Mn of from 2 to 6 and preferably from 2.5 to 5.5, a glass transition point of from 50 to 70° C. and preferably from 55 to 70° C., and a softening point of from 90 to 110° C. and preferably from 90 to 105° C. is desirably used.

When the number average molecular weight is less than 3,000, the image is peeled off on the occasion of the solid portion of the image was folded, namely the resistivity of the fixed image against the folding is lowered, and when it is more than 6,000, the thermal melting ability is lowered so as to low the fixing strength. When Mw/Mn is lower than 2, the offset at high temperature tends to occur and when that is more than 6, the sharp-melting ability at the fixation is lowered so that the light permeability of the toner and the color mixing ability on the occasion of full color image formation are lowered.

When the glass transition point is less than 50° C., the heat resistance becomes insufficient so that the coagulation of the toner tens to occur and when that is more than 70° C., the toner is difficultly molten so that the fixing suitability and color mixing ability on the occasion of formation of full color image are lowered. When the softening point is less than 90° C., the high temperature offset tends to occur and when it is more than 110° C., the fixing strength, light permeability, color mixing ability and glossiness of the full color image are lowered.

(Resin for Core)

The resin for forming the core of the colored microscopic particle relating to the invention is described below. The resin for forming the core of the colored microscopic particle relating to the invention is not specifically limited as long as the resin is different from the thermoplastic resin in the composition thereof. For example, a (meth)acrylate type resin, a polyester type resin, a polyamide type resin, a polyimide type resin, a polystyrene type resin, a polyepoxy type resin, a polyester type resin, an amino type resin, a fluororesin, a phenol type resin, a polyurethane type resin, a polyethylene type resin, a poly(vinyl chloride) type resin, a poly(vinyl alcohol) type resin, a polyether type resin, a poly(ether ketone) type resin, a poly(ethylene sulfide) resin, a polycarbonate resin and an aramid resin are usable, and a resin obtained by polymerizing a polymerizable ethylenic unsaturated double bond such as the (meth)acrylate type resin, polystyrene type resin, polyethylene type resin, poly(vinyl chloride) type resin, is preferred. The (meth)acrylate type resin and the polystyrene type resin are most preferable.

The (meth)acrylate type resin can be synthesized by homo- or co-polymerization of various methacrylate type monomers and acrylate type monomers, and desired (meth)acrylate type resin can be obtained by varying the kind and the ratio of the monomers. Furthermore, a copolymer produced by copolymerizing the (meth)acrylate type monomer together with a copolymerizable monomer having a unsaturated double bond other than the (meth)acrylate type monomer and a copolymer of the (meth)acrylate type monomer together with other plural kinds of monomer are usable in the invention.

Examples of the monomer component for forming the (meth)acrylate type resin include (meth)acrylic acid, methyl (meth)acrylate, ethyl(meth)acrylate, propyl(meth)acrylate, butyl(meth)acrylate, isopropyl(meth)acrylate, isobutyl (meth)acrylate, t-butyl(meth)acrylate, stearyl(meth)acrylate, 2-hydroxyethyl(meth)acrylate, acetoxyethyl (meth)acrylate, dimethylaminoethyl(meth)acrylate, 2-hydroxypropyl(meth) acrylate, di(ethylene glycol)ethyl ether(meth)acrylate, ethylene glycol methyl ether(meth)acrylate, isobonyl(meth)acrylate, chloroethyl trimethyl ammonium(meth)acrylate, trifluoroethyl(meth)acrylate, octafluoropentyl(meth)acrylate, 2-acetoamidemethyl(meth)acrylate, 2-methoxyethyl (meth)acrylate, 2-dimethylaminoethyl(meth)acrylate, 3-trimethoxysilane(meth)acrylate, benzyl(meth)acrylate, tridecyl (meth)acrylate, 4-hydroxybutyl(meth)acrylate, tetrahydrofrufuryl(meth)acrylate, dodecyl(meth)acrylate, octadecyl(meth)acrylate, 2-diethylaminoethyl(meth)acrylate, 2-ethylhexyl(meth)acrylate, cyclohexyl(meth)acrylate, phenyl(meth)acrylate and glycidyl(meth)acrylate, and (meth)acrylic acid, methyl(meth)acrylate, ethyl(meth)acrylate, propyl(meth)acrylate, butyl(meth)acrylate, stearyl (meth)acrylate, 2-hydroxyethyl(meth)acrylate, cactoacetoxyethyl(meth)acrylate, benzyl(meth)acrylate, tridecyl (meth)acrylate, dodecyl(meth)acrylate and 2-ethylhexyl (meth)acrylate are preferable.

The polystyrene type resin includes a homopolymer of styrene monomer, a random copolymer, a block polymer and a graft polymer formed by copolymerization of styrene polymer and another copolymerizable monomer having an unsaturated double bond. Furthermore, a blended material and a polymer each alloy prepared by combining such the polymer together with another polymer are also usable. Examples of the styrene monomer include styrene, a nucleus alkyl-substituted styrene such as α-methylstyrene, α-ethylstyrene, α-methyl-styrene, p-methylstyrene, o-methylstyrene, m-methylstyrene and p-methylstyrene, and a nucleus halogenized styrene such as o-chlorostyrene, m-chlorostyrene, p-chlorostyrene, p-bromostyrene, dichlorostyrene, dibromostyrene, trichlorostyrene and tribromostyrene. Among them, styrene and α-methylstyrene are preferable.

The resin to be used in the invention is synthesized by homo- or co-polymerization of such the monomers. Examples of the rein include a copolymer resin of benzyl methacrylate/ethyl acrylate or benzyl methacrylate/butyl acrylate, a copolymer resin of methyl methacrylate/2-ethylhexyl methacrylate, a copolymer of methyl methacrylate/methacrylic acid/stearyl methacrylate/acetoacetoxyethyl methacrylate, a copolymer of styrene/acetoacetoxy ethyl methacrylate/stearyl methacrylate, a copolymer of styrene/2-hydroxyethyl methacrylate/stearyl methacrylate and a copolymer resin of 2-ethylhexyl methacrylate/2-hydroxyethyl methacrylate.

The resin to be used in the invention preferably has a number average molecular weight of from 500 to 100,000, and particularly preferably from 1,000 to 30,000 from the viewpoint of the durability and fine particle forming ability.

(Resin for Shell)

In the invention, the resin for covering the outer surface of the colored microscopic particle to form the shell is not specifically limited and, for example, a poly(meth)acrylate type resin, a polyester type resin, a polyamide type resin, a polyimide type resin, a polystyrene type resin, a polyepoxy type resin, a polyester type resin, an amino type resin, a fluororesin, a phenol type resin, a polyurethane type resin, a polyethylene type resin, a poly(vinyl chloride) type resin, a poly(vinyl alcohol type resin, a polyallylate type resin, a polyether type resin, a polyether type resin, a poly(ether ketone) type resin, a poly(phenylene sulfide) type resin, a polycarbonate type resin and an aramid type resin are usable. The poly(meth)acrylate type resin is particularly preferable from the viewpoint of the combination with the toner binder or the thermoplastic resin.

The poly(meth)acrylate type resin can be synthesized by homo- or co-polymerization of various (meth)acrylate type monomers, and desired (meth)acrylate type resin can be obtained by varying the kind and the composition ratio of the monomers. Furthermore, the poly(meth)acrylate polymer can be used by mixing with plural kinds of another resin.

The following monomers can be cited as the monomer for forming the poly(meth)acrylate to be used in the invention, for example; (methacrylic acid, methyl(meth)acrylate, ethyl (meth)acrylate, propyl(meth)acrylate, butyl(meth)acrylate, isopropyl(meth)acrylate, isobutyl(meth)acrylate, t-butyl (meth)acrylate, stearyl(meth)acrylate, 2-hydroxyethyl(meth) acrylate, acetoacetoxyethyl(meth)acrylate, dimethylaminoethyl(meth)acrylate, 2-hydroxypropyl(meth)acrylate, di(ethylene glycol)ethyl ether(meth)acrylate, ethylene glycol methyl ether(meth)acrylate, isobonyl(meth)acrylate, chloroethyltrimethyl ammonium(meth)acrylate, trifluoroethyl (meth)acrylate, octafluoropentyl(meth)acrylate, 2-acetoamidemethyl(meth)acrylate, 2-methoxyethyl(meth)acrylate, 2-dimethylaminoethyl(meth)acrylate, 3-trimethoxysilane (meth)acrylate, benzyl(meth)acrylate, tridecyl(meth)acrylate, 4-hydroxybutyl(meth)acrylate, tetrahydrofrufuryl (meth)acrylate, dodecyl(meth)acrylate, octadecyl(meth) acrylate, 2-diethylaminoethyl(meth)acrylate, 2-ethylhexyl (meth)acrylate, cyclohexyl(meth)acrylate, phenyl(meth) acrylate and glycidyl(meth)acrylate; and (meth)acrylic acid, methyl(meth)acrylate, ethyl(meth)acrylate, propyl(meth) acrylate, butyl(meth)acrylate, stearyl(meth)acrylate, 2-hydroxyethyl(meth)acrylate, cactoacetoxyethyl(meth)acrylate, benzyl(meth)acrylate, tridecyl(meth)acrylate, dodecyl(meth) acrylate and 2-ethylhexyl(meth)acrylate are preferable. Methyl(meth)acrylate, ethyl(meth)acrylate, propyl(meth) acrylate, and butyl(meth)acrylate are more preferable.

The shell resin may be a copolymer with a reactive emulsifying agent.

(Reactive Emulsifying Agent)

Both of an anionic type and a nonionic type reactive emulsifying agent may be preferably used in the invention, and a compound having one of the following substituents A, B and C.

A: A substituent of linear chain alkyl group, branched chain alkyl group or a substituted or unsubstituted aromatic group each having 6 or more carbon atoms B: An anionic or nonionic substituent each displaying a surface activity C: A radical polymerizable group The linear alkyl group described in the above Item A is, for example, a heptyl group, an octyl group, a nonyl group, a decyl group and dodecyl group and as the branched-chain alkyl group, a 2-ethylhexyl group can be cited. The aromatic group is, for example, a phenyl group, a nonylphenyl group and a naphthyl group.

As the nonionic or anionic substituent displaying the emulsifying ability (surface activity), poly(ethylene oxide), poly (propylene oxide) and a copolymer of them such as poly (alkylene oxide) can be exemplified. Examples of the anionic substituent include a carboxylic acid, phosphoric acid, sulfonic acid and their salts. The alkylene oxide having such the anionic substituent at the terminal thereof is also a concrete example of the anionic group. The substituent described in the above Item B is preferably the anionic group and more preferably one forming a salt at the terminal thereof.

The radical polymerizable group described in the above Item C is a group capable of occurring polymerization and crosslinking reaction by a radical reactive species. A vinyl group, an allyl group, a 1-propenyl group, an isopropenyl group, an acryl group, a methacryl group, a maleimido group, an acrylamido group and a styryl group each having an ethylenic unsaturated bond are exemplified.

A compound represented by the following Formula (A), B or C is preferable as the reactive emulsifying agent.

Formula (A)

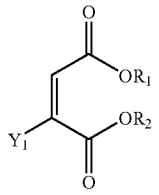

In the above Formula (A), $R_1$ is a linear alkyl group having 6 to 20 carbon atoms, a branched-chain alkyl group or a unsubstituted aromatic group, for example, a heptyl group, an octyl group, a nonyl group, a decyl group and dodecyl group, a branched chain alkyl group such as a 2-ethylhexyl group, and the n aromatic group such as a phenyl group, a nonylphenyl group and a naphthyl group described in above Formula (A).

$R_2$ is a substituent having the radical polymerizable such as the acryl group, methacryl group and maleimido group as the group having ethylenic unsaturated bond described in the above Item C. $Y_1$ is a sulfonic acid, carboxylic acid and a salt thereof.

The compounds represented by Formula (A) can be synthesized by skilled one according to a known method and are easily available on the market. Latemul S-120, Latemul S-120A, Latemul S-180 and Latemul S-180A, each manufactured by Kao Co., Ltd., and Eleminol JS-2, manufactured by Sanyo Kasei Kogyo Co., Ltd., are exemplified.

Formula (B)

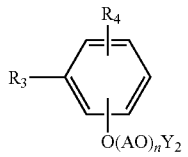

In above Formula (B), $R_3$ and $R_4$ are each the same as $R_1$ and $R_2$ in Formula (A), respectively. $Y_2$ is a hydrogen atom, a sulfonic acid, a carboxylic acid or a salt thereof. AO is an alkylene oxide.

The compounds represented by Formula (B) can be synthesized by skilled one according to a known method and easily available on the market. NE series of Adeka Reasoap NE-10, Adeka Reasoap NE-20, Adeka Reasoap NE-30, and SE series of Adeka Reasoap SE-10N, Adeka Reasoap NE-20N and Adeka Reasoap NE-20N, each manufactured by Asahi Denka Co., Ltd., RN series of Aqualon RN-10, Aqualon RN-20, Aqualon RN-30 and Aqualon RN-50, HS series of Aqualon HS-10, Aqualon HS-20 and Aqualon HS-30 and Aqualon BC series, each manufactured by Dai-ichi Seiyaku Kogyo Co., Ltd., can be exemplified.

Formula (C)

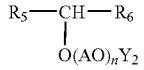

$R_5$, $R_6$ and $Y_3$ in Formula (C) are each the same as $R_1$, $R_2$ and $Y_1$ in Formula (A), respectively, and AO in Formula (C) is the same as AO in Formula (B).

The compounds represented by Formula (C) can be synthesized by skilled one according to a known method and are easily available on the market. Aqualon HK-05, Aqualon HK-10 and Aqualon HK-20, manufactured by Dai-ichi Kogyo Seiyaku Co., Ltd., can be exemplified.

In Formulas (B) and (C), the average polymerization degree of the alkylene oxide chain (AO) is preferably from 1 to 10. As examples of such the compound, Aqualon KH-05, Aqualon KH-10, Aqualon HS-05 and Aqualon HS-10 can be cited.

In the invention, the reactive emulsifying agent is preferably the anionic compound. As examples of such the emulsifying agent, the series of Adeka Reasoap SE of Asahi Denka Kogyo Co., Ltd., Aqualon HS series of Dai-ichi Kogyo Seiyaky Co., Ltd., Latemul S series of Kao Co., Ltd., and Eleminol JS series of Sanyo Kasei Kogyo Co., Ltd., can be cited.

The using amount of the reactive emulsifying agent is usually from 0.8 to 80, preferably from 1 to 70, and more preferably from 10 to 60, parts by weight to 100 parts by weight of the resin forming the colored microscopic particle of the invention.

(Surfactant)

On the occasion of the emulsification of the colored microscopic particles to be used in the invention, usual anionic type emulsifying agent (surfactant) and/or a nonionic emulsifying agent (surfactant) may be used according to necessity.

Examples of the usual nonionic emulsifying agent include a polyoxyethylene alkyl ether such as polyoxyethylene lauryl ether and polyoxyethylene stearyl ether; a polyoxyethylene alkylphenyl ether such as polyoxyethylene nonylphenyl ether; a sorbitan higher fatty acid ester such as sorbitan monolaurate, sorbitan monostearate and sorbitan trioleate; a polyoxyethylene sorbitan higher fatty acid such as polyoxyethylene sorbitane monolaurate and polyoxyethylene sorbitan monostearate; a polyoxyethylene higher fatty acid ester such as polyoxyethylene monolaurate and polyoxyethylene monostearate; a glycerol higher fatty acid ester such as oleic monoglyceride and stearic monoglyceride; and a polyoxyethylene-polyoxypropylene block copolymer.

Examples of the usual anionic emulsifying agent include a higher fatty acid salt such as sodium oleate; an alkylarylsulfonate such as sodium dodecylbenzenesulfonic acid; an alkylsulfate such as sodium laurylsulfate; a polyoxyethylene alkyl ether sulfate such as sodium polyetoxyethylene laurylsulfate; a polyoxyethylene alkylaryl ether sulfate such as sodium polyoxyethylene nonylphenylsulfate; an alkylsulfosuccinate such as sodium monooctylsulfosuccinate, sodium dioctylsulfosuccinate and sodium polyoxyethylene lurylsulfosuccinate; and derivatives thereof.

(Oil-Soluble Dye)

The oil-soluble dye contained in the colored microscopic particle to be used in the invention is described blow.

The oil-soluble dye to be used in this invention is an oil-soluble dye capable of chelating, and may be used singly or in combination with other oil-soluble dyes. As an oil-soluble dye, a usually known as an oil-soluble dye can be used. The oil-soluble dye is usually a dye which has no dissolving group such as a carboxylic acid group and a sulfonic acid group, and is soluble in an organic solvent and insoluble in water, and the dye also includes an oil-soluble dye which is originally a water-soluble dye and is made oil-soluble by making a salt with a long-chain base. For example, a salt of an acidic dye, a direct dye or a reactive dye with a long-chain amine are known. Examples of the oil-soluble dye include Valifast Yellow 4120, Valifast Yellow 3150, Valifast Yellow 3108, Valifast Yellow 2310N, Valifast Yellow 1101, Valifast Red 3320, Valifast Red 3304, Valifast Red 1306, Valifast Blue 2610, Valifast Blue 2606, Valifast Blue 1630, Oil Yellow GG-S, Oil Yellow 3G, Oil Yellow 129, Oil Yellow 107, Oil Yellow 105, Oil Scarlet 308, Oil Red RR, Oil Red OG, Oil Red 5B, Oil Pink 312, Oil Blue BOS, Oil Blue 613, Oil Blue 2N, Oil Black BY, Oil Black BS, Oil Black 860, Oil Black 5970, Oil Black 5906 and Oil Black 5905, each manufactured by Orient Kagaku Kogyo Co., Ltd., Kayaset Yellow SF-G, Kayaset Yellow K-CL, Kayaset Yellow GN, Kayaset Yellow A-G, Kayaset Yellow 2G, Kayaset Red SF-4G, Kayaset Red K-BL, Kayaset Red A-BR, Kayaset Magenta 312 and Kayaset Blue K-FL, each manufactured by Nihon Kayaku Co., Ltd., FS Yellow 1015, FS Magenta 1404, FS Cyan 1522 and FS Blue 1504, C.I. Solvent Yellow 88, 83, 82, 79,56, 29, 19, 16, 14, 04, 03, 02 and 01, C.I. Solvent Red 84:1, C.I. Solvent Red 84, 218, 132, 73, 72, 51, 43, 27, 24,18 and 01, C.I. Solvent Blue 70, 67, 44, 40, 35, 11, 02 and 01, C.I. Solvent Black 43, 70, 34, 29, 27, 7 and 3, C.I. Solvent Violet 3, C.I. Solvent Green 3 and 7, Plast Yellow DY352 and Plast Red 8375 each manufactured by Arimoto Kagaku Kogyo Co., Ltd., MS Yellow HD-180, MS Red G, MS Magenta HM-1450H and MS Blue HM-1384, each manufactured by Mitsui Kagaku Co., Ltd., ES Red 3001, ES Red 3002, ES 3003, TS Red 305, ES Yellow 1001, ES Yellow 1002, TS Yellow 118, ES Orange 2001, ES Blue 6001 and TS Turq Blue 618, each manufactured by Sumitomo Kagaku Co., Ltd., and Macrolex Yellow 6G, Ceres Blue, Gnneopan Yellow O75, Ceres Blue GN and Macrolex Red Violet R, each manufactured by Bayer Co., Ltd., although the oil-soluble dye is not limited to the above-mentioned.

A dispersion dye can be used as the oil-soluble dye. Examples of the dispersion dye include C.I. Disperse Yellow 5, 42, 54, 64, 79, 82, 83, 93, 99, 100, 119, 122, 124, 160, 184:1, 186, 198, 199, 204, 224 and 237, C.I. Disperse Orange 13, 29, 31:1, 33, 49, 54, 55, 66, 73, 118, 119 and 163, C.I. Disperse Red 54, 60, 72, 73, 86, 88, 91, 92, 93, 111, 126, 127, 134, 135, 143, 152, 153, 154, 159, 164, 167:1, 177, 181, 204, 206, 207, 221, 239, 240, 258, 277, 278, 311, 323, 343, 348, 356 and 362, C.I. Disperse Violet 33, C.I. Disperse Blue 56, 60, 73, 87, 113, 128, 143, 148, 154, 158, 165, 165:1, 165:2, 178, 183, 185, 197, 198, 201, 214, 224, 225, 257, 266, 267, 287, 354, 358, 365 and 368, and C.I. Disperse Green 6:1 and 9, though the oil-soluble dye is not limited to the above-mentioned.

Moreover, a coupler such as a cyclic methylene compound such as phenol and pyrazolotriazole and an open-ring methylene compound, a p-diaminopyridine compound, an azomethine dye and an indoaniline dye are also preferably used.

(Volume Average Particle Diameter of Colored Microscopic Particles)

The volume average diameter of the colored microscopic particles of this invention is preferably from 10 nm to 1 μm and more preferably from 10-100 nm.

When the volume average diameter of the colored particle is within the above range, the surface area per unit volume of the particles is suitable for easily enclosing the oil-soluble dye into the polymer of the colored microscopic particle so that the stability of the colored microscopic particle is suitable and the particle is not precipitated on the occasion of production of the colored microscopic particle and the suitability of production is high. Moreover, the glossiness is not degraded and the transparency can be held when such the colored microscopic particles are used in the toner.

The volume average particle diameter can be measured by a dynamic light scattering method, a laser diffraction method, a centrifugal method, an FFF method and an electric detector method. In the invention, the volume average particle diameter is measured by the dynamic light scattering method using Zetasizer manufactured by Malvern Co., Ltd.

(Content of Oil-Soluble Dye)

The content of the oil-soluble oil-soluble dye in the colored microscopic particle of the invention is preferably from 10 to 70% by weight. Sufficient density and protection ability of the resin for the colorant can be obtained by such the content of the oil-soluble oil-soluble dye, and the colored microscopic particle is superior in the stability during the storage so as to be able to prevent increasing in the particle diameter.

(Metal Compound)

Metal compounds can be used in the invention as long as the compound can form a complex, and inorganic or organic salts and complexes of metal are usable. Among them the organic metal salts and complexes are preferable.

As the metal, mono- and multi-valent metals included in Groups I to VIII of the periodic table are usable, among them Al, Co, Cr, Cu, Fe, Mg, Mn, Mo, Ni, Sn, Ti and Zn are preferable and Ni, Cu, Cr, Co and Zn are particularly preferable. Concrete examples are salts of $Ni^{2+}$, $Cu^{2+}$, $Cr^{2+}$, $Co^{2+}$ or $Zn^{2+}$ of an aliphatic acid such as acetic acid and stearic acid or an aromatic carboxylic acid such as benzoic acid and salicylic acid. Other than those, metal complexes having a ligand represented by $X_1$ or $X_2$ in Formula (2) are also usable.

Concrete examples of the metal compounds other than the copper compounds represented by Formula (2) are listed in Table 2, but the compounds are not limited to them.

TABLE 2

| Compound | M | X1 | m | X2 | n | W1 | s |
|---|---|---|---|---|---|---|---|
| C-36 | $Ni^{2+}$ | X-4 | 2 | — | 0 | — | 0 |
| C-37 | $Ni^{2+}$ | X-6 | 2 | — | 0 | — | 0 |
| C-38 | $Ni^{2+}$ | X-17 | 2 | — | 0 | — | 0 |
| C-39 | $Ni^{2+}$ | X-54 | 2 | — | 0 | — | 0 |
| C-40 | $Ni^{2+}$ | X-62 | 2 | — | 0 | — | 0 |
| C-41 | $Ni^{2+}$ | X-67 | 2 | — | 0 | — | 0 |
| C-42 | $Ni^{2+}$ | X-74 | 2 | — | 0 | — | 0 |
| C-43 | $Ni^{2+}$ | X-84 | 2 | — | 0 | — | 0 |
| C-44 | $Ni^{2+}$ | X-87 | 2 | — | 0 | — | 0 |
| C-45 | $Ni^{2+}$ | X-90 | 2 | — | 0 | — | 0 |
| C-46 | $Ni^{2+}$ | X-92 | 2 | — | 0 | — | 0 |
| C-47 | $Ni^{2+}$ | X-96 | 2 | — | 0 | — | 0 |
| C-48 | $Ni^{2+}$ | X-99 | 2 | — | 0 | — | 0 |
| C-49 | $Ni^{2+}$ | X-102 | 2 | — | 0 | — | 0 |
| C-50 | $Ni^{2+}$ | X-107 | 2 | — | 0 | — | 0 |
| C-51 | $Ni^{2+}$ | X-109 | 2 | — | 0 | — | 0 |
| C-52 | $Ni^{2+}$ | X-127 | 2 | — | 0 | — | 0 |
| C-53 | $Ni^{2+}$ | X-119 | 2 | — | 0 | — | 0 |
| C-54 | $Ni^{2+}$ | X-126 | 2 | — | 0 | — | 0 |
| C-55 | $Ni^{2+}$ | X-129 | 2 | — | 0 | — | 0 |
| C-56 | $Co^{2+}$ | X-4 | 2 | — | 0 | — | 0 |
| C-57 | $Co^{2+}$ | X-6 | 2 | — | 0 | — | 0 |
| C-58 | $Co^{2+}$ | X-63 | 2 | — | 0 | — | 0 |
| C-59 | $Co^{2+}$ | X-74 | 2 | — | 0 | — | 0 |
| C-60 | $Co^{2+}$ | X-84 | 2 | — | 0 | — | 0 |
| C-61 | $Co^{2+}$ | X-92 | 2 | — | 0 | — | 0 |
| C-62 | $Co^{2+}$ | X-100 | 2 | — | 0 | — | 0 |
| C-63 | $Co^{2+}$ | X-101 | 2 | — | 0 | — | 0 |
| C-64 | $Co^{2+}$ | X-106 | 2 | — | 0 | — | 0 |
| C-65 | $Co^{2+}$ | X-128 | 2 | — | 0 | — | 0 |
| C-66 | $Zn^{2+}$ | X-4 | 2 | — | 0 | — | 0 |
| C-67 | $Zn^{2+}$ | X-6 | 2 | — | 0 | — | 0 |
| C-68 | $Zn^{2+}$ | X-78 | 2 | — | 0 | — | 0 |
| C-69 | $Zn^{2+}$ | X-82 | 2 | — | 0 | — | 0 |
| C-70 | $Zn^{2+}$ | X-92 | 2 | — | 0 | — | 0 |
| C-71 | $Zn^{2+}$ | X-117 | 2 | — | 0 | — | 0 |
| C-72 | $Zn^{2+}$ | X-120 | 2 | — | 0 | — | 0 |
| C-73 | $Zn^{2+}$ | X-127 | 2 | — | 0 | — | 0 |
| C-74 | $Zn^{2+}$ | X-130 | 2 | — | 0 | — | 0 |
| C-75 | $Zn^{2+}$ | X-134 | 2 | — | 0 | — | 0 |
| C-78 | $Co^{2+}$ | X-127 | 2 | X-4 | 2 | X-85 | 2 |
| C-79 | $Ni^{2+}$ | X-127 | 2 | X-4 | 2 | X-85 | 2 |
| C-80 | $Zn^{2+}$ | X-127 | 1 | X-4 | 1 | — | 0 |

*: The same one as X1 may be added to X2 as m = 1

(Toner)

In the toner of the invention, a known charge controlling agent and an offset preventing agent may be added additionally to the above thermoplastic resin and the colored microscopic particles.

The charge controlling agent is not specifically limited. Colorless or light colored charge controlling agents are usable for the color toner, which do not give any bad influence to the color and light permeation ability of the toner. Complexes of zinc or chromium of salicylic acid derivatives, calixarene type compounds, organic boron compounds and fluorine-containing quaternary ammonium salt type compounds are suitably used. For example, the salicylic acid metal complex described in JP-A Nos. 53-127726 and 145255, the calixarene compounds described in JP-A 2-201378, and the organic boron compounds described in JP-A 221967 described in JP-A 3-1162 are usable. When such the charge controlling agent is used, the using amount is desirably from 0.1 to 10, and preferably from 0.5 to 5.0, parts by weight to 100 parts by weight.

The offset preventing agent is not specifically limited. For example, polyethylene wax, oxide type polyethylene wax, polypropylene wax, oxide type polyethylene wax, carnauba wax, sasol wax, rice wax, candelilla wax, jojoba oil wax and beeswax are usable. The using amount of such the waxes is desirably from 0.5 to 5, and preferably from 1 to 3, parts by weight to 100 parts by weight. When the adding amount is less than 0.5 parts by weight, the effect becomes insufficient and when the amount is more than 5 parts by weight, the light permeability and the color reproducibility are lowered.

The toner of the invention can be produced by known methods such as a kneading-crashing method, a suspension polymerization method, an emulsion polymerization method, an emulsifying dispersion granulation method and a capsule method using the thermoplastic resin (binder resin), colored microscopic particle, and another desired additive. Among these production methods, the emulsion polymerization method is preferred from the viewpoint of the cost and stability of the production when the miniaturization of the toner particle accompanied with the raising in the quality of the image is considered.

In the emulsion polymerization, the emulsion of thermoplastic resin produced by the emulsion polymerization is mixed with the dispersion of the other toner ingredients such as the colored microscopic particles and they are gradually coagulated while balancing the repulsion force between the surface of the particles caused by pH control and the coagulation force caused by the addition of an electrolyte for progressing the particle association while controlling the fusion between the fine particles and the shape of thereof by simultaneously heating and stirring to produce the toner. The volume average particle diameter of the toner relating to the invention is preferably adjusted into the range of from 4 to 10 μm, and more preferably from 6 to 9 μm form the viewpoint of high precision reproduction.

In the toner of the invention, a post-treating agent may be added without any limitation for improving the fluidity and the cleaning suitability. As such the post-treating agent, for example, an inorganic fine particle such as silica fine, alumina fine particle and titania particle, an inorganic stearate such as aluminum stearate fine particle, zinc stearate fine particle, an inorganic titanate such as strontium titanate and zinc titanate are usable. They can be used singly or in combination. These fine particles is preferably treated on the surface by a silane coupling agent, a higher fatty acid or a silicone oil for improving the stability as to environmental conditions and the storage ability at high temperature. The adding amount of the surface treating agent is preferably from 0.05 to 5, and more preferably from 0.1 to 3, parts by weight to 100 parts by weight of the toner.

The toner of the invention can be used either for a double-component developer composed of the toner and the carrier or for a single-component developer.

As the carrier to be used together with the toner of the invention, usually known carrier for the double-component developer, for example, a carrier composed of a magnetic particle such as iron and ferrite, a resin coated carrier composed of such the magnetic particle coated by a resin or a binder type carrier composed the magnetic fine particle dispersed in a binder resin, are usable. Among these carriers, the resin coated carrier suing a silicone type resin, a copolymer (graft polymer) resin of an organopolysiloxane and a vinyl type monomer or a polyester type resin is preferable from the viewpoint of the toner spend, and a carrier coated by a resin obtained by reacting isocyanate with the copolymer of the organosiloxane and the vinyl type monomer is particularly preferable from the viewpoint of the durability, stability as to environmental conditions and toner spend inhibiting ability. The use of a monomer having a substituted reactive with the isocyanate such as a hydroxyl group is necessary for the above vinyl type monomer. The use of the carrier having a volume average particle diameter of from 20 to 100 μm, and preferably from 20 to 60 μm, is preferred for holding high image quality and preventing fogging by carrier.

(Image Forming Method)

The image forming method using the toner of the invention will be described below.

In the invention, the method for forming the image is not specifically limited. For example, a method in which plural images are-formed on a photoreceptor and transferred at once, and a method in which the images formed on the photoreceptor are successively transferred are applicable without any limitation, and the former method is preferable.

In such the method, the photoreceptor is uniformly charged and exposed to light corresponding to the first image, and then the photoreceptor is subjected to the first development to form the first toner image. After that, the photoreceptor carrying the first toner image is uniformly charged and exposed to light corresponding to the second image, and then the photoreceptor is subjected to the second development to form the second toner image on the photoreceptor. Moreover, the photoreceptor carrying the first and second toner images is uniformly charged and exposed to light corresponding to the third image, and then the photoreceptor is subjected to the third development to form the third toner image on the photoreceptor. Further, the photoreceptor carrying the first, second and third toner images is uniformly charged and exposed to light corresponding to the fourth image, and then the photoreceptor is subjected to the fourth development to form the fourth toner image on the photoreceptor.

For example, a full color image is formed on the photoreceptor by developing by using yellow, magenta, cyan and black toners for the first, second, third and fourth developments, respectively. After that, the images formed on the photoreceptor is transferred at once and fixed onto an image support to form a fixed image.

In this method, the images formed on the photoreceptor is transferred at once onto the support such as paper to obtain the image. Therefore, the image quality can be raised by this method since the transferring process, which is a factor of causing the deterioration of image quality, is only one time in this method different from the method so called intermediate transfer method.

The method for development is preferably a non-contact developing method because plural times of development are necessary.

The method with application of an alternative electric field on the occasion of the development is also preferable.

The volume average particle diameter of the carrier capable of using in the double-component developer is preferably from 15 to 100 μm, and more preferably from 25 to 60 μm. The volume average particle diameter can be measured typically by a laser diffraction particle size distribution measuring apparatus HELOS having a wet type dispersing instrument, manufactured by Sympatec Co., Ltd.

The carrier is preferably a carrier coated with a resin or a resin dispersion type carrier composed of magnetic particle dispersed in a resin. As the resin composition for the coating, for example, an olefin type resin, a styrene/acryl type resin, a silicone type resin, an ester type resin and fluorine-containing polymer type resin are used though the composition is not specifically limited. As the resin for constituting the resin dispersion type carrier, known ones are usable without any limitation and, for example, a styrene/acryl resin, a polyester resin, a fluororesin and a phenol resin are usable.

A so-called contact heating method is preferable for the fixing method for the invention. Particularly, a heat-roller fixing method and a press-contacting-heat fixing method in which the fixation is carried out by a rotatable pressing member including a fixed heater, are applicable.

(Image)

In the image formation by developing, transferring and fixating using the toner of the invention, the toner transferred on the transferring material adheres after the fixation in a sated of that the colored particles are dispersed without breaking down in the toner particle.

In this invention, the colored microscopic particles are dispersed in the toner particle so that the oil-soluble dye is not released and transferred from the surface of the toner particle even though the toner particle contains the oil-soluble dye in high concentration. Consequently, the following problems of the usual toner particle in which the oil-soluble dye is directly dispersed or dissolved in the thermoplastic resin (being a binder resin) and exposed on the toner particle surface can be solved:

1. a charging amount is low;

2. the difference between the charging amount under high temperature high moisture condition and that under low temperature low moisture condition (being an environmental dependency) is large; and 3. when plural kinds of pigments such as cyan, magenta, yellow and black for full color image recording are employed, the charging amount of each toner varies from each other.

Moreover, problems of sublimation of the oil-soluble dye and contamination of oil caused by the use of usual toner using the oil-soluble dye do not occur on the occasion of fixing because the oil-soluble dye as the colorant is not transferred out from or not exposed on the toner particle surface.

EXAMPLE

This invention is described in detail below referring to examples, and this invention is not limited by the examples.

<<Preparation of Toner Particle 1>>

Toner particles exhibiting median diameter $D_{50}$ of 8.5 μm with a volume standard were obtained by mixing, kneading, crushing and classifying 100 g of polyester resin, 2 g of oil-soluble dye (being A-1), and 3 g of polypropylene. This preparation was designated as Toner Particle 1.

A-1

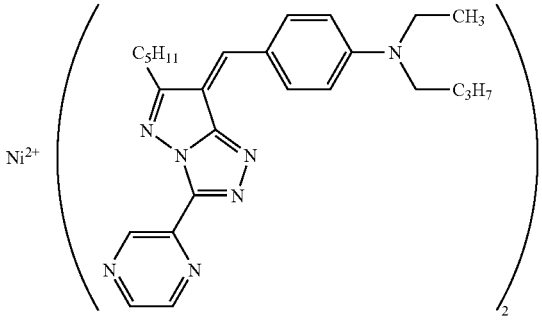

-continued

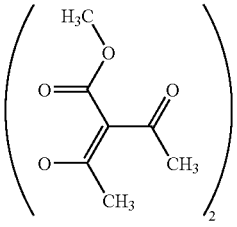

<<Preparation of Toner Particle 2>>

(Preparation of Oil-soluble Dye Dispersion 2)

Into a separable flask, 16.0 g of an oil-soluble dye (being A-1) and 200.0 g of ethyl acetate were charged, and stirred to completely dissolve the oil-soluble dye after replacing ambient air in the flask with nitrogen gas. After that, the above aqueous solution was dripped into 360 g of the aqueous solution containing 19.6 g of a surfactant, namely EM-27C (at a solid content of 27 weight %, manufactured by Kao Corp.) while stirring, and then emulsified over 300 seconds with an ultrasonic dispersing machine, namely UH-600 (manufactured by SMT Co., Ltd.). This dispersion was designated as Oil-soluble Dye Dispersion 2.

(Preparation of Colored Microscopic Particle 2)

Thereafter, ethyl acetate was removed from Oil-soluble Dye Dispersion 2 under vacuum to obtain a dispersion of the colored microscopic particles. The average particle diameter of the thus obtained colored microscopic particles in the dispersion was 46 nm. This dispersion was designated as Colored Microscopic Particle 2.

(Preparation of Toner Particle 2)

[Preparation of Thermoplastic Resin (Latex)]

Into a 5,000 ml separable flask to which a stirrer, thermal sensor, cooling tube and nitrogen gas introducing device were attached, a previously prepared surfactant solution composed of 2,760 g of deionized water and an anionic surfactant [sodium dodecylbenzenesulfonate (SDS)] was charged and the interior temperature was raised to 80° C. by heating while stirring at a stirring rate of 230 rpm under nitrogen gas stream. On the other hand, 72.0 g of a parting agent represented by following Formula (a) was added to a monomer mixture composed of 115.1 g of styrene, 42.0 g of n-butyl acrylate and 10.9 g of methacrylic acid and dissolved by heating at 80° C. to prepare a monomer solution. The 80° C. monomer solution was mixed and dispersed in the surfactant solution (also at 80° C.) by a mechanical dispersing machine having a recirculation method to prepare an emulsion of oil droplets of uniform particle diameter. To the resultant dispersion, a polymerization initiator solution, composed of 200 ml of deionized water and 0.84 g of a polymerization initiator of potassium persulfate (being KPS) dissolved therein, was added and the system was heated to 80° C. and stirred for 3 hours to carry out polymerization (being first-step polymerization) to prepare a latex. After that, a polymerization initiator solution composed of 240 ml of deionized water and 7.73 g of KPS dissolved therein was added. After 15 minutes, a monomer mixture composed of 383.6 g of styrene, 140.0 g of n-butyl acrylate, 36.4 g of methacrylic acid and 13.7 g of tert-dodecylmercaptane was pripped over 126 minutes at 80° C. After completion of dripping, polymerization (being second-step polymerization) was carried out by heating and stirring for 60 minutes and then cooled to 40° C. to prepare the latex, which was designated as Latex 2.

Formula (a)

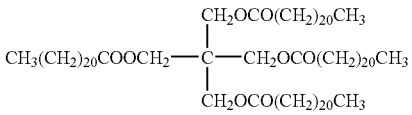

Into a 5 liter four-mouth flask to which a thermal sensor, a cooling pipe, a nitrogen gas introducing device and a stirrer were attached, 1,250 g of Latex 2 obtained in the above preparation example of the thermoplastic resin (latex), 2,000 g of deionized water, and the-above obtained Colored Microscopic Particle Dispersion 1 were charged and stirred. The interior temperature was adjusted to 30° C. and then a 5N-solution of sodium hydroxide was added to adjust the pH of the mixture to 10.0. After that, a solution composed of 72 ml of deionized water and 52.6 g of magnesium chloride hexahydrate dissolved therein was added to the above resultant liquid over 10 minutes at 30° C. After allowed to stand for 3 minutes, the system was heated by 90° C. over 6 minutes at a temperature rising rate of 10° C./minute. The diameter of the associated particle from such a situation was measured via Coulter Counter TA-II and the growth of the particles was stopped at the time when the volume average particle size reaches 6.5 μm by adding a solution composed of 700 g of deionized water and 115 g of sodium chloride dissolved therein, and the fusion of the particles was further continued for 6 hours at a liquid temperature of 90±2° C. while heating and stirring. After that, the liquid was cooled at 30° C. at a rate of 6° C./minute. The associated particles were separated by filtration from the thus prepared dispersion of associated particle and re-dispersed in deionized water (at a pH of 3) at a factor of 10 times by weight as a washing treatment and then separated from the washing water. After twice repeating that washing treatment, the associated particles were further washed only in deionized water and dried by a warm air flow of 40° C. to obtain the targeted toner particles. The toner particles thus obtained were designated as Toner Particle 2.

<<Preparation of Toner Particle 3>>

Toner particles were prepared in the same manner as Toner Particle 2, except that Oil-soluble Dye (A-1) was replaced by Oil-soluble Dye (A-2). The toner particles thus obtained were designated as Toner Particle 3.

A-2

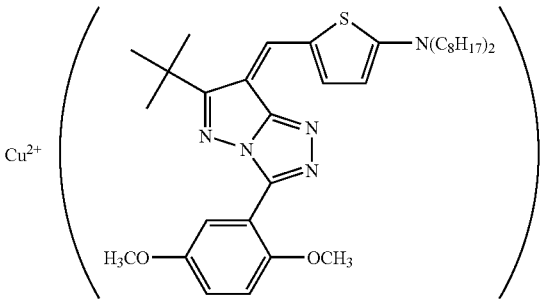

-continued

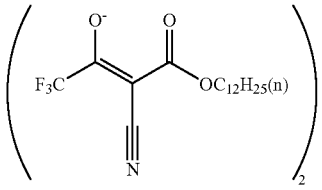

<<Preparation of Toner Particle 4>>

(Preparation of Oil-soluble Dye Dispersion 4)

Into a separable flask, 16.0 g of an oil-soluble dye (being L-1) and 200.0 g of ethyl acetate were charged and stirred to completely dissolve the oil-soluble dye after replacing ambient air in the flask with nitrogen gas. After that, the above aqueous solution was dripped into 340.0 g of the aqueous solution containing 19.6 g of a surfactant of EM-27C of 27% solution (manufactured by Kao Corp.), while stirring, and then emulsified over 300 seconds with an ultrasonic dispersing machine, namely UH-600 (manufactured by SMT Co., Ltd.). This dispersion was designated as Oil-soluble Dye Dispersion 4.

(Preparation of Colored Microscopic Particle 4)

Thereafter, ethyl acetate was removed from Oil-soluble Dye Dispersion 2 under vacuum to obtain a dispersion of the colored microscopic particles. The average particle diameter of the thus obtained colored microscopic particles in the dispersion was 34 nm. This dispersion was designated as Colored Microscopic Particle 4.

(Preparation of Toner Particle 4)

The toner particles were prepared in the same manner as Toner Particle 2, except that Colored Microscopic Particle 2 was replaced by Colored Microscopic Particle 4. The toner particles thus obtained were designated as Toner Particle 4.

<<Preparation of Toner Particle 5>>

The toner particles were prepared in the same manner as Toner Particle 4, except that the surfactant of EM-27C (having a solid content of 27 weight %, and manufactured by Kao Corp.) was changed from 19.6 g to 3.9 g. The toner particles thus obtained were designated as Toner Particle 5.

<<Preparation of Toner Particles 6-41>>

The toner particles were prepared in the same manner as Toner Particle 4, except that Oil-soluble Dye (L-1) and Metal Compound (C-17) were replaced with those as described in Table 3. The toner particles thus obtained were designated as Toner Particles 6-41.

<<Preparation of Toner Particle 42>>

(Preparation of Oil-soluble Dye Dispersion 42)

Into a separable flask, 9.62 g of Metal Compound (C-17) and 123.5 g of ethyl acetate, in addition to 13.5 g of Resin (P-1) having the following compositions and 9.46 g of L-4 were charged and stirred to completely dissolve the above oil-soluble dye after replacing ambient air in the flask with nitrogen gas.

After that, 238 g of an aqueous solution containing 8.0 g of Aqualon KH-05, manufactured by Dai-ichi Kogyo Seiyaku Co., Ltd., was dripped into the above resultant solution and stirred and then emulsified over 300 seconds using Clearmix W-motion CLM-0.8, manufactured by M-Technique Co., Ltd. This dispersion was designated as Oil-soluble Dye Dispersion 42.

(Colored Microscopic Particle 42)

Thereafter, ethyl acetate was removed from Oil-soluble Dye Dispersion 42 under vacuum to obtain core-type Colored Microscopic Particle Dispersion 42 into which the oil-soluble dye was mixed. The average particle diameter of the thus obtained colored microscopic particle dispersion was 40 nm. The average particle diameter was a volume average particle diameter measured by Zetasizer, manufactured by Malvern Co., Ltd.

Resin (P-1): St/HEMA/SMA=30/40/30

St: Styrene

HEMA: 2-hydroxyethyl methacrylate

SMA: Stearyl methacrylate (Preparation of Toner Particle 42)

The toner particles were prepared in the same manner as Toner Particle 2, except that Colored Microscopic Particle 4 was replaced with Colored Microscopic Particle 42. The toner particles thus obtained were designated as Toner Particle 42.

<<Preparation of Toner Particle 43>>

(Preparation of Colored Microscopic Particle 43)

To the dispersion of core-type Colored Microscopic Particle 42 prepared as above, composed of an oil-soluble dye, 0.5 g of potassium persulfate was further added and heated to 70° C. by a heater, and then the resultant liquid was allowed to react for 5 hours while dripping 10.0 g of methyl methacrylate. Thus core shell type Colored Microscopic Particle 43 was obtained. The average diameter of the colored microscopic particles in the obtained colored microscopic particle dispersion was 46 nm. The average particle diameter was a volume average particle diameter measured by Zetasizer, manufactured by Malvern Co., Ltd.

(Preparation of Toner Particle 43)

The toner particles were prepared in the same manner as Toner Particle 2, except that Colored Microscopic Particle 4 was replaced with Colored Microscopic Particle 43. The toner particles thus obtained were designated as Toner Particle 43.

<<Preparation oh Toner Particle 44>>

(Colored Microscopic Particle 44)

Core/shell-type Colored Microscopic Particle 44 was obtained in the same manner as Colored Microscopic Particle 43, except that Resin (P-1) was replaced with Resin (P-2), and Metal Compound (C-17) was replaced with Metal Compound (C-28).

(Preparation of Toner Particle 44)

Toner particles were prepared in the same manner as Toner Particle 2, except that Colored Microscopic Particle 4 was replaced with Colored Microscopic Particle 44. The toner particles thus obtained were designated as Toner Particle 44.

The materials used to prepare the colored microscopic particles and the average particle diameter of each of the thus obtained colored microscopic particle dispersions are shown in following Table 3.

TABLE 3

| *1 | Resin (Core) | Resin (Shell) | Dye | Metal compound | *2 | Particle diameter | Toner |
|---|---|---|---|---|---|---|---|
| — | — | — | A-1 | — | — | — | 1 |
| 2 | — | — | A-1 | — | — | 46 nm | 2 |
| 3 | — | — | A-2 | — | — | 44 nm | 3 |
| 4 | — | — | L-4 | C-17 | 1 | 34 nm | 4 |

TABLE 3-continued

| *1 | Resin (Core) | Resin (Shell) | Dye | Metal compound | *2 | Particle diameter | Toner |
|---|---|---|---|---|---|---|---|
| 5 | — | — | L-4 | C-17 | 1 | 110 nm | 5 |
| 6 | — | — | L-4 | C-17 | 1.1 | 36 nm | 6 |
| 7 | — | — | L-4 | C-17 | 2 | 40 nm | 7 |
| 8 | — | — | L-4 | C-17 | 2.1 | 57 nm | 8 |
| 9 | — | — | L-4 | C-64 | 1 | 40 nm | 9 |
| 10 | — | — | L-4 | C-52 | 1 | 40 nm | 10 |
| 11 | — | — | L-4 | C-71 | 1 | 38 nm | 11 |
| 12 | — | — | L-4 | C-10 | 1 | 36 nm | 12 |
| 13 | — | — | L-4 | C-4 | 1 | 86 nm | 13 |
| 14 | — | — | L-6 | C-18 | 1 | 46 nm | 14 |
| 15 | — | — | L-12 | C-19 | 1 | 45 nm | 15 |
| 16 | — | — | L-20 | C-23 | 1 | 40 nm | 16 |
| 17 | — | — | L-34 | C-26 | 1 | 52 nm | 17 |
| 18 | — | — | L-38 | C-28 | 1 | 38 nm | 18 |
| 19 | — | — | L-40 | C-30 | 1 | 38 nm | 19 |
| 20 | — | — | L-45 | C-31 | 1 | 40 nm | 20 |
| 21 | — | — | L-54 | C-14 | 1 | 48 nm | 21 |
| 22 | — | — | L-75 | C-17 | 1 | 53 nm | 22 |
| 23 | — | — | L-83 | C-20 | 1 | 53 nm | 23 |
| 24 | — | — | L-92 | C-3 | 1 | 60 nm | 24 |
| 25 | — | — | L-101 | C-28 | 1 | 62 nm | 25 |
| 26 | — | — | L-114 | C-5 | 1 | 38 nm | 26 |
| 27 | — | — | L-126 | C-28 | 1 | 40 nm | 27 |
| 28 | — | — | L-146 | C-23 | 1 | 41 nm | 28 |
| 29 | — | — | L-162 | C-17 | 1 | 50 nm | 29 |
| 30 | — | — | L-188 | C-22 | 1 | 38 nm | 30 |
| 31 | — | — | L-192 | C-28 | 1 | 48 nm | 31 |
| 32 | — | — | L-200 | C-5 | 1 | 64 nm | 32 |
| 33 | — | — | L-207 | C-10 | 1 | 41 nm | 33 |
| 34 | — | — | L-208 | C-1 | 1 | 39 nm | 34 |
| 35 | — | — | L-217 | C-28 | 1 | 38 nm | 35 |
| 36 | — | — | L-219 | C-31 | 1 | 40 nm | 36 |
| 37 | — | — | L-225 | C-7 | 1 | 41 nm | 37 |
| 38 | — | — | L-235 | C-29 | 1 | 48 nm | 38 |
| 39 | — | — | L-248 | C-28 | 1 | 53 nm | 39 |
| 40 | — | — | L-252 | C-31 | 1 | 53 nm | 40 |
| 41 | — | — | L-264 | C-34 | 1 | 63 nm | 41 |
| 42 | P-1 | — | L-4 | C-17 | 1 | 40 nm | 42 |
| 43 | P-1 | MMA | L-4 | C-17 | 1 | 46 nm | 43 |
| 44 | P-2 | MMA | L-4 | C-28 | 1 | 50 nm | 44 |

P-1: St/HEMA/SMA = 30/40/30 P-2: St/HEMA/SMA = 20/40/40

*1: Colored Microscopic Particle No.,

*2: Adding amount (Mole ratio for Dye)

<<Preparation of Toner>>

(Toner Particle: an External Additive Treatment)

To each of Toner Particles 1-44 as prepared above, as an external additive, specifically hydrophobic silica (exhibiting a number average primary particle diameter of 12 nm and a hydrophobicity of 68) was added in an amount of 1% by weight, and also hydrophobic titanium oxide (exhibiting a number average primary particle diameter of 20 nm and hydrophobicity of 63) was added in an amount of 1.2% by weight, after which, the resultant mixture was further mixed using a Henschell Mixer to produce the toners. The thus obtained toners were each designated as Toner 1 through Toner 44, respectively.

Median diameter $D_{50}$, with a volume standard of obtained Toner 1, was 8.5 μm, and median diameters with a volume standard of Toners 2-44 were between 6.5-7.5 μm.

Median diameter $D_{50}$ with a volume standard was measured and calculated using an apparatus which is a Multisizer 3, manufactured by Beckman Coulter, Inc., connected with a computer system for data processing, also manufactured by Beckman Coulter, Inc. The measuring process was: 1) applying 20 ml of a surfactant solution (for the purpose of dispersion of the toner, for example, a surfactant solution of a neutral detergent containing a surfactant component diluted at a factor of 10 with pure water) to 0.02 g of the toner, and 2)

conducting ultrasonic dispersion for one minute, to prepare the targeted toner dispersion. This toner dispersion was poured into a beaker containing ISOTON II (manufactured by Beckman Coulter, Inc.) in the sample stand until the measuring concentration became 8 weight %, and the measuring apparatus count was set at 2,500 particles. The aperture diameter of Multisizer 3 was selected for 50 μm.

(Preparation of Developer)

Each of the above toners was mixed with a silicone resin coated ferrite carrier at a volume average particle diameter of 60 μm to prepare a developer of a toner concentration of 6%. These developers were each designated as Developer 1 through Developer 44 corresponding to each of the toners, respectively.

(Apparatuses and Conditions for Evaluation)

Developers 1 through 44 prepared as above were each subjected to a practical printing test under normal temperature and normal humidity conditions at 25° C. and 65% RH using a digital copying machine, namely Konica Sitios 7075, manufactured by Konica Minolta Business Technologies, Inc.) in which the fixing device was modified as follows. As the image receiving medium, high quality paper (64 g/m$^2$) and transparent sheets for OHP were used.

[Charging of Photoreceptor]

Surface potential of photoreceptor: −700 V

[Developing Conditions]

DC bias: −500V

Dsd (being the distance between the photoreceptor and the developing sleeve): 600 μm Regulation of the developer layer: Magnetic H-Cut method Developer layer thickness: 700 μm Developing sleeve diameter: 40 mm (Fixing Device)

A heated roller type fixing device was used. Specifically, the heated roller was constituted of a cylindrical aluminum core metal including a heater in the central portion thereof which has an interior diameter of 40 mm, a thickness of 1.0 mm and a total width of 310 mm, and a tube of 120 μm of tetrafluoroethylene-perfluoroalkyl vinyl ether copolymer (PFA) covering the core metal, and a pressing roller constituted of a cylindrical iron roller of an interior diameter of 40 mm and a thickness of 2.0 mm as well as silicone rubber sponge of an Ascar C hardness of 48 and a thickness of 2 mm covering the core metal. The above heated roller and the pressing roller were placed into contact by applying a load of 150 N so as to form a nip of 5.8 mm depth. The printing line speed was set at 480 mm/second using the above fixing device. To clean the fixing device, polydiphenylsilicone at a viscosity of 10 Pa·s at 20° C. was supplied via a web method. The fixing temperature was set at 175° C. and regulated by the surface temperature of the heated roller. The coating amount of the silicone oil was 0.1 mg per A4 size sheet.

[Evaluation of Characteristics]

Produced practical prints were evaluated for (1) color reproducibility, (2) transparency, (3) charging property and (4) offset inhibiting capability, as well as (5) heat resistance and (6) light resistance. Evaluation rankings of A, B, C and D were acceptable while E was unacceptable in practice.

(1) Color Reproducibility

Color reproducibility of mono-color image printed on high quality paper was subjected to visual evaluation by 10 monitors according to the following criteria. The evaluation was performed within the toner adhering amount of 0.7±0.05 mg/cm$^2$. Results are listed in following Table 4.

(Evaluation Criteria)

B: Color reproducibility is excellent.

C: Color reproducibility is good.

D: Slight contamination in reproduced color is observed but the level of the color reproduction is commercially viable.

E: Major color contamination, resulting in non-viable prints.

(2) Transparency

Transparent images were printed out on a transparent OHP sheet as the image receiving medium, of which the visible light spectral transmittance was measured via an Automatic Spectrophotometer 330, manufactured by Hitachi Seisakusho Co., Ltd., using the OHP transparent sheet with no printed image as a reference. Any difference between the spectral transmittance at 650 nm and at 450 nm of the yellow toner, difference between the spectral transmittance at 650 nm and at 550 nm of the magenta toner, and difference between the spectral transmittance at 500 nm and at 600 nm of the cyan toner were determined. The transparency of the OHP image was ranked as follows. When the value was at least 70%, the transparency was judged to be acceptable. The evaluation was performed within an adhered toner amount of 0.7±0.05 mg/cm$^2$.

(Evaluation Criteria)

B: At least 90%

C: At or between 70%-90%

E: Less than 70%

(3) Variation of Electrical Charging Amount After Accelerated Aging

The variation of electrical charging amount of the toner following accelerated aging was evaluated based on the value of $Q_b/Q_a$ according to the following criteria, wherein $Q_a$ is the charging amount of the toner at the first printed sheet and $Q_b$ is the charging amount after the 1,000,000$^{th}$ print.

The electrical charging amount was measured by a blow-off type charging amount measuring instrument TB-200, manufactured by Toshiba Co., Ltd., having a stainless steel screen of 400 mesh, through which nitrogen gas blowing was performed for 10 minutes at a blowing pressure of $0.5\times10^4$ P. The charging amount in μC/g was calculated by dividing the measured charging amount by the weight of the blown-off toner.

(Evaluation Criteria)

B: The $Q_b/Q_a$ value was between 0.9 or more and less than 1.1.

C: The $Q_b/Q_a$ value between 0.8 or more and less than 0.9, or between 1.1 or more and less than 1.2.

D: The $Q_b/Q_a$ value was between 0.7 or more and less than 0.8, or between 1.2 or more and less than 1.3.

E: The $Q_b/Q_a$ value was less than 0.7, or more than 1.3.

(4) Offset Inhibiting Capability

To evaluate offset inhibiting capability, 10,000 A4 sheets of high quality paper were conveyed in the length direction and fixed, on each of which 5 mm wide solid band images were printed at right angle to the conveying direction. After that, 10,000 A4 sheets each having 20 mm wide halftone images printed at the right angle to the conveying direction were conveyed in the width direction and then the machine was placed on stand by. After for one night on stand by, the machine was restarted and any contamination of the image formed on the first print caused by the offset phenomenon was visually evaluated according to the following criteria.

(Evaluation Criteria)

B: No visible contamination was formed on the image.

C: Slight contamination was formed on the image but no problem for practical use.

E: The image was obviously contaminated and unacceptable for practical use.

(5) Heat Resistance

Coloring of the fixing roller and the recovered silicone oil was visually observed and evaluated according to the following criteria.

(Evaluation Criteria)

C: The fixing roller and the silicone oil were not colored.

E: The fixing roller and the silicone oil were colored.

measured, and the remaining oil-soluble dye ratio, (Ci−Cf)/Ci)×100%, was calculated based on any difference of before and after the xenon irradiation. The image density was measured by a reflective densitometer X-Rite 310TR.

(Evaluation Criteria)

A: The remaining dye ratio was not less than 98%.

B: The remaining dye ratio was not less than 95% and less than 98%.

C: The remaining dye ratio was not less than 90% and less than 95%.

D: The remaining dye ratio was not less than 80% and less than 90%.

E: The remaining dye ratio was less than 80%.

These evaluation results are listed in following Table 4.

TABLE 4

| | Toner No. | Color reproducibility | Transparency | Charging property | Offset inhibiting capability | Head resistance | Light resistance | Heat & Moisture resistance + Light resistance |
|---|---|---|---|---|---|---|---|---|
| Comp. | 1 | C | C | C | C | C | C | E |
| Comp. | 2 | C | C | C | C | E | B | E |
| Comp. | 3 | B | C | C | C | E | B | E |
| Inv. | 4 | B | B | B | C | C | A | C |
| Inv. | 5 | C | C | B | C | C | A | C |
| Inv. | 6 | B | B | B | C | C | A | B |
| Inv. | 7 | B | B | B | C | C | A | B |
| Inv. | 8 | B | B | C | C | C | A | C |
| Inv. | 9 | B | B | C | C | C | A | C |
| Inv. | 10 | B | B | C | C | C | A | C |
| Inv. | 11 | B | B | B | C | C | B | D |
| Inv. | 12 | B | B | B | C | C | A | C |
| Inv. | 13 | C | B | B | C | C | B | C |
| Inv. | 14 | B | B | B | C | C | B | C |
| Inv. | 15 | B | B | B | C | C | B | C |
| Inv. | 16 | B | B | B | C | C | B | C |
| Inv. | 17 | B | B | B | C | C | A | C |
| Inv. | 18 | B | B | B | C | C | A | C |
| Inv. | 19 | B | B | B | C | C | A | C |
| Inv. | 20 | B | B | B | C | C | A | C |
| Inv. | 21 | C | B | B | C | C | B | C |
| Inv. | 22 | B | B | B | C | C | B | C |
| Inv. | 23 | C | B | B | C | C | B | C |
| Inv. | 24 | B | B | B | C | C | B | C |
| Inv. | 25 | B | B | B | C | C | A | C |
| Inv. | 26 | B | B | B | C | C | A | C |
| Inv. | 27 | B | B | B | C | C | B | C |
| Inv. | 28 | B | B | B | C | C | B | C |
| Inv. | 29 | C | B | B | C | C | B | C |
| Inv. | 30 | B | B | B | C | C | B | C |
| Inv. | 31 | B | B | B | C | C | B | C |
| Inv. | 32 | B | B | B | C | C | C | C |
| Inv. | 33 | B | B | B | C | C | A | C |
| Inv. | 34 | C | B | B | C | C | A | C |
| Inv. | 35 | B | B | B | C | C | A | C |
| Inv. | 36 | B | B | B | C | C | A | C |
| Inv. | 37 | B | B | B | C | C | A | C |
| Inv. | 38 | B | B | B | C | C | B | C |
| Inv. | 39 | B | B | B | C | C | B | C |
| Inv. | 40 | B | B | B | C | C | B | C |
| Inv. | 41 | B | B | B | C | C | B | C |
| Inv. | 42 | B | B | B | C | C | A | B |
| Inv. | 43 | B | B | B | B | C | A | B |
| Inv. | 44 | B | B | B | B | C | A | B |

Comp.: Comparative example,
Inv.: This Invention (6) Light Resistance

For evaluation of light resistance, image density Ci was measured just after printing and then the sample was irradiated for 10 days in 85,000 lux xenon light using a weather meter, namely Atlas C 165. After that, image density Cf was The evaluation results show that Developers 4-44 of this invention each exhibits superior color reproducibility, transparency, electrical charging capability and offset inhibiting capability and high quality images can be assuredly produced. According to observation of the fixing roller and the recovered silicone oil, no coloration caused by the oil-soluble dye was observed and superiority in thermal resistivity can be assured. Further, light resistance is equal to or more compared with the nickel chelate dye [being Oil-soluble Dye (A-1)] and it turns out that the toners of this invention are superior. Further, the toners produced with the methods of this invention by adding the oil-soluble dye capable of chelating and the metal compound exhibit excellent characteristics with a fading resistance test even after a heat and humidity resistance test.

What is claimed is:

1. A method for producing an electrophotographic toner comprising the steps of:

(1) mixing a water-insoluble organic solvent, an oil-soluble dye capable of chelating with a metal, a metal compound and water to form an oil-soluble dye dispersion, (2) removing the organic solvent from the oil-soluble dye dispersion to form colored microscopic particles, and (3) adding an emulsion of a thermoplastic resin to the colored microscopic particles so as to associate the particles with slow coagulation;

wherein the oil-soluble dye dispersion further comprising a resin having different compositions from the thermoplastic resin in the step (1) and the colored microscopic particle containing the resin having different compositions from the thermoplastic resin is formed in the step (2).

2. The method for producing the electrophotographic toner of claim 1, wherein the oil-soluble dye dispersion prepared in the first process, contains the oil-soluble dye represented by Formula (1) capable of chelating with a metal, and a copper compound represented by Formula (2):

Formula (1)

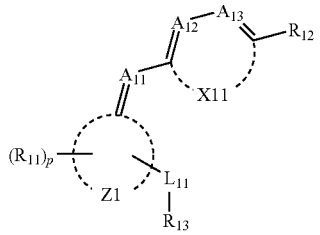

wherein $R_{11}$ are each independently a hydrogen atom or a substituent, $R_{12}$ is an —$NR_{14}R_{15}$ group or an —$OR_{16}$ group, $R_{13}$ is a hydroxyl group, an alkoxy group, an aryloxy group, an amino group, an amide group, an alkylsulfonylamino group or an arylsulfonylamino group, $A_{11}$, $A_{12}$ and $A_{13}$ are each independently a —$CR_{17}$= group or an —N= atom, X11 is a group of atoms necessary for forming a five- or six-member aromatic or heterocyclic ring, Z1 is a group of atoms necessary for forming a heterocyclic ring including at least one nitrogen atom which may have a substituent or may form a condensed ring by the substituent, $R_{14}$ through $R_{17}$ are each independently a hydrogen atom or a substituent, $L_{11}$ is a linking group having one or two carbon atoms or forming a part of the ring structure which may form a five-or six-member ring structure by bonding with $R_{13}$, and p is an integer of 0 to 3;

M(X1)m(X2)n.(W1)s Formula (2)

wherein M is a divalent Cu ion, X1 and X2 are each independently a mono- or di-dentate ligand which may be the same as or different from each other, and X1 and X2 may be bonded with together, m, n and s are each an integer of 0 to 2, and W1 is a counter ion when the counter ion is necessary for neutralizing the electric charge.

3. The method for producing the electrophotographic toner of claim 2, wherein the heterocyclic ring represented by Z1 is a ring represented by Formula (3) or (4):

Formula (3)

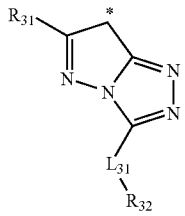

Formula (4)

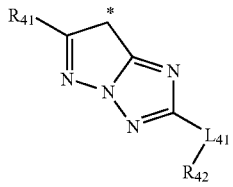

wherein $R_{31}$ and $R_{41}$ are each independently a hydrogen atom or a substituent, $R_{32}$ and $R_{42}$ is a hydrogen atom, an alkoxy group, an aryloxy group, an amino group, an alkylsulfonylamino group or an arylsulfonylamino group, and $L_{31}$ and $L_{41}$ are each a linking group having one or two carbon atoms or forming a part of a ring structure and bonded with $A_{11}$ in Formula (1) at the site represented by *.

4. The method for producing an electrophotographic toner of claim 2, wherein the heterocyclic ring represented by Z1 is a ring represented by Formula (5) or (6);

Formula (5)

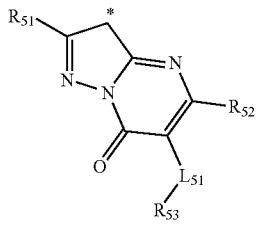

Formula (6)

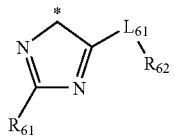

wherein $R_{51}$, $R_{52}$ and $R_{61}$ are each independently a hydrogen atom or a substituent, $R_{53}$ and $R_{62}$ is a hydrogen atom, an alkoxy group, an aryloxy group, an amino group, an alkylsulfonylamino group or an arylsulfonylamino group, and $L_{51}$ and $L_{61}$ are each a linking group having one or two carbon atoms or forming a part of a ring structure and bonded with $A_{11}$ in Formula (1) at the site represented by *.

5. The method for producing an electrophotographic toner of claim 2, wherein the heterocyclic ring represented by Z1 is a ring represented by Formula (7) or (8);

Formula (7)

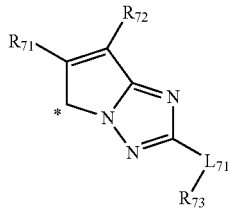

Formula (8)

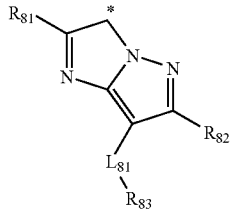

wherein $R_{71}$, $R_{72}$, $R_{81}$ and $R_{82}$ are each independently a hydrogen atom or a substituent, $R_{73}$ and $R_{83}$ is a hydrogen atom, an alkoxy group, an aryloxy group, an amino group, an alkylsulfonylamino group or an arylsulfonylamino group, and $L_{71}$ and $L_{81}$ are each a linking group having one or two carbon atoms or forming a part of a ring structure and bonded with $A_{11}$ in Formula (1) at the site represented by *.

6. The method for producing an electrophotographic toner of claim 2, wherein $A_{11}$ in Formula (1) is a group represented by —$CR_{17}$= is a which $R_{17}$ is a hydrogen atom or a substituent.

7. The method for producing an electrophotographic toner of claim 2, wherein the ligand represented by $X_1$ or $X_2$ in Formula (2) is one represented by Formula (9):

Formula (9)

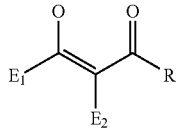

wherein $E_1$ and $E_2$ are each an electron-withdrawing group having a Hammett's substituent constant (σp) of from 0.1 to 0.9, and R is an alkyl group, an aryl group, a heterocyclic group, an alkoxy group, an aryloxy group or an amino group, each of which may have a substituent.

8. The method for producing an electrophotographic toner of claim 1, wherein an average particle diameter of the colored microscopic particles is 10 to 100 nm.

9. The method for producing an electrophotographic toner of claim 1, wherein the colored microscopic particle is constituted by a core comprising the resin and the oil-soluble dye and a resin shell covering the core.

10. An electrophotographic toner produced by the method for producing an electrophotographic toner of claim 1.

11. The electrophotographic toner of claim 10, wherein the amount of the metal compound is from 1.1 to 2 times in mole of the amount of the oil-soluble dye capable of chelating with the metal.

12. The electrophotographic toner of claim 11, wherein the oil-soluble dye is represented by Formula (1) and the metal compound is a copper compound represented by Formula (2):

Formula (1)

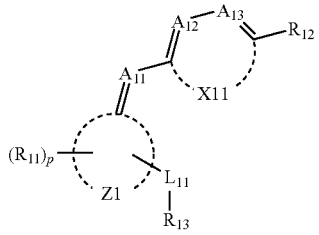

wherein $R_{11}$ are each independently a hydrogen atom or a substituent, $R_{12}$ is an —$NR_{14}R_{15}$ group or an —$OR_{16}$ group, $R_{13}$ is a hydroxyl group, an alkoxy group, an aryloxy group, an amino group, an amide group, an alkylsulfonylamino group or an arylsulfonylamino group, $A_{11}$, $A_{12}$ and $A_{13}$ are each independently a —$CR_{17}$= group or an N= atom, X11 is a group of atoms necessary for forming a five- or six-member aromatic or heterocyclic ring, Z1 is a group of atoms necessary for forming a heterocyclic ring including at least one nitrogen atom which may have a substituent or may form a condensed ring by the substituent, $R_{14}$ through $R_{17}$ are each independently a hydrogen atom or a substituent, $L_{11}$ is a linking group having one or two carbon atoms or forming a part of the ring structure which may form a five-or six-member ring structure by bonding with $R_{13}$, and p is an integer of 0 to 3;

M(X1)m(X2)n.(W1)s Formula (2)

wherein M is a divalent Cu ion, X1 and X2 are each independently a mono- or di-dentate ligand which may be the same as or different from each other, and X1 and X2 may be bonded with together, m, n and s are each an integer of 0 to 2, and W1 is a counter ion when the counter ion is necessary for neutralizing the electric charge.

* * * * *